US011607590B2

(12) United States Patent
Woodward et al.

(10) Patent No.: US 11,607,590 B2
(45) Date of Patent: Mar. 21, 2023

(54) GOLF CLUB HEADS WITH HOSEL INSERTS AND RELATED METHODS

(71) Applicant: KARSTEN MANUFACTURING CORPORATION, Phoenix, AZ (US)

(72) Inventors: Alex G. Woodward, Phoenix, AZ (US); Jacob T. Clarke, Apex, NC (US); Eric J. Morales, Laveen, AZ (US); Ryan M. Stokke, Anthem, AZ (US); Evan R. Greer, Peoria, AZ (US); Eric V. Cole, Phoenix, AZ (US); David S. Kultala, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/304,836

(22) Filed: Jun. 25, 2021

(65) Prior Publication Data

US 2022/0054899 A1 Feb. 24, 2022

Related U.S. Application Data

(63) Continuation-in-part of application No. 17/330,309, filed on May 25, 2021, which is a continuation of application No. 16/523,839, filed on Jul. 26, 2019, now Pat. No. 11,013,964, which is a continuation of application No. 15/831,515, filed on Dec. 5, 2017, now Pat. No. 10,398,946, which is a continuation of application No. 15/003,494, filed on Jan. 21, 2016, now Pat. No. 9,868,035, which is a continuation-in-part of application No. 14/282,786, filed on May 20, 2014, now Pat. No. 9,327,170, which is a continuation-in-part of application No. 13/795,653, filed on Mar. 12, 2013, now Pat. No. 9,168,426, and a continuation-in-part of application No. 13/735,123, filed on Jan. 7, 2013, now Pat. No. 9,192,823, and a continuation-in-part of application (Continued)

(51) Int. Cl.
*A63B 53/02* (2015.01)
*A63B 53/04* (2015.01)

(52) U.S. Cl.
CPC ..... *A63B 53/02* (2013.01); *A63B 53/0466* (2013.01); *A63B 53/023* (2020.08); *Y10T 29/49826* (2015.01)

(58) Field of Classification Search
CPC .... A63B 53/02; A63B 53/0466; A63B 53/023
See application file for complete search history.

(56) References Cited

U.S. PATENT DOCUMENTS 2,027,452 A 1/1936 Rusing
2,219,670 A 10/1940 Wettlaufer
(Continued)

FOREIGN PATENT DOCUMENTS

EP 0535848 4/1993
JP 2001017584 1/2001
(Continued)

OTHER PUBLICATIONS

International Search Report and Written Opinion of the International Searching Authority from PCT Application No. PCT/US2016/014322, dated Mar. 29, 2016.

*Primary Examiner* — William M Pierce

(57) ABSTRACT

Embodiments of golf coupling mechanisms are presented herein. Other examples and related methods are also disclosed herein.

19 Claims, 24 Drawing Sheets

Related U.S. Application Data

No. 13/468,663, filed on May 10, 2012, now Pat. No. 8,926,447, said application No. 13/735,123 is a continuation-in-part of application No. 13/468,675, filed on May 10, 2012, now Pat. No. 8,932,147, said application No. 14/282,786 is a continuation-in-part of application No. 13/468,675, said application No. 13/735,123 is a continuation-in-part of application No. 13/468,663, and a continuation-in-part of application No. 13/468,677, filed on May 10, 2012, now Pat. No. 8,419,567, said application No. 13/468,663 is a continuation-in-part of application No. 13/429,319, filed on Mar. 24, 2012, now Pat. No. 8,790,191, said application No. 13/468,675 is a continuation-in-part of application No. 13/429,319, said application No. 13/468,677 is a continuation of application No. 13/429,319, said application No. 14/282,786 is a continuation-in-part of application No. 13/429,319.

(60) Provisional application No. 62/254,081, filed on Nov. 11, 2015, provisional application No. 62/107,240, filed on Jan. 23, 2015, provisional application No. 61/590,232, filed on Jan. 24, 2012, provisional application No. 61/529,880, filed on Aug. 31, 2011.

(56) References Cited

U.S. PATENT DOCUMENTS

| | | | |
|---|---|---|---|
| 2,425,808 | A | 8/1947 | Jakosky |
| 2,962,286 | A | 11/1960 | Brouwer |
| 4,854,582 | A | 8/1989 | Yamada |
| 4,948,132 | A | 8/1990 | Wharton |
| 5,039,098 | A | 8/1991 | Pelz |
| 5,586,944 | A | 12/1996 | Nagamoto et al. |
| 5,624,330 | A | 4/1997 | Atsushi |
| 6,050,903 | A | 4/2000 | Lake |
| 6,368,230 | B1 | 4/2002 | Helmstetter et al. |
| 6,652,388 | B1 | 11/2003 | Lenhof |
| 6,752,726 | B2 | 6/2004 | Burrows |
| 6,863,622 | B1 | 3/2005 | Hsu |
| 6,890,269 | B2 | 5/2005 | Burrows |
| 7,029,402 | B2 | 4/2006 | Nakajima |
| 7,083,529 | B2 | 8/2006 | Cackett et al. |
| 7,258,623 | B2 | 8/2007 | Halleck et al. |
| 7,300,359 | B2 | 11/2007 | Hocknell et al. |
| 7,326,126 | B2 | 2/2008 | Holt et al. |
| 7,438,645 | B2 | 10/2008 | Hsu |
| D583,001 | S | 12/2008 | Evans et al. |
| D583,891 | S | 12/2008 | DeMille et al. |
| D588,660 | S | 3/2009 | Evans et al. |
| 7,500,920 | B2 | 3/2009 | Sugimae et al. |
| D590,036 | S | 4/2009 | Evans et al. |
| D590,906 | S | 4/2009 | Cackett et al. |
| 7,566,279 | B2 | 7/2009 | Nakashima |
| 7,789,769 | B2 | 1/2010 | Sugimoto |
| D614,712 | S | 4/2010 | Toulon et al. |
| 7,699,717 | B2 | 4/2010 | Morris et al. |
| 7,722,475 | B2 | 5/2010 | Thomas et al. |
| 7,789,766 | B2 | 9/2010 | Morris |
| 7,819,754 | B2 | 10/2010 | Evans |
| 7,819,755 | B2 | 10/2010 | Sugimae et al. |
| 7,846,037 | B2 | 12/2010 | Burnett et al. |
| 7,878,921 | B2 | 2/2011 | Bennett et al. |
| 7,887,431 | B2 | 2/2011 | Beach et al. |
| 7,909,705 | B2 | 3/2011 | Gill |
| 7,909,706 | B2 | 3/2011 | Cole |
| 7,922,599 | B2 | 4/2011 | Yamamoto |
| 7,931,542 | B2 | 4/2011 | Kusumoto |
| 7,963,855 | B2 | 6/2011 | Sander et al. |
| 7,963,856 | B2 | 6/2011 | Yamamoto |
| 7,892,105 | B2 | 7/2011 | Galloway |
| 7,997,997 | B2 | 8/2011 | Bennett et al. |
| 8,075,417 | B2 | 12/2011 | Thomas et al. |
| 8,096,894 | B2 | 1/2012 | Sander |
| 8,142,306 | B2 | 3/2012 | De La Cruz et al. |
| 8,162,774 | B2 | 4/2012 | Sato et al. |
| 8,177,661 | B2 | 5/2012 | Beach et al. |
| 8,182,360 | B2 | 5/2012 | Cameron |
| 8,192,299 | B2 | 6/2012 | Sato et al. |
| 8,235,834 | B2 | 8/2012 | De La Cruz |
| 8,235,837 | B2 | 8/2012 | Bennett et al. |
| 8,262,498 | B2 | 9/2012 | Beach et al. |
| 8,262,499 | B2 | 9/2012 | Murphy |
| 8,277,333 | B2 | 10/2012 | Thomas et al. |
| 8,287,400 | B2 | 10/2012 | Thomas |
| 8,337,319 | B2 | 12/2012 | Sargent |
| 8,403,770 | B1 | 3/2013 | Aguinaldo et al. |
| 8,419,567 | B2 | 4/2013 | Jertson et al. |
| 8,523,701 | B2 | 9/2013 | Knutson et al. |
| 8,535,173 | B2 | 9/2013 | Golden et al. |
| 8,574,093 | B2 | 11/2013 | Sato et al. |
| 8,585,511 | B2 | 11/2013 | Sato et al. |
| 8,636,606 | B2 | 1/2014 | Sato |
| 8,668,597 | B2 | 3/2014 | Yamamoto |
| 8,727,905 | B2 | 5/2014 | Harvell et al. |
| 8,771,097 | B2 | 7/2014 | Bennett |
| 8,858,357 | B2 | 10/2014 | Golden |
| 8,876,626 | B2 | 11/2014 | Suwa |
| 8,926,447 | B2 | 1/2015 | Jertson |
| 9,022,879 | B2 | 5/2015 | Sato |
| 9,033,821 | B2 | 5/2015 | Beach et al. |
| 9,216,326 | B2 | 12/2015 | Beach et al. |
| 9,283,445 | B2 | 3/2016 | Moore |
| 9,908,010 | B2 | 3/2018 | Boggs et al. |
| 10,307,646 | B2 | 6/2019 | Mizutani |
| 2001/0007835 | A1 | 7/2001 | Baron |
| 2006/0287125 | A1 | 12/2006 | Hocknell et al. |
| 2007/0117645 | A1 | 5/2007 | Nakashima |
| 2008/0254909 | A1 | 10/2008 | Callinan et al. |
| 2008/0280693 | A1 | 11/2008 | Chai |
| 2009/0062029 | A1 | 3/2009 | Stites et al. |
| 2009/0233728 | A1 | 9/2009 | Liou |
| 2010/0035700 | A1 | 2/2010 | Yu et al. |
| 2010/0197423 | A1 | 8/2010 | Thomas et al. |
| 2010/0255927 | A1 | 10/2010 | Evans |
| 2011/0111881 | A1 | 5/2011 | Sander et al. |
| 2011/0165960 | A1 | 7/2011 | Sargent |
| 2011/0319187 | A1 | 12/2011 | Chou |
| 2012/0165111 | A1 | 6/2012 | Cheng |
| 2012/0316006 | A1 | 12/2012 | Kitagawa et al. |
| 2013/0230654 | A1 | 9/2013 | Sargent et al. |

FOREIGN PATENT DOCUMENTS

| | | |
|---|---|---|
| JP | 2003070940 | 3/2003 |
| JP | 2006042951 | 2/2006 |
| JP | 2008029691 | 2/2008 |
| JP | 2008142338 | 6/2008 |
| JP | 2009050676 | 3/2009 |
| JP | 3154639 | 10/2009 |
| KR | 20070021382 | 2/2007 |
| WO | 3803427 | 5/1988 |
| WO | 20070211160 | 2/2007 |

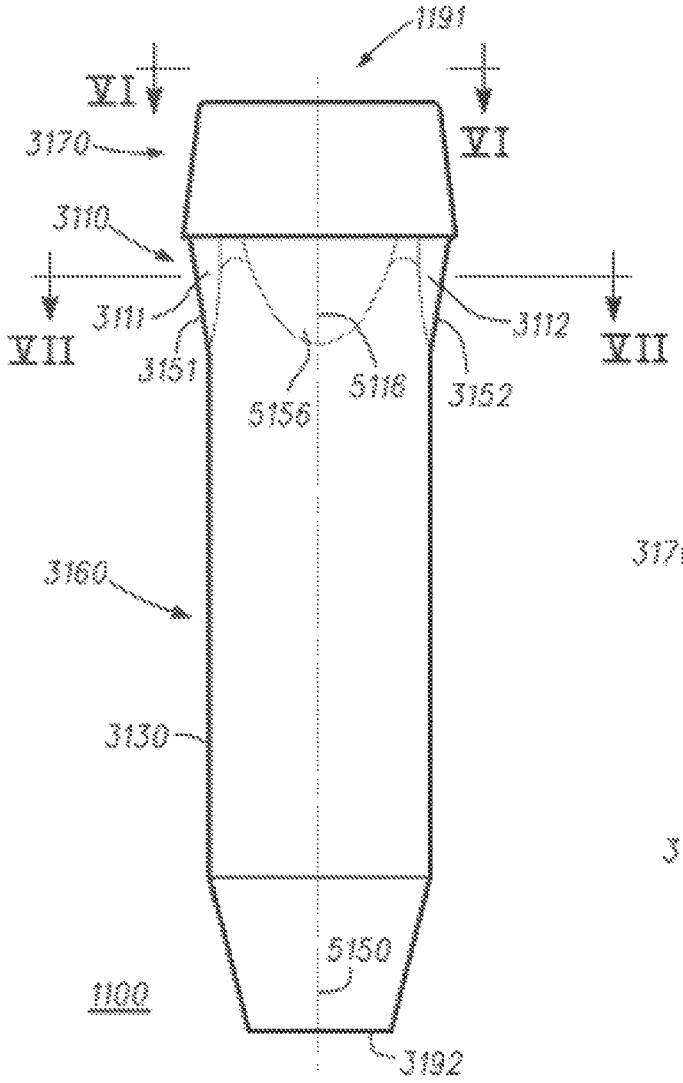
Fig. 5
Fig. 6
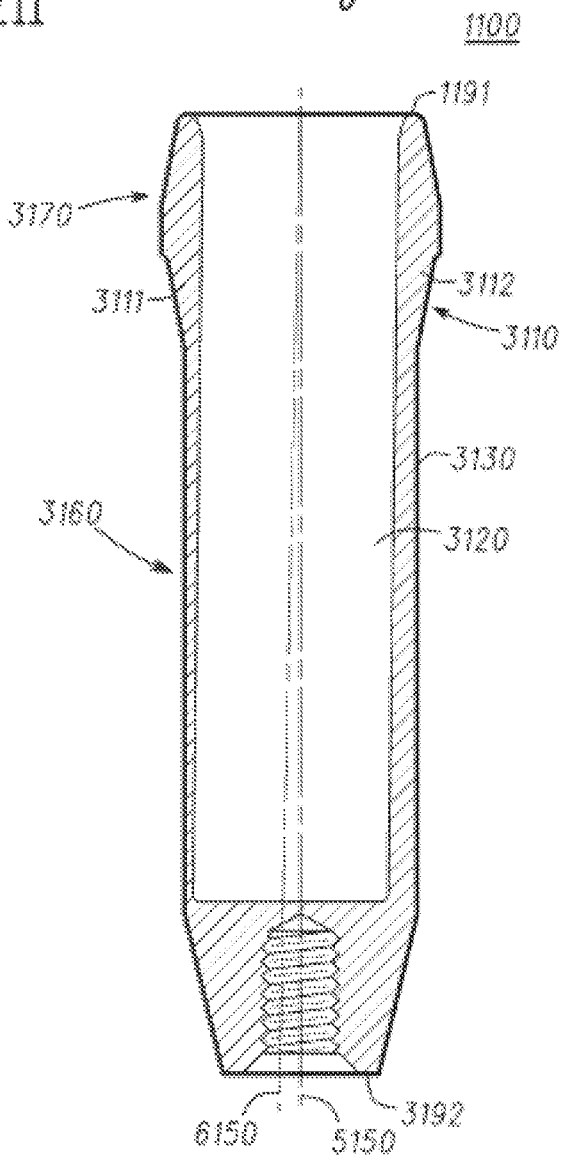

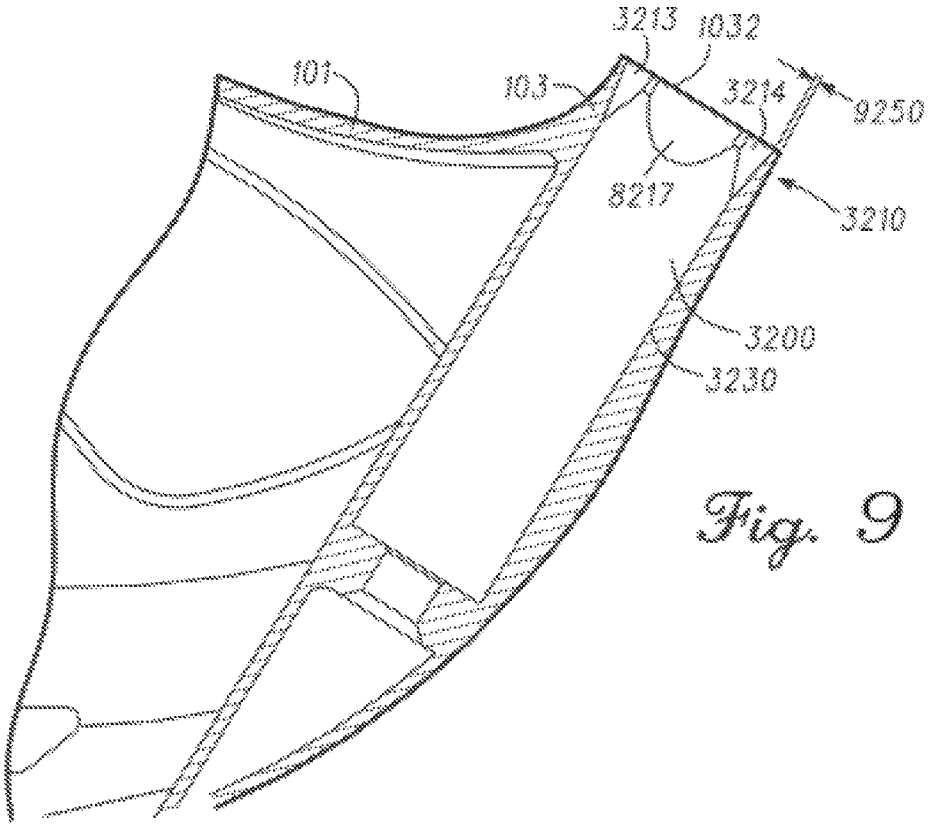
Fig. 9
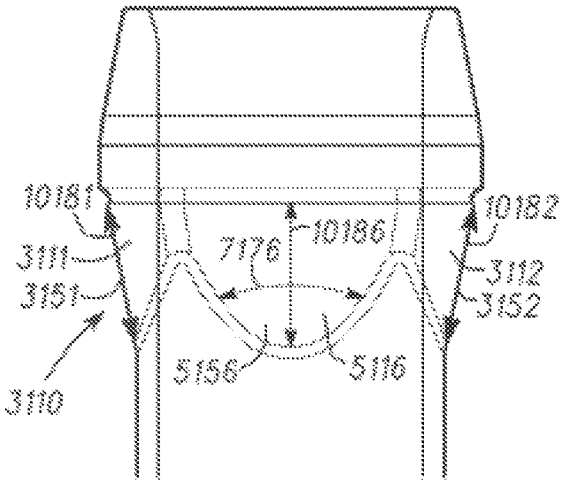
1100 Fig. 10
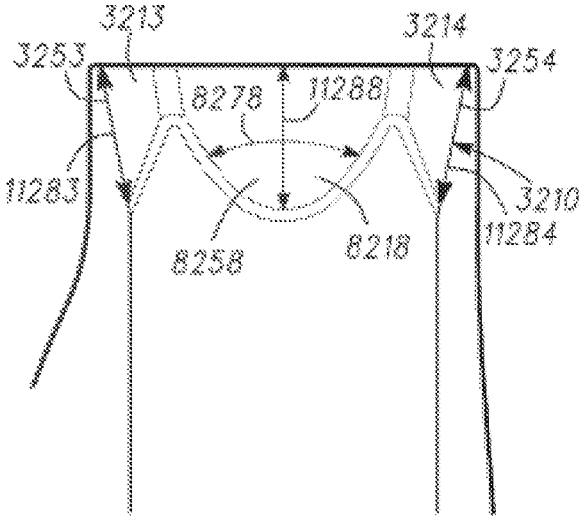
Fig. 11 3200

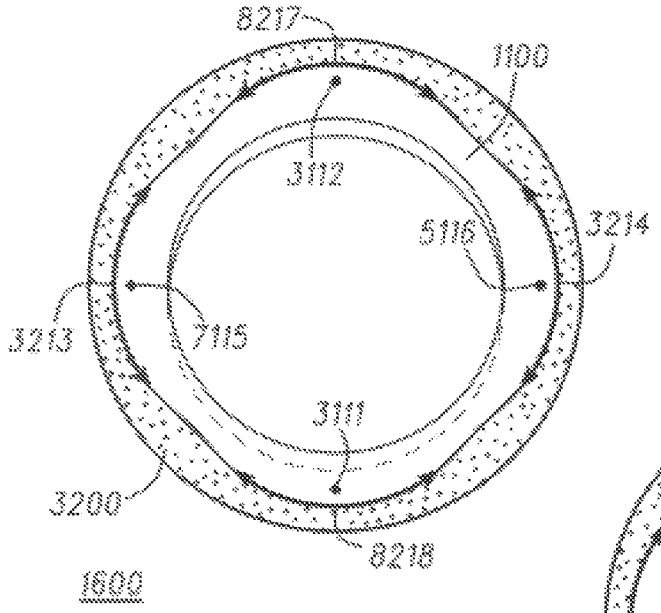
Fig. 16
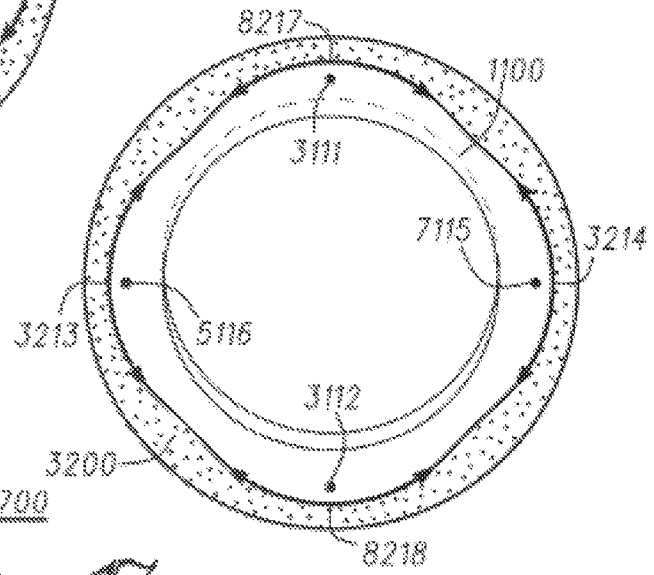
Fig. 17
Fig. 18
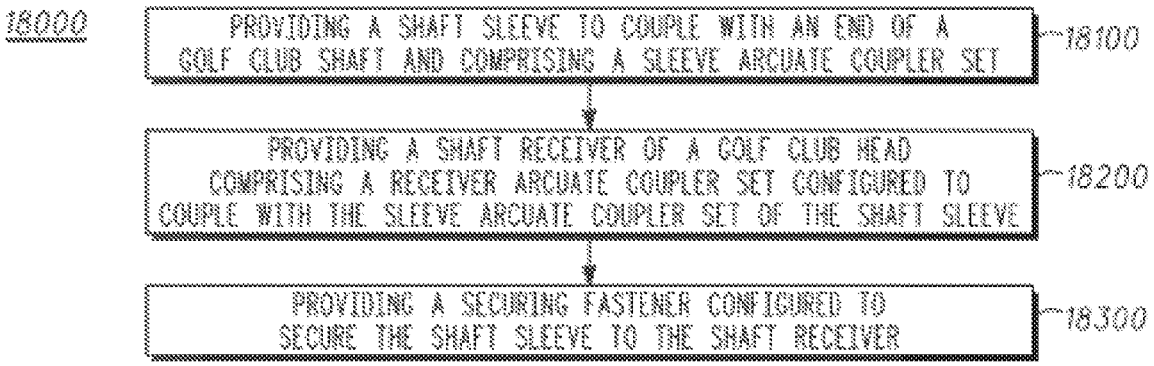

GOLF CLUB HEADS WITH HOSEL INSERTS AND RELATED METHODS

CROSS REFERENCE TO RELATED APPLICATIONS

This is a continuation-in-part of U.S. patent application Ser. No. 17/330,309, filed May 25, 2021, which is a continuation of U.S. patent application Ser. No. 16/523,839, filed on Jul. 26, 2019, now U.S. Pat. No. 11,013,964, which is a continuation of U.S. patent application Ser. No. 15/831,515, filed on Dec. 5, 2017, now U.S. Pat. No. 10,398,946, which is a continuation of U.S. patent application Ser. No. 15/003,494, filed on Jan. 21, 2016, now U.S. Pat. No. 9,868,035, which is a continuation in part of U.S. patent application Ser. No. 14/282,786, filed May 20, 2014 which is a continuation in part of: (i) U.S. patent application Ser. No. 13/795,653, filed on Mar. 12, 2013, now U.S. Pat. No. 9,327,170; (ii) U.S. patent application Ser. No. 13/429,319, filed on Mar. 24, 2012, now U.S. Pat. No. 8,790,191; (iii) U.S. patent application Ser. No. 13/468,663, filed on May 10, 2012, now U.S. Pat. No. 8,926,447; (iv) U.S. patent application Ser. No. 13/468,675, filed on May 10, 2012, now U.S. Pat. No. 8,932,147; and (v) U.S. patent application Ser. No. 13/735,123, filed on Jan. 7, 2013, now U.S. Pat. No. 9,192,823, all of which are fully incorporated herein by references.

U.S. patent application Ser. No. 15/003,494, filed Jan. 21, 2016 claims the benefit of U.S. Prov. Patent Application No. 62/107,240, filed Jan. 23, 2015, and U.S. Prov. Patent Application No. 62/254,081 filed Nov. 11, 2015.

U.S. patent application Ser. No. 13/429,319 claims the benefit of U.S. Provisional Patent Application No. 61/590,232, filed on Jan. 24, 2012, and of U.S. Provisional Patent Application No. 61/529,880, filed on Aug. 31, 2011.

U.S. patent application Ser. No. 13/468,663 and U.S. patent application Ser. No. 13/468,675 each are a continuation in part of U.S. patent application Ser. No. 13/429,319. U.S. patent application Ser. No. 13/468,677 is a continuation of U.S. patent application Ser. No. 13/429,319.

U.S. patent application Ser. No. 13/735,123 is a continuation in part of U.S. patent application Ser. No. 13/468,663, filed on May 10, 2012, U.S. patent application Ser. No. 13/468,675, filed on May 10, 2012, and U.S. patent application Ser. No. 13/468,677, filed on May 10, 2015.

U.S. Prov. Patent Application No. 62/107,240, U.S. Prov. Patent Application No. 62/254,081, U.S. patent application Ser. No. 14/282,786, U.S. patent application Ser. No. 13/795,653, U.S. patent application Ser. No. 13/429,319, U.S. patent application Ser. No. 13/468,663, U.S. patent application Ser. No. 13/468,675, U.S. patent application Ser. No. 13/735,123, U.S. patent application Ser. No. 13/468,677, U.S. Prov. Patent Application No. 61/590,232, and U.S. Prov. Patent Application No. 61/529,880 each are incorporated herein by reference in their entirety.

TECHNICAL FIELD

The present disclosure relates generally to sports equipment, and relates, more particularly, to golf coupling mechanisms and related methods.

BACKGROUND

Several sports, like golf, require equipment with features that can be selected or custom-fit to an individual's characteristics or preferences. For example, the recommended type of club shaft, type of club head, and/or the loft or lie angle of the club head may vary based on the individual's characteristics, such as skill, age or height. Once assembled, however, golf clubs normally have fixed, unchangeable coupling mechanisms between their golf club shafts and golf club heads. Accordingly, when determining suitable equipment for the individual, an unnecessarily large number of golf clubs with such fixed coupling mechanisms must be available to test different combinations of club shafts, club heads, loft angles, and/or lie angles. In addition, if the individual's characteristics or preferences were to change, his golf equipment would not be adjustable to account for such changes. Adjustable coupling mechanisms can be configured to provide such flexibility in changeably setting different features of golf clubs, but may introduce instabilities leading to lack of cohesion or concentrations of stress at the golf club head and golf club shaft coupling. Considering the above, further developments in golf coupling mechanisms and related methods will enhance utilities and adjustability features for golf clubs.

BRIEF DESCRIPTION OF THE DRAWINGS

The present disclosure may be better understood from a reading of the following detailed description of examples of embodiments, taken in conjunction with the accompanying figures.

FIG. 5 illustrates a side view of the shaft sleeve decoupled from the golf club head.

FIG. 6 illustrates a cross sectional view of the shaft sleeve along cross-sectional line VI-VI of FIG. 5.

FIG. 9 illustrates a side cross-sectional side view of the golf club head of FIG. 1 along cross-sectional line of FIG. 2, with the shaft sleeve removed therefrom.

FIG. 10 illustrates a side view of a portion of a sleeve coupler set of the shaft sleeve.

FIG. 11 illustrates a side x-ray view of a portion a receiver coupler set of the shaft receiver.

FIG. 16 illustrates a top cross-sectional view of the golf coupling mechanism in a third configuration, with respect to the viewpoint of with the shaft sleeve removed therefrom line XIV-XIV of FIG. 4.

FIG. 17 illustrates a top cross-sectional view of the golf coupling mechanism in a fourth configuration, with respect to the viewpoint of with the shaft sleeve removed therefrom line XIV-XIV of FIG. 4.

FIG. 18 illustrates a flowchart for a method that can be used to provide, form, and/or manufacture a golf coupler mechanism in accordance with the present disclosure.

Figure 1:
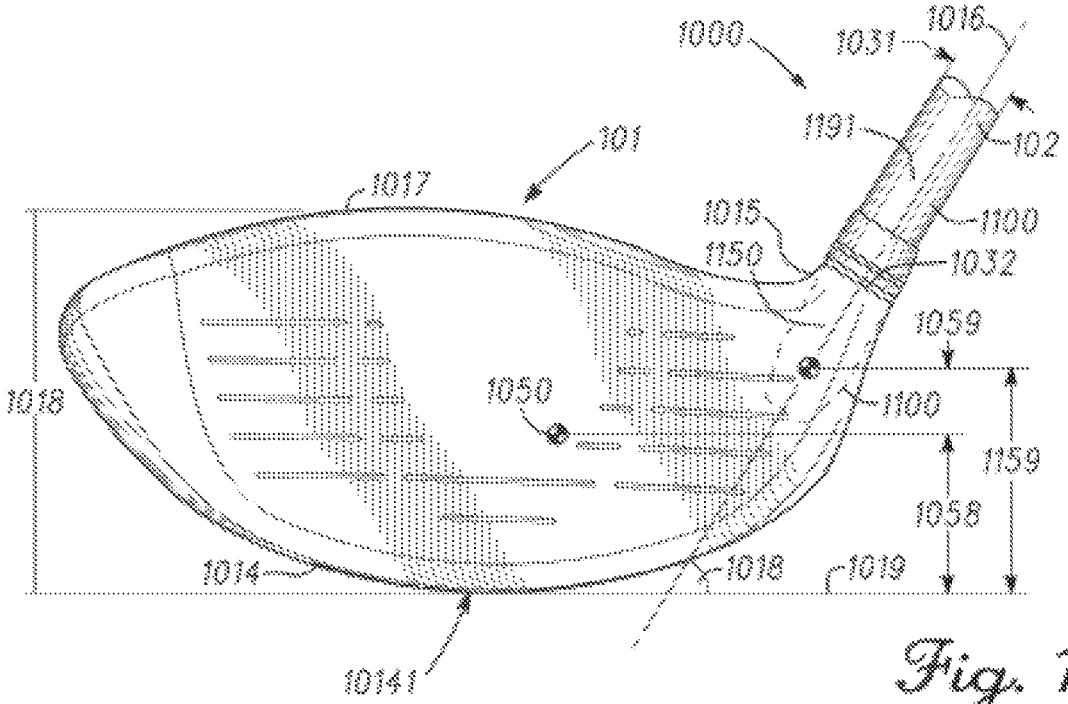
FIG. 1 illustrates a front perspective view of a golf club head with a golf coupling mechanism according to one example of the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

DETAILED DESCRIPTION

Some embodiments include a golf club head. The golf club head comprises a club head body, and the golf club head body comprises a sole comprising a sole bottom end, a top portion opposite the sole portion, a heel portion, a toe portion opposite the heel portion, a rear portion, a front portion opposite the rear portion, and a hosel. Further, the front portion comprises a strike face. The golf club head also comprises a shaft sleeve insertable into the hosel and configured to couple a golf club shaft with the hosel. The hosel can comprise a hosel bore configured to receive the shaft sleeve. Meanwhile, the shaft sleeve comprises (i) a shaft bore configured to receive an end of the golf club shaft, (ii) a shaft sleeve body comprising a sleeve body outer wall, and at least one coupler at the sleeve body outer wall, and (iii) a shaft sleeve cap configured to be coupled with the shaft sleeve body. When the golf club head is at an address position, with the shaft sleeve secured in the hosel, the shaft sleeve center of gravity can be located at a shaft sleeve CG vertical distance less than or equal to approximately 46 millimeters relative to the sole bottom end.

In these or other embodiments, the shaft sleeve body can comprise an intermediate region, the shaft sleeve body can comprise a sleeve body wall, and the sleeve body wall can comprise an intermediate region thickness of approximately 0.020 inch at the intermediate region.

In these or other embodiments, the shaft sleeve body can comprise a coupler region, the shaft sleeve body can comprise the sleeve body wall, the sleeve body wall can comprise a coupler region thickness that varies at the coupler region from a greatest thickness of the sleeve body wall to a least thickness of the sleeve body wall, the greatest thickness of the sleeve body wall can be less than or equal to approximately 0.75 inch, and the least thickness off the sleeve body wall can be greater than or equal to approximately 0.020 inch.

In these or other embodiments, the hosel bore can comprise at least one receiver configured to engage the at least one coupler, and when the hosel bore receives the shaft sleeve, the at least one coupler can engage the at least one receiver to restrict a rotation of the shaft sleeve relative to the hosel.

In these or other embodiments, the shaft sleeve cap can be removably coupled with the shaft sleeve body.

In these or other embodiments, the at least one coupler can comprise multiple couplers, the multiple couplers can comprise a first coupler and a second coupler, and a coupler length of the first coupler can be different than a coupler length of the second coupler.

In these or other embodiments, the at least one coupler can comprise a coupler length, and the coupler length can be greater than or equal to approximately 0.260 inch and less than or equal to approximately 0.38 inch.

In these or other embodiments, the shaft sleeve body can comprise a receiving groove, the shaft sleeve cap can comprise an extrusion portion, and the receiving groove can be configured to receive the extrusion portion when the shaft sleeve body is coupled with the shaft sleeve cap.

In these or other embodiments, the shaft sleeve cap comprises at least one slit and a cap wall, and the at least one slit is configured to permit the cap wall to compress axially.

In these or other embodiments, the shaft sleeve cap can comprise a cap bore and one or more ribs extending into the cap bore, and when the shaft bore receives the end of the golf club shaft, the one or more ribs can center the golf club shaft within the shaft bore.

In these or other embodiments, the shaft sleeve can comprise a shaft sleeve mass of approximately 4.5 grams, the shaft sleeve body can comprise a shaft sleeve body mass less than or equal to approximately 4.1 grams, and/or the shaft sleeve cap can comprise a shaft sleeve cap mass greater than or equal to approximately 0.3 grams less than or equal to approximately 1.0 grams.

In these or other embodiments, the golf club head can comprise a fastener configured to couple the shaft sleeve to the hosel, when the shaft sleeve cap is coupled with the shaft sleeve body, and when the fastener is securing the shaft sleeve to the hosel, the golf club head can comprise an assembled club head mass, and the assembled club head mass can be less than or equal to approximately 199 grams.

In these or other embodiments, the golf club head can comprise a fastener configured to couple the shaft sleeve to the hosel, when the shaft sleeve cap is coupled with the shaft sleeve body, and when the fastener is securing the shaft sleeve to the hosel, the golf club head can comprise an assembled club head mass, the shaft sleeve can comprise a shaft sleeve mass, and a ratio of the shaft sleeve mass to the assembled club head mass can be less than or equal to approximately 2.2%.

In these or other embodiments, the golf club head can comprise a disassembled club head mass, the shaft sleeve can comprise a shaft sleeve mass, and a ratio of the shaft sleeve mass to the disassembled club head mass can be less than or equal to approximately 2.2%.

In these or other embodiments, the shaft sleeve CG vertical distance can be greater than or equal to approximately 45.3 millimeters relative to the sole bottom end.

In these or other embodiments, when the shaft sleeve body is coupled to the shaft sleeve cap, the shaft sleeve comprises a shaft sleeve height, and the shaft sleeve height can be greater than or equal to approximately 1.78 inches and less than or equal to approximately 1.82 inches; when the shaft sleeve body is coupled to the shaft sleeve cap, the shaft sleeve comprises a shaft sleeve body height, and the shaft sleeve body height can be greater than or equal to approximately 1.529 inches and less than or equal to approximately 1.569 inches; and/or when the shaft sleeve body is coupled to the shaft sleeve cap, the shaft sleeve comprises a shaft sleeve cap height, and the shaft sleeve cap height can be greater than or equal to approximately 0.46 inches and less than or equal to approximately 0.50 inches.

Further embodiments include a golf club head. The golf club head comprises a club head body, and the golf club head body comprises a sole comprising a sole bottom end, a top portion opposite the sole portion, a heel portion, a toe portion opposite the heel portion, a rear portion, a front portion opposite the rear portion, and a hosel. Further, the front portion comprises a strike face. The golf club head also comprises a shaft sleeve insertable into the hosel and configured to couple a golf club shaft with the hosel. Meanwhile, the hosel can comprise a hosel bore configured to receive the shaft sleeve. Further, the shaft sleeve can comprises (i) a shaft bore configured to receive an end of the golf club shaft, (ii) a shaft sleeve body comprising a sleeve body outer wall, and at least one coupler on the sleeve body outer wall, and (iii) a shaft sleeve cap configured to be coupled with the shaft sleeve body. The shaft sleeve body can further comprise an intermediate region and a sleeve body wall. Also, the shaft sleeve can comprise a shaft sleeve mass of approximately 4.3 grams. In these embodiments, the shaft sleeve body can comprise a shaft sleeve body mass less than or equal to approximately 3.8 grams. Further, the shaft sleeve cap can comprise a cap bore and one or more ribs into the cap bore, and when the shaft bore receives the end of the golf club shaft, the one or more ribs can center the golf club shaft within the shaft bore. In various embodiments, the shaft sleeve cap can be removably coupled with the shaft sleeve body. Further still, when the golf club head is at an address position, with the shaft sleeve secured in the hosel: the shaft sleeve center of gravity can be located at a shaft sleeve CG vertical distance greater than or equal to approximately 43.5 millimeters and less than or equal to approximately 47 millimeters relative to the sole bottom end.

Other embodiments include a method. The method can comprise providing a shaft sleeve. Meanwhile, providing the shaft sleeve can comprise: providing a shaft sleeve body; and providing a shaft sleeve cap. Further, the shaft sleeve can be configured to be insertable into a hosel of a golf club head and configured to couple a golf club shaft with the hosel. Likewise, the golf club head can comprises a golf club head body and the hosel, and the golf club head body can comprise a sole comprising a sole bottom end, a top portion opposite the sole portion, a heel portion, a toe portion opposite the heel portion, a rear portion, a front portion opposite the rear portion. The front portion can comprising a strike face. Further still, the hosel can comprise a hosel bore configured to receive the shaft sleeve. Also, the shaft sleeve can comprise (i) a shaft bore configured to receive an end of the golf club shaft, (ii) a shaft sleeve body comprising a sleeve body outer wall, and at least one coupler on the sleeve body outer wall, and a shaft sleeve cap configured to be coupled with the shaft sleeve body. When the golf club head is at an address position, with the shaft sleeve secured in the hosel, the shaft sleeve center of gravity can be located at a shaft sleeve CG vertical distance less than or equal to approximately 46 millimeters relative to the sole bottom end.

Other examples and embodiments are further disclosed herein. Such examples and embodiments may be found in the figures, in the claims, and/or in the present description.

Figure 2:
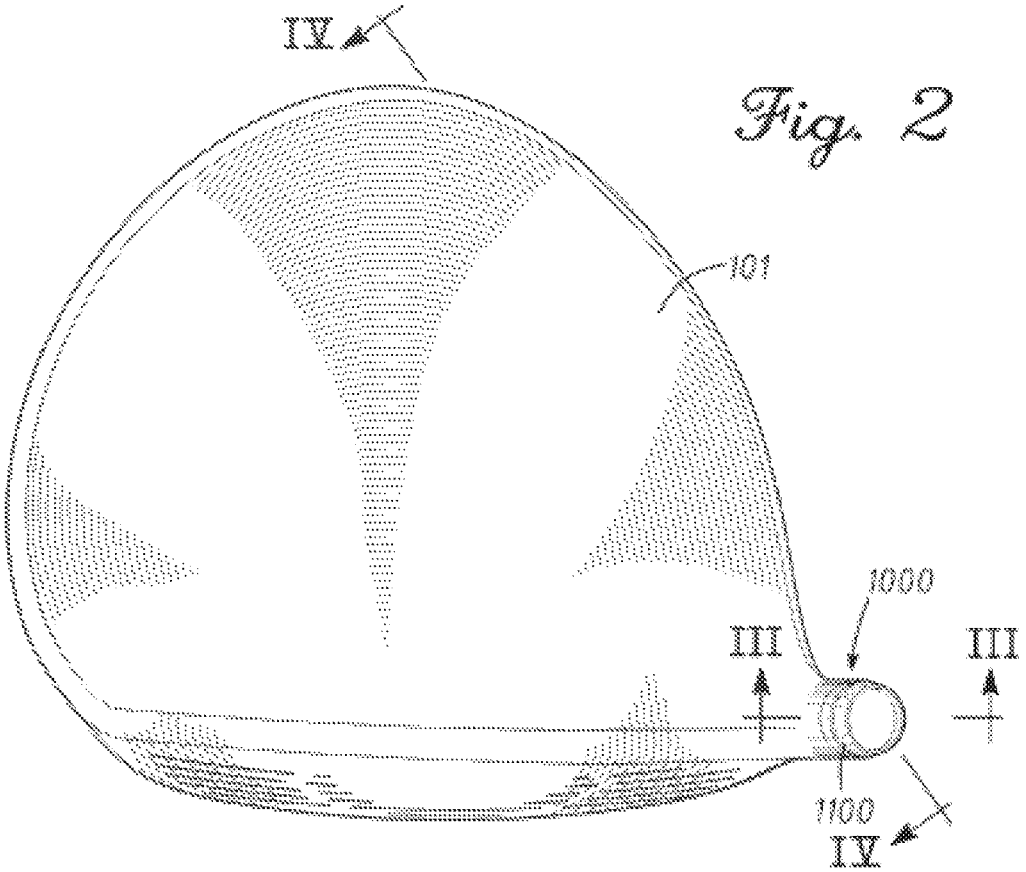
FIG. 2 illustrates a top perspective view of the golf club head with the golf coupling mechanism of FIG. 1.
Figure 3:
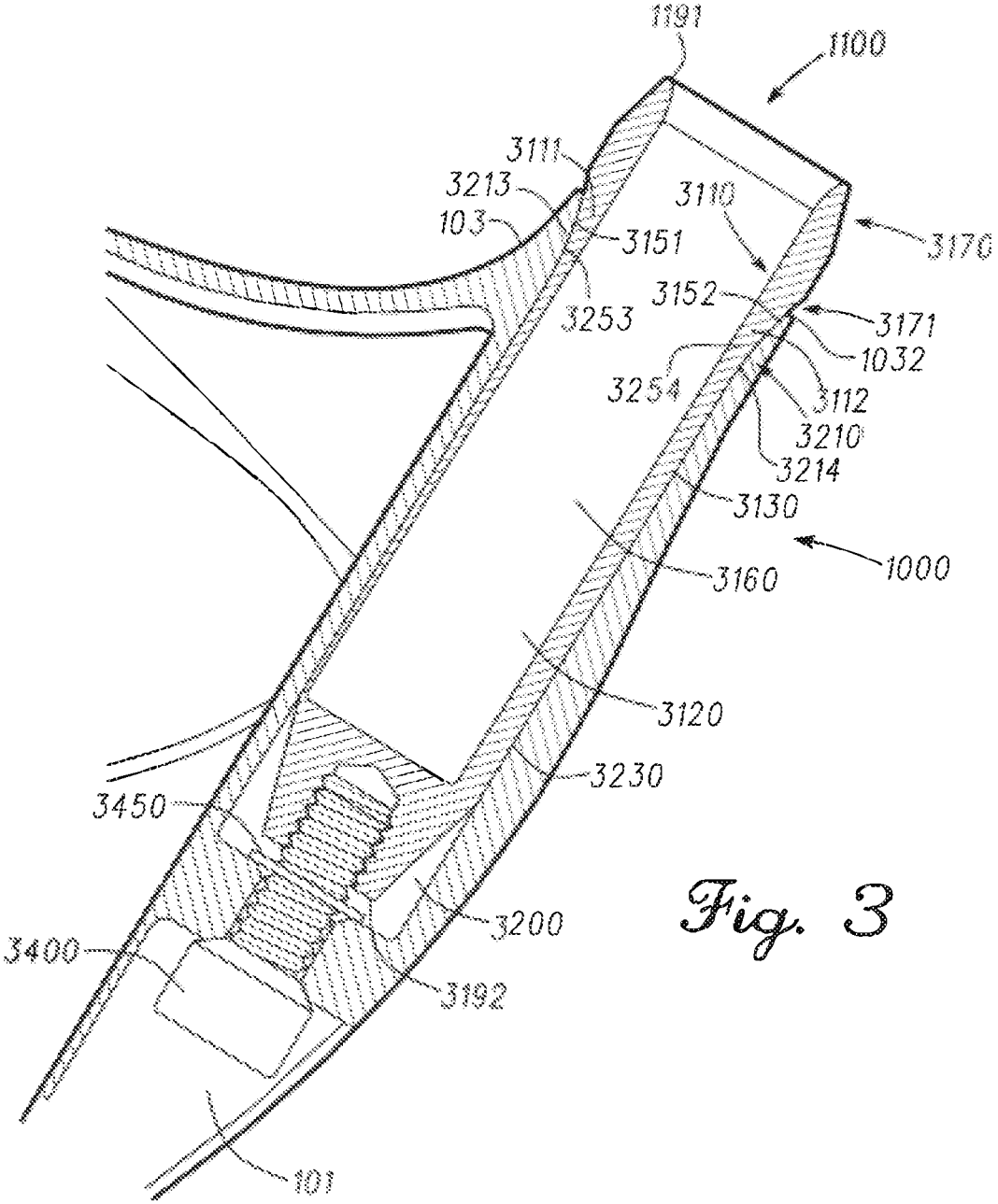
FIG. 3 illustrates a cross-sectional view of the golf club head along cross-sectional line of FIG. 2, showing the golf coupling mechanism with a shaft sleeve inserted into a shaft receiver.
Figure 4:
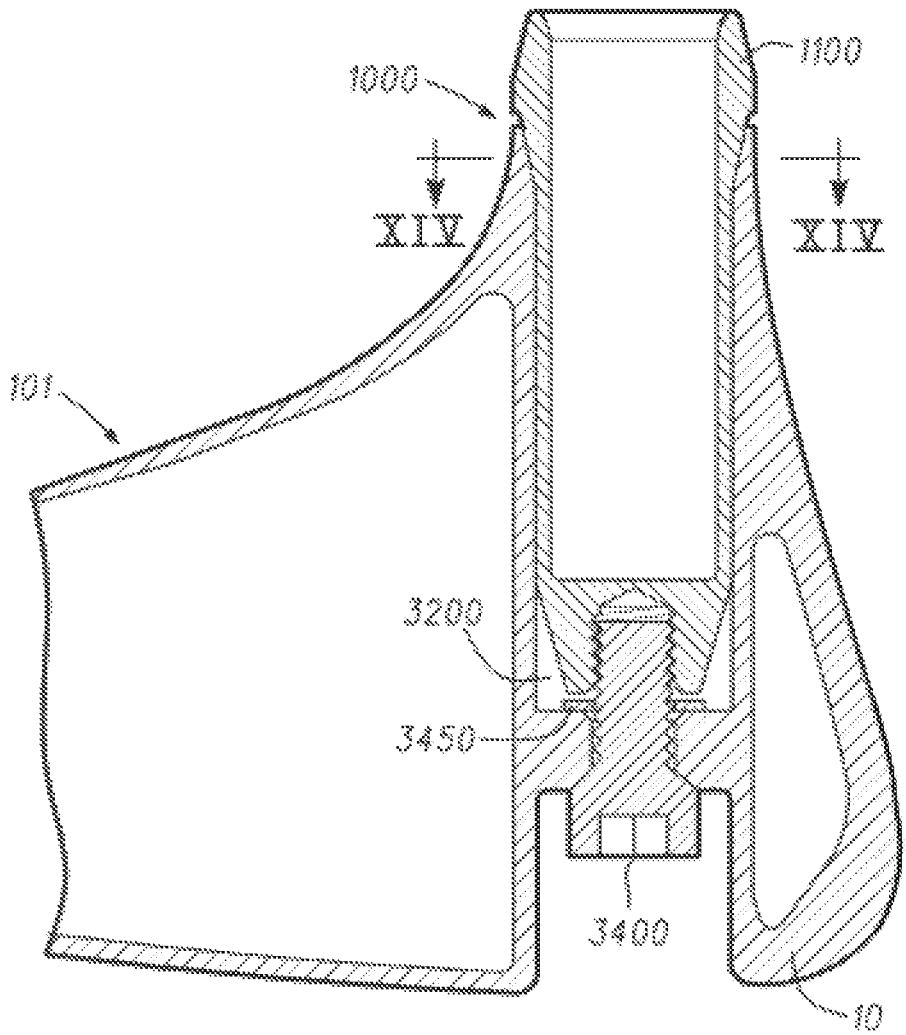
FIG. 4 illustrates a cross-sectional view of the golf club head and the golf coupling mechanism along cross-sectional line IV-IV of FIG. 2.

Turning to the drawings, FIG. 1 illustrates a front perspective view of golf club head 101 with golf coupling mechanism 1000 according to one example of the present disclosure. FIG. 2 illustrates a top perspective view of golf club head 101 with golf coupling mechanism 1000. FIG. 3 illustrates a cross-sectional view of golf club head 101 along line of FIG. 2, showing golf coupling mechanism 1000 with shaft sleeve 1100 inserted into shaft receiver 3200. FIG. 4 illustrates a cross-sectional view of golf club head 101 and golf coupling mechanism 1000 along line IV-IV of FIG. 2.

In the present embodiment, golf coupling mechanism 1000 comprises shaft sleeve 1100 configured be coupled to an end of a golf club shaft, such as golf club shaft 102 (FIG. 1). FIG. 5 illustrates a side view of shaft sleeve 1100 decoupled from golf club head 101 (FIG. 1). FIG. 6 illustrates a cross sectional view of shaft sleeve 1100 along line VI-VI of FIG. 5. In the present example, shaft sleeve 1100 comprises shaft bore 3120 configured to receive the end of golf club shaft 102. Shaft sleeve 1100 also comprises sleeve axis 5150 extending along a longitudinal centerline of shaft sleeve 1100, from sleeve top end 1191 to sleeve bottom end 3192. Sleeve outer wall 3130 is a right angle cylinder such that at least portions of sleeve outer wall 3130 are substantially parallel to sleeve axis 5150 in the present example, and bound shaft bore 3120 therewithin. In other words, sleeve axis 5150 is the center of sleeve outer wall 3130 in this embodiment. In the present example, shaft bore 3120 extends coaxially to shaft bore axis 6150, and is angled with respect to sleeve axis 5150, thus being non-coaxial thereto. Shaft bore axis 6150 is angled at approximately 0.5 degrees from sleeve axis 5150 in the present example, but there can be examples where such angle can be of approximately 0.2 degrees to approximately 4 degrees relative to sleeve axis 5150. Accordingly, shaft bore 3210 and sleeve outer wall 3130 are not concentric in this embodiment. There can be other embodiments, however, where shaft bore axis 6150 can be substantially collinear with sleeve axis 5150, such that sleeve outer wall 3130 and shaft bore 3120 can be substantially concentric.

Figure 7:
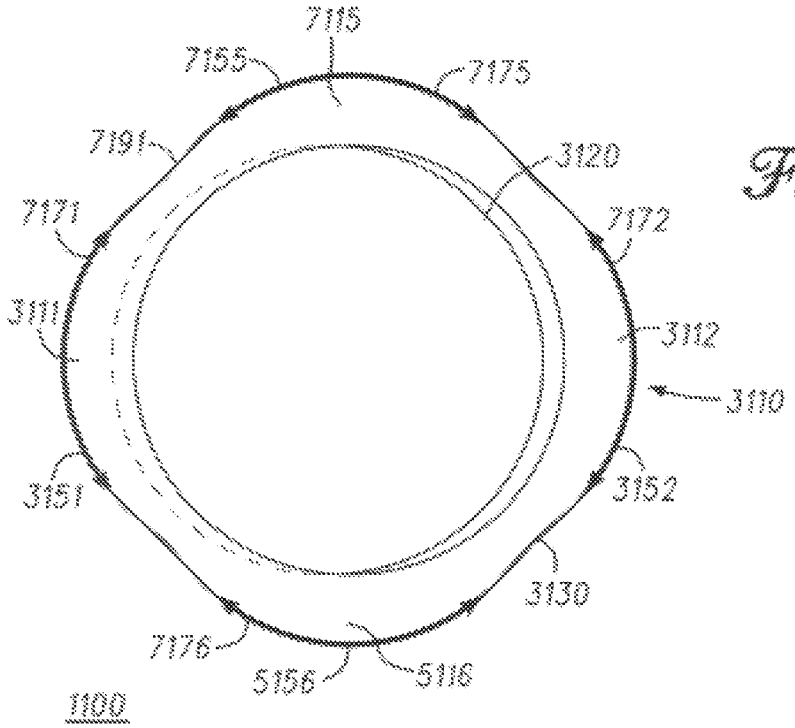
FIG. 7 illustrates a cross-section view of the shaft sleeve along cross-sectional line VII-VII of FIG. 5.

Shaft sleeve 1100 comprises sleeve coupler set 3110 with one or more couplers protruding from sleeve outer wall 3130. FIG. 7 illustrates a cross-section view of shaft sleeve 1100 along line VII-VII of FIG. 5 across sleeve coupler set 3110. FIGS. 3-7 illustrate different views of sleeve coupler set 3110 protruding from sleeve outer wall 3130. In the present example, sleeve coupler set 3110 comprises sleeve couplers 3111, 3112, 5116, and 7115 protruding from sleeve outer wall 3130, where sleeve coupler 3112 lies opposite sleeve coupler 3111 and sleeve coupler 7115 lies opposite sleeve coupler 5116 along perimeter 7191 of sleeve outer wall 3130. As can be seen from FIG. 7, sleeve coupler set 3110 forms alternating concave and convex surfaces about perimeter 7191 in the present embodiment.

The sleeve couplers of sleeve coupler set 3110 comprise arcuate surfaces configured to restrict rotation of shaft sleeve 1100 relative golf club head 101 when shaft sleeve 1100 is inserted and secured in shaft receiver 3200. For example, as seen in FIGS. 3, 5, and 7: (a) sleeve coupler 3111 comprises arcuate surface 3151 curved throughout the outer area of sleeve coupler 3111, (b) sleeve coupler 3112 comprises arcuate surface 3152 curved throughout the outer area of sleeve coupler 3112, (c) sleeve coupler 5116 comprises arcuate surface 5156 curved throughout the outer area of sleeve coupler 5116, and (d) sleeve coupler 7115 comprises arcuate surface 7155 curved throughout the outer area of sleeve coupler 7115.

Figure 8:
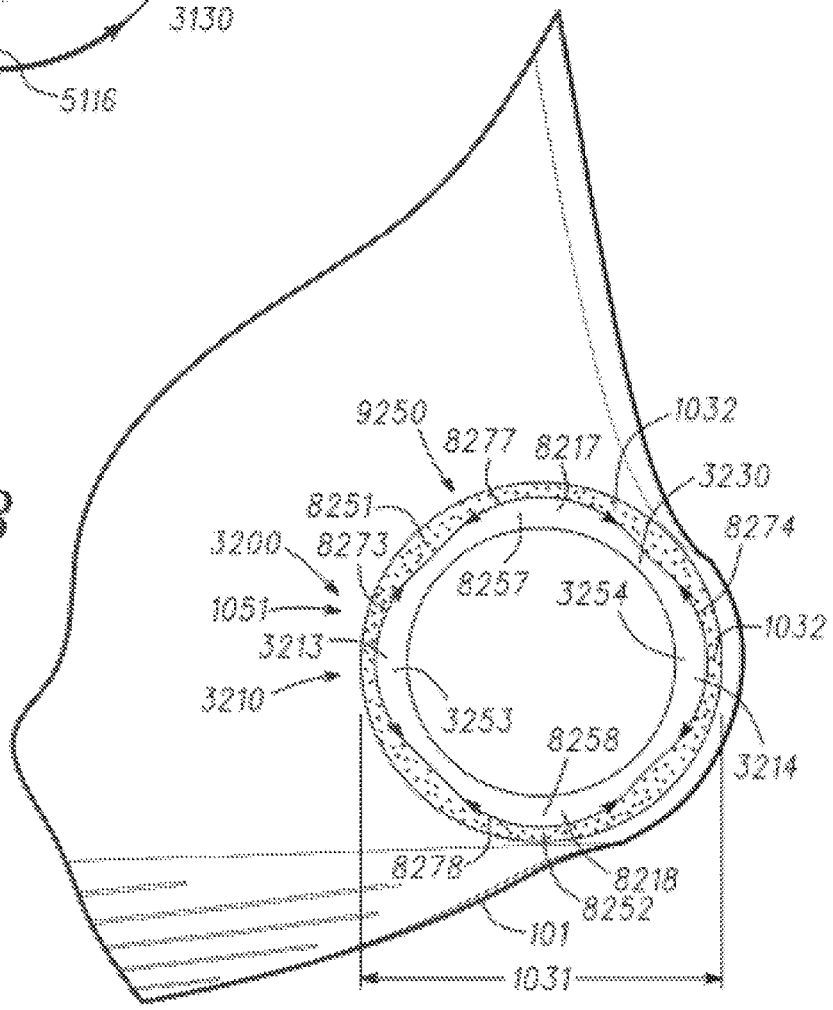
FIG. 8 illustrates a top view of the golf club head of FIG. 1, with the shaft sleeve removed therefrom, showing the shaft receiver from above.

Golf coupling mechanism 1000 also comprises shaft receiver 3200, configured to receive shaft sleeve 1100 as seen in FIGS. 3-4. FIG. 8 illustrates a top view of golf club head 101 with shaft sleeve 1100 removed therefrom, showing shaft receiver 3200 from above. FIG. 9 illustrates a cross-sectional side view of golf club head 101 with shaft sleeve 1100 removed therefrom and along line of FIG. 2, showing a side cross section of shaft receiver 3200.

In the present example, shaft receiver 3200 is integral with hosel 1015 of club head 101, but there can be embodiments where shaft receiver 3200 can be distinct from hosel 1015 and coupled thereto via one or more fastening methods, such as via adhesives, via a screw thread mechanism, and/or via a bolt or rivet. In the same or other embodiments, the terms hosel and shaft receiver may be used interchangeably. There can also be embodiments where golf club head 101 may comprise a head bore into its crown or top portion, rather than hosel 1015. In such embodiments, the shaft receiver 3200 may also be part of, or coupled to, such head bore.

Shaft sleeve 1100 is configured to be inserted into shaft receiver 3200, and can be subdivided in several portions. For example, shaft sleeve 1100 comprises sleeve insertion portion 3160 bounded by sleeve outer wall 3130 and configured to be internal to shaft receiver 3200 when shaft sleeve 1100 is secured in shaft receiver 3200. In the present example, shaft sleeve 1100 also comprises sleeve top portion 3170, configured to remain external to shaft receiver 3200 when shaft sleeve 1100 is secured in shaft receiver 3200. There can be other examples, however, that are devoid of sleeve top portion 3170 and/or with a shaft sleeve similar to shaft sleeve 1100 but configured to be inserted in its entirety into shaft receiver 3200.

Shaft receiver 3200 comprises hosel outer wall 3240, with receiver inner wall 3230 configured to bound sleeve insertion portion 3160 and sleeve outer wall 3130 of shaft sleeve 1100 when inserted therein. Shaft receiver 3200 also comprises receiver coupler set 3210 configured to engage coupler set 3110 of shaft sleeve 1100 to restrict a rotation of shaft sleeve 1100 relative to shaft receiver 3200. In the present embodiment, as can be seen in FIG. 8, receiver coupler set 3210 comprises receiver couplers 3213, 3214, 8217, and 8218 indented into receiver inner wall 3230, with receiver coupler 3213 opposite receiver coupler 3214 and with receiver coupler 8218 opposite receiver coupler 8217.

The receiver couplers of receiver coupler set 3210 in shaft receiver 3200 comprise arcuate surfaces complementary with the arcuate surfaces of sleeve coupler set 3110 of shaft sleeve 1100. For example: (a) receiver coupler 3213 comprises arcuate surface 3253 curved throughout the inner area of receiver coupler 3213 (FIG. 8), where arcuate surface 3253 of receiver coupler 3213 is complementary with arcuate surface 3151 of sleeve coupler 3111 (FIG. 7), (b) receiver coupler 3214 comprises arcuate surface 3254 curved throughout the inner area of receiver coupler 3214 (FIG. 8), where arcuate surface 3254 of receiver coupler 3214 is complementary with arcuate surface 3152 of sleeve coupler 3112 (FIG. 7), (c) receiver coupler 8217 comprises arcuate surface 8257 curved throughout the inner area of receiver coupler 8217 (FIG. 8), where arcuate surface 8257 of receiver coupler 8217 is complementary with arcuate surface 7155 of sleeve coupler 7115 (FIG. 7), and (d) receiver coupler 8218 comprises arcuate surface 8258 curved throughout the inner area of receiver coupler 8218 (FIG. 8), where arcuate surface 8258 of receiver coupler 8218 is complementary with arcuate surface 5156 of sleeve coupler 5116 (FIG. 7).

In the present embodiment, the arcuate surfaces of sleeve coupler set 3110 and of receiver coupler set 3210 are curved throughout their respective sleeve couplers and receiver couplers. FIG. 10 illustrates a side view of a portion of shaft sleeve 1100 and sleeve coupler set 3110. FIG. 11 illustrates a side x-ray view of a portion of shaft receiver 3200 and receiver coupler set 3210. As seen in FIGS. 7 and 10, arcuate surface 5156 of sleeve coupler 5116 comprises horizontal radius of curvature 7176, arcuate surface 3151 of sleeve coupler 3111 comprises horizontal radius of curvature 7171, arcuate surface 3152 of sleeve coupler 3112 comprises horizontal radius of curvature 7172, and arcuate surface 7155 of sleeve coupler 7115 comprises horizontal radius of curvature 7175 in the present example. Also in the present example, the arcuate surfaces of sleeve coupler set 3110 comprise vertical taperings that decrease in thickness towards sleeve bottom end 3192 of shaft sleeve 1100 and towards sleeve axis 5150 (FIGS. 5-6). For example, as seen in FIG. 10, arcuate surface 5156 of sleeve coupler 5116 comprises vertical tapering 10186, arcuate surface 3151 of sleeve coupler 3111 comprises vertical tapering 10181, and arcuate surface 3152 of sleeve coupler 3112 comprises vertical tapering 10182. Although not shown in FIG. 10, arcuate surface 7155 of sleeve coupler 7115 also comprises a vertical tapering similar to vertical tapering 10186 of sleeve coupler 5116.

With respect to receiver coupler set 3210 of shaft receiver 3200, as seen in FIGS. 8 and 11, arcuate surface 8258 of receiver coupler 8218 comprises horizontal radius of curvature 8278 complementary with horizontal radius of curvature 7176 of sleeve coupler 5116 (FIGS. 7, 10), arcuate surface 3253 of receiver coupler 3213 comprises horizontal radius of curvature 8273 complementary with horizontal radius of curvature 7171 of sleeve coupler 3111 (FIG. 7), arcuate surface 3254 of receiver coupler 3214 comprises horizontal radius of curvature 8274 complementary with horizontal radius of curvature 7172 of sleeve coupler 3112 (FIG. 7), and arcuate surface 8257 of receiver coupler 8217 comprises horizontal radius of curvature 8277 complementary with horizontal radius of curvature 7175 of sleeve coupler 7115 (FIG. 7) in the present example.

Also in the present example, the arcuate surfaces of receiver coupler set 3210 comprise vertical taperings complementary to the vertical taperings of the arcuate surfaces of sleeve coupler set 3110. For example, as seen in FIG. 11, arcuate surface 8258 of receiver coupler 8218 comprises vertical tapering 11288 complementary with vertical tapering 10186 of sleeve coupler 5116 (FIG. 10), arcuate surface 3253 of receiver coupler 3213 comprises vertical tapering 11283 complementary with vertical tapering 10181 of sleeve coupler 3111 (FIG. 10), and arcuate surface 3254 of receiver coupler 3214 comprises vertical tapering 11284 complementary with vertical tapering 10182 of sleeve coupler 3112 (FIG. 10). Although not shown in FIG. 11, arcuate surface 8257 of receiver coupler 8217 also comprises a vertical tapering similar to vertical tapering 11288 of receiver coupler 8218 and complementary to the vertical tapering of sleeve coupler 7115.

In the present embodiment, the vertical taperings of the arcuate surfaces of sleeve coupler set 3110 are substantially linear, decreasing in a substantially straight line as can be seen in the profile view of vertical taperings 10181 and 10182 for sleeve couplers 3111 and 3112 in FIG. 10. Similarly, the vertical taperings of the arcuate surfaces of receiver coupler set 3210 are substantially linear, as can be seen in the profile view of vertical taperings 11283 and 11284 for receiver couplers 3213 and 3214 in FIG. 11. In the same or other examples, the substantially linear vertical taperings of the arcuate surfaces of sleeve coupler set 3110 and of receiver coupler set 3210 may be considered to comprise a large or infinite vertical radius of curvature yielding a substantially straight line.

Figure 12:
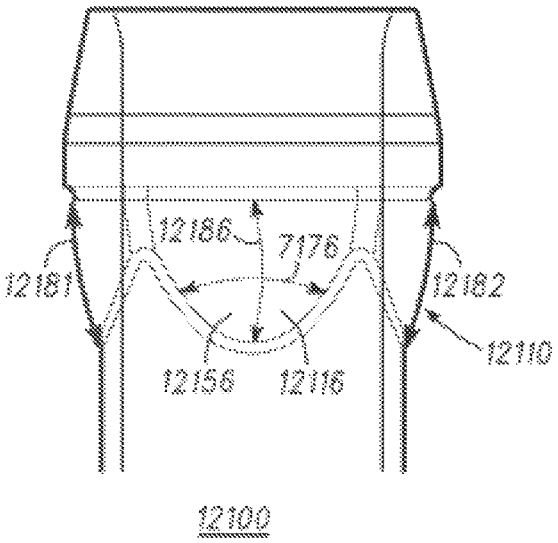
FIG. 12 illustrates a side view of a portion of a sleeve coupler set of a shaft sleeve similar to the shaft sleeve of FIGS. 1-7, and 10.
Figure 13:
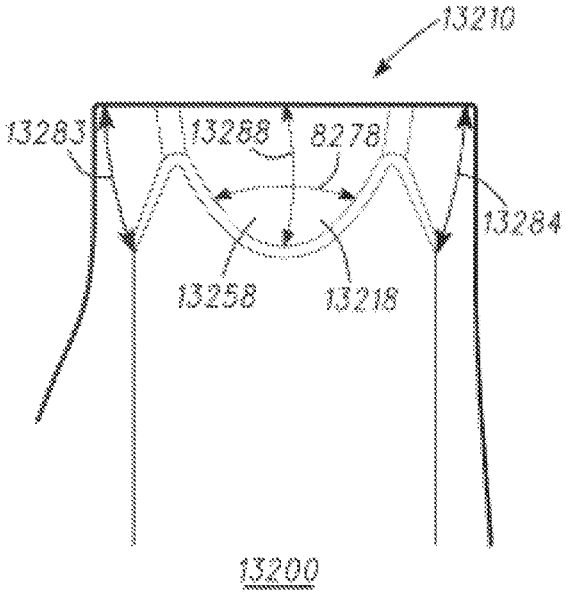
FIG. 13 illustrates a side x-ray view of a portion a receiver coupler set of a shaft receiver similar to the shaft receiver of FIGS. 1-4, 8-9, and 11.

There can be other embodiments, however, where the vertical taperings of the sleeve couplers and/or the receiver couplers need not be linear. FIG. 12 illustrates a side view of a portion of shaft sleeve 12100 with sleeve coupler set 12110. FIG. 13 illustrates a side x-ray cross-sectional view of shaft receiver 13200 with receiver coupler set 13210.

Shaft sleeve 12100 can be similar to shaft sleeve 1100 (FIGS. 1-7, 10), and shaft receiver 13200 can be similar to shaft receiver 3200 (FIGS. 3-4, 8, 10). Sleeve coupler set 12110 differs from sleeve coupler set 3110, however, by comprising vertical taperings that are not linear. For example, sleeve coupler set 12110 comprises vertical taperings 12186, 12181, and 12182 that are curved rather than linear, and can comprise respective vertical radii of curvature. Similarly, receiver coupler set 13210 comprises vertical taperings 13288, 13283, and 13284 that are curved rather than linear, and comprise respective vertical radii of curvature complementary with the radii of curvature of sleeve coupler set 12110. Accordingly, the sleeve couplers of sleeve coupler set 12110 and the receiver couplers of receiver coupler set 13120 are each curved horizontally and vertically throughout their respective surface areas. For example, any horizontal line tangential to any point of a total surface of sleeve coupler 12116 is non-tangential to any other point of the total surface of sleeve coupler 12116. In the same or other embodiments, the total surface of each sleeve coupler of sleeve coupler set 12110, and the total surface of each receiver coupler of receiver coupler set 13120 is each curved throughout and in all directions.

The different sleeve couplers and receiver couplers of the present disclosure may comprise respective curvatures within certain ranges. For example, with respect to FIGS. 7 and 10, horizontal radii of curvature 7171, 7172, 7175, and 7176 of sleeve coupler set 3110 are each of approximately 0.175 inches (4.45 millimeters (mm)), but there can be embodiments where they could range from approximately 0.1 inches (2.54 mm) to approximately 0.225 inches (5.715 mm). With respect to FIGS. 8 and 11, horizontal radii of curvature 8273, 8274, 8277, and 8278 of receiver coupler set 3210 can be complementarily the same or similar to horizontal radii of curvature 7171, 7172, 7175, and 7176 (FIGS. 7, 10), respectively. In addition, the horizontal radii of curvature for sleeve coupler set 12110 and for receiver coupler set 13210 in the embodiment of FIGS. 12-13 can also be similar to those described above with respect to the embodiment of FIGS. 1-11 for sleeve coupler set 3110 and/or receiver coupler set 3210.

As previously described, in the embodiment of FIGS. 1-11, the vertical taperings of sleeve coupler set 3110 (FIG. 10) and of receiver coupler set 3210 (FIG. 11) can comprise vertical radii of curvature approximating infinity, thereby yielding substantially straight lines. In the embodiment of FIGS. 12-13, the vertical taperings of sleeve coupler set 12110 (FIG. 12) and of receiver coupler set 13210 (FIG. 13) comprise more pronounced vertical radii of curvature. As an example the vertical radius of curvature for vertical tapering 12186 of sleeve coupler 12116 (FIG. 12) is of approximately 0.8 inches (20.32 mm), but there can be embodiments where it could range from approximately 0.4 inches (10.16 mm) to 2 inches (50.8 mm). The vertical radii of curvature for other similar portions of sleeve coupler set 12110 can also be in the same range described for vertical tapering 12186. In addition, the vertical radii of curvature for receiver coupler set 13210 (FIG. 13) can be complementarily the same or similar to the vertical radii of curvature described for sleeve coupler set 12110 (FIG. 12).

In some examples, the arcuate surfaces of the sleeve couplers and/or of the receiver couplers may comprise portions of geometric structures. For instance, the arcuate surface of sleeve coupler 12116 (FIG. 12) can comprise a quadric surface, and the arcuate surface of receiver coupler 13218 (FIG. 13) can comprise a quadric surface complementary to the arcuate surface of sleeve coupler 12116. In such examples, the quadric surface of sleeve coupler 12116 and of receiver coupler 13218 can comprise, for example, a portion of a paraboloid surface or a portion of a hyperboloid surface. There can also be examples with sleeve couplers and receiver couplers whose quadric arcuate surfaces can comprise a portion of a degenerate quadric surface, such as a portion of a conical surface. Such examples can be similar to those of FIGS. 10-11 with respect to sleeve coupler set 3110 and receiver coupler set 3200.

In the embodiments of FIGS. 10-11 and of FIGS. 12-13, the arcuate surfaces of the sleeve couplers of sleeve coupler set 3110 (FIG. 10) and/or 12110 (FIG. 12), and the arcuate surfaces of the receiver couplers of receiver coupler set 3210 (FIG. 11) and/or 13210 (FIG. 13), can be configured to be devoid of any inflection point, such as to be continuously curved. In the same or other embodiments, such arcuate surfaces can also be configured to be edgeless (except for their respective perimeter). For example, the total surface area of sleeve coupler 5116 (FIG. 10) is edgeless with respect to any portion of its total surface area within its perimeter. In addition, the total surface area of receiver coupler 8218 (FIG. 11) also is edgeless with respect to any portion of its total surface area within its perimeter. Similar edgeless attributes are also shared by sleeve coupler 12110 (FIG. 12) and receiver coupler 13218 (FIG. 13). The characteristics described above can permit the contact area to be maximized when sleeve couplers seat against receiver couplers to restrict rotation of their shaft sleeves relative to their respective shaft receivers.

As can be seen in FIGS. 3-7 and 10, sleeve coupler set 3110 protrudes from a top section of sleeve outer wall 3130. Similarly, as can be seen in FIGS. 3-4, 8-9, and 11, receiver coupler set 3210 is indented into a top section of receiver inner wall 3230. There can be other embodiments, however, where sleeve coupler set 3110 and receiver coupler set 3210 may be located elsewhere. For instance, sleeve coupler set 3110 and receiver coupler set 3210 may be located at or towards bottom sections or mid sections of shaft sleeve 1100 and shaft receiver 3200, respectively. In the same or other embodiments, the shape of sleeve coupler set 3110 and receiver coupler set 3210 could be reversed such that sleeve coupler set 3110 is recessed into sleeve outer wall 3130 and receiver coupler set 3210 protrudes from receiver inner wall 3230. The apparatus, methods, and articles of manufacture described herein are not limited in this regard.

As can be seen in the cross section presented in FIG. 3, golf coupling mechanism 1000 also comprises securing fastener 3400 configured to secure shaft sleeve 1100 to shaft receiver 3200. In the present example, securing fastener 3400 comprises a bolt configured to couple, via a passageway at a bottom of shaft receiver 3200, with sleeve bottom end 3192 of shaft sleeve 1100. Securing fastener 3400 is configured to couple with sleeve bottom end 3192 via a screw thread mechanism. As the screw thread mechanism is tightened, securing fastener 3400 is configured to pull shaft sleeve 1100 towards the bottom end of shaft receiver 3200, thereby causing the arcuate surfaces of sleeve coupler set 3110 to seat against the arcuate surfaces of receiver coupler set 3210.

In examples such as the present one, the combined total masses of the body of golf club head 101, shaft sleeve 1100, and securing fastener 3400 may be referred to as an assembled club head mass, while the mass of the body of golf club head 101, without shaft sleeve 1100 and securing fastener 3400, may be referred to as a disassembled club head mass.

In the present embodiment, securing fastener 3400 comprises retainer element 3450 coupled thereto to restrict or at least inhibit securing fastener 3400 from being fully removed from shaft receiver 3200 when decoupled from shaft sleeve 1100. Retainer element 3450 comprises a washer located within shaft receiver 3200 and coupled around the threads of securing fastener 3400. Retainer element 3450 can be configured to flexibly engage the threads of securing fastener 3400 in the present embodiment, such as to permit positioning thereof along the threads of securing fastener 3400 by ramming securing fastener 3400 through retainer element 3450, and such as to remain substantially in place once positioned along the threads of securing fastener 3400. Retainer element 3450 can thus retain an end of securing fastener 3400 within shaft receiver 3200 after shaft sleeve 1100 is removed therefrom, and can permit insertion of the end of securing fastener 3400 into sleeve bottom end 3192. In some examples, retainer element 3450 can comprise a material such as a nylon material or other plastic material more flexible than the material of securing fastener 3400.

In other examples, the bore through which securing fastener 3400 enters shaft receiver 3200 may comprise threading corresponding to that of securing fastener 3400, where such threading can thereby serve as the retainer element. IN these other examples, retainer element 3450 can be omitted.

Sleeve coupler set 3110 and receiver coupler set 3210 are configured such that at least a majority of their respective arcuate surfaces seat against each other when shaft sleeve 1110 is secured in shaft receiver 3200 by securing fastener 3400. For example, in the embodiment of FIGS. 10-11, when seated against each other, at least a majority of a total surface of sleeve coupler 5116 and a majority a total surface of receiver coupler 8218 contact each other and restrict rotation of shaft sleeve 1100 relative to shaft receiver 3200. As another example, in the embodiment of FIGS. 11-12, when seated against each other, a majority of a total surface of sleeve coupler 12116 and a majority of a total surface of receiver coupler 13218 also contact each other to restrict rotation. In the same or other examples, the contact area defined by the interface between an individual sleeve coupler of sleeve coupler set 3110 (FIG. 10) or 12110 (FIG. 12) and an individual receiver coupler of receiver coupler set 3210 (FIG. 11) or 13210 (FIG. 13) may be of approximately 51% to approximately 95% of a total surface of the individual receiver coupler or the individual sleeve coupler. Such contact area may be even greater in some embodiments, such as to substantially approach or equal the total surface of the individual receiver coupler and/or of the individual sleeve coupler. There can also be examples where, when the arcuate surfaces of the sleeve couplers of sleeve coupler set 3110 (FIG. 10) or 12110 (FIG. 12) seat against the arcuate surfaces of the receiver couplers of receiver coupler set 3200 (FIG. 11) or 13210 (FIG. 13), normal forces are exerted against each other across the respective contact areas.

In the present example, when securing fastener 3400 secures shaft sleeve 1100 in shaft receiver 3200, sleeve top portion 3170 remains external to shaft receiver 3200, with bottom end 3171 of sleeve top portion 3170 spaced away from a top end of shaft receiver 3200 by the seating of sleeve coupler set 3110 against receiver coupler set 3210. Such built-in spacing eases manufacturing tolerances, ensuring that sleeve coupler set 3110 can properly seat against receiver coupler set 3210.

In the same or other examples, a portion of one or more of the sleeve couplers of sleeve coupler set 3110 may protrude past the top end of shaft receiver 3200. There can also be examples where one or more of the sleeve couplers of sleeve coupler set 3110 may extend past the bottom end of one or more of the receiver couplers of receiver coupler set 3210. In other examples, one or more of the receiver couplers of receiver coupler set may extend past the bottom end of one or more of the sleeve couplers of sleeve coupler set 3110. Some of the features described above may be designed into golf coupling mechanism 1000 to ease the required manufacturing tolerances while still permitting proper seating of sleeve coupler set 3110 against receiver coupler set 3210.

Figure 14:
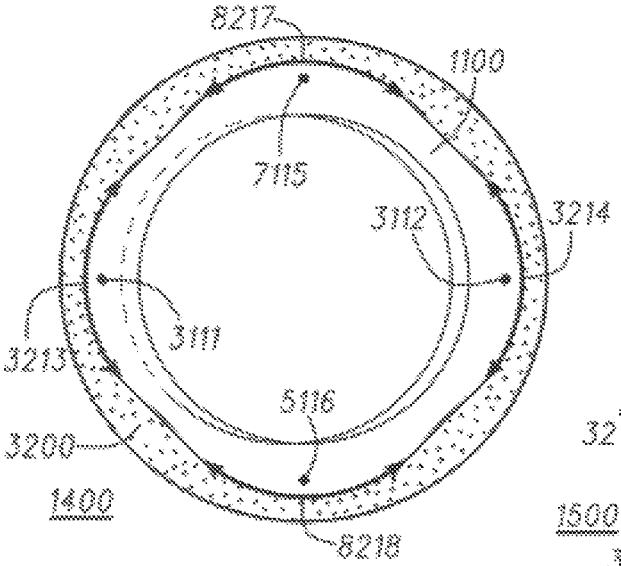
FIG. 14 illustrates a top cross-sectional view of the golf coupling mechanism in a first configuration, with respect to the viewpoint of cross-sectional line XIV-XIV of FIG. 4.

FIG. 14 illustrates a top cross-sectional view of golf coupling mechanism 1000 in configuration 1400, with respect to the viewpoint of line XIV-XIV of FIG. 4. Golf coupling mechanism 1000 is shown in FIGS. 3-4 and 14 in configuration 1400, where sleeve couplers 3111, 7115, 3112, and 5116 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1400 in FIG. 14 can comprise a first lie angle and a first loft angle between shaft bore axis 6150 (FIG. 6) and shaft receiver 3200 (FIGS. 3-4, 8-9) and/or between shaft 102 (FIG. 1) and golf club head 101 (FIG. 1).

Figure 15:
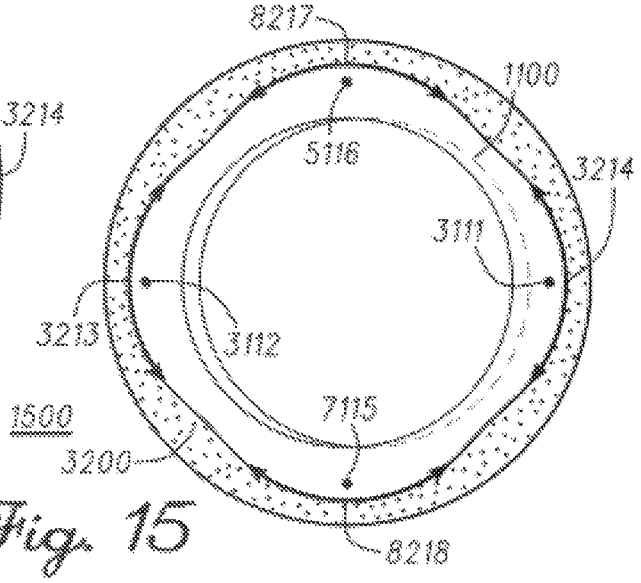
FIG. 15 illustrates a top cross-sectional view of the golf coupling mechanism in a second configuration, with respect to the viewpoint of cross-sectional line XIV-XIV of FIG. 4.

FIG. 15 illustrates a top cross-sectional view of golf coupling mechanism 1000 in configuration 1500, with respect to the viewpoint of line XIV-XIV of FIG. 4. In configuration 1500, sleeve couplers 3112, 5116, 3111, and 7115 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1500 in FIG. 15 can comprise a second lie angle and a second loft angle between shaft bore axis 6150 (FIG. 6) and shaft receiver 3200 (FIGS. 3-4, 8-9) and/or between shaft 102 (FIG. 1) and golf club head 101 (FIG. 1).

FIG. 16 illustrates a top cross-sectional view of golf coupling mechanism 1000 in configuration 1600, with respect to the viewpoint of line XIV-XIV of FIG. 4. In configuration 1600, sleeve couplers 7115, 3112, 5116, and 3111 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1600 in FIG. 16 will comprise a third lie angle and a third loft angle between shaft bore axis 6150 (FIG. 6) and shaft receiver 3200 (FIGS. 3-4, 8-9) and/or between shaft 102 (FIG. 1) and golf club head 101 (FIG. 1).

FIG. 17 illustrates a top cross-sectional view of golf coupling mechanism 1000 in configuration 1700, with respect to the viewpoint of line XIV-XIV of FIG. 4. In configuration 1700, sleeve couplers 5116, 3111, 7115, and 3112 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1700 in FIG. 17 will comprise a fourth lie angle and a fourth loft angle between shaft bore axis 6150 (FIG. 6) and shaft receiver 3200 (FIGS. 3-4, 8-9) and/or between shaft 102 (FIG. 1) and golf club head 101 (FIG. 1).

Depending on the angle of shaft bore axis 6150 with respect to sleeve axis 5150 and sleeve coupler set 3110, different lie and loft angle alignments may be attained via the configurations shown in FIGS. 14-17. For example, in the present embodiment, as can be seen in FIG. 6, the angle between shaft bore axis 6150 and sleeve axis 5150 causes the bottom of shaft bore 3120 to point towards sleeve coupler 3111, such that shaft 102 (FIG. 1) will lean towards sleeve coupler 3112 when inserted into shaft sleeve 1100.

Accordingly, in configuration 1400 (FIG. 14), the first lie angle may comprise a lower lie angle, and the first loft angle may comprise a neutral or middle loft angle. As an example, the first lie angle can be set to tilt the grip end of shaft 102 towards the heel of golf club head 101 (FIG. 1) by approximately 0.2 degrees to approximately 4 degrees, thereby decreasing the lie angle of the golf club in configuration 1400. The first loft angle, being neutral in the present example, does not affect the tilt of shaft 102 in configuration 1400.

In configuration 1500 (FIG. 15), the second lie angle may comprise a higher lie angle, and the second loft angle may comprise a neutral or middle loft angle, which may be similar or equal to the first loft angle of configuration 1400 (FIG. 14). As an example, second lie angle can be set to tilt the grip end of shaft 102 towards the toe of golf club head 101 (FIG. 1) by approximately 0.2 degrees to approximately 4 degrees, thereby increasing the lie angle of the golf club in configuration 1500. The second loft angle, being neutral in the present example, does not affect the tilt of shaft 102 in configuration 1500.

In configuration 1600 (FIG. 16), the third loft angle may comprise a lower loft angle, and the third lie angle may comprise a neutral or middle lie angle. As an example, the third loft angle can be set to tilt the grip end of shaft 102 towards the rear of golf club head 101 (FIG. 1) by approximately 0.2 degrees to approximately 4 degrees, thereby decreasing the loft angle of the golf club in configuration 1600. The third lie angle, being neutral in the present example, does not affect the tilt of shaft 102 in configuration 1600.

In configuration 1700 (FIG. 17), the fourth loft angle may comprise a higher loft angle, and the fourth lie angle may comprise a neutral or middle lie angle, which may be similar or equal to the third lie angle of configuration 1600 (FIG. 16). As an example, the fourth loft angle can be set to tilt the grip end of shaft 102 towards the front or strike face of golf club head 101 (FIG. 1) by approximately 0.2 degrees to approximately 4 degrees, thereby increasing the loft angle of the golf club in configuration 1700. The fourth lie angle, being neutral in the present example, does not affect the tilt of shaft 102 in configuration 1700.

Other lie and loft angle relationships may be configured in other embodiments by altering the angle and/or orientation of shaft bore axis 6150 (FIG. 6) with respect to sleeve axis 5150 (FIG. 6) of shaft sleeve 1100. Furthermore, as seen from FIGS. 14-17, sleeve couplers 3111, 3112, 5116, and 7115 are symmetric with each other, and receiver couplers 3213, 3214, 8217, and 8218 are also symmetric with each other. In a different embodiment, only opposite ones of the sleeve couplers and the receiver couplers may be symmetric with each other such that only two (and not four) different lie and loft angle combinations are permitted.

The different features described above for the golf coupler mechanisms of FIGS. 1-17 can also impart several performance benefits to the golf clubs on which they are used, when compared to other golf club heads with adjustable shaft coupling mechanisms. For example, because of the small number of parts required, and/or because receiver coupler set 3210 is located only towards the top end of shaft receiver 3200 (FIG. 3), hosel diameter 1031 of hosel 1015 (FIG. 1) can be maintained to a minimum and/or relatively unchanged from a hosel diameter of a corresponding regular golf club head. In some examples, as can be seen in FIG. 8, hosel diameter 1031 can be of less than approximately 20 mm, such as of approximately 0.55 inches (approximately 14 mm), or such as of approximately 0.53 inches (approximately 13.46 mm) at receiver top end 1032. In addition, top wall thickness 9250 (FIGS. 8-9) of shaft receiver 3200 can be minimized as shown at receiver top end 1032 of shaft receiver 3200. For instance, top wall thickness 9250 can be of approximately 0.035 inches (approximately 0.9 mm) or less, such as of approximately 0.024 inches (approximately 0.61 mm).

As can be seen in FIG. 8, top wall thickness 9250 varies in thickness along receiver top end 1032 in the present embodiment, and comprises at least one hosel top wall narrow section 8252 and at least one hosel top wall thick section 8251 at receiver top end 1032. Hosel top wall thick section 8251 can have a thickness less than or equal to approximately 2.3 mm at receiver top end 1032, when measured radially relative to a centerpoint of hosel diameter 1031. Hosel top wall narrow section 8252 can have a thickness less than or equal to approximately 0.9 mm at receiver top end 1032, when measured radially relative to the centerpoint of hosel diameter 1031. In the present example, when measured radially relative to the centerpoint of hosel diameter 1031, hosel top wall thick section 8251 can be less than or equal to approximately 1.27 mm, and hosel top wall narrow section 8252 can be less than or equal to 0.64 mm.

Figure 19:
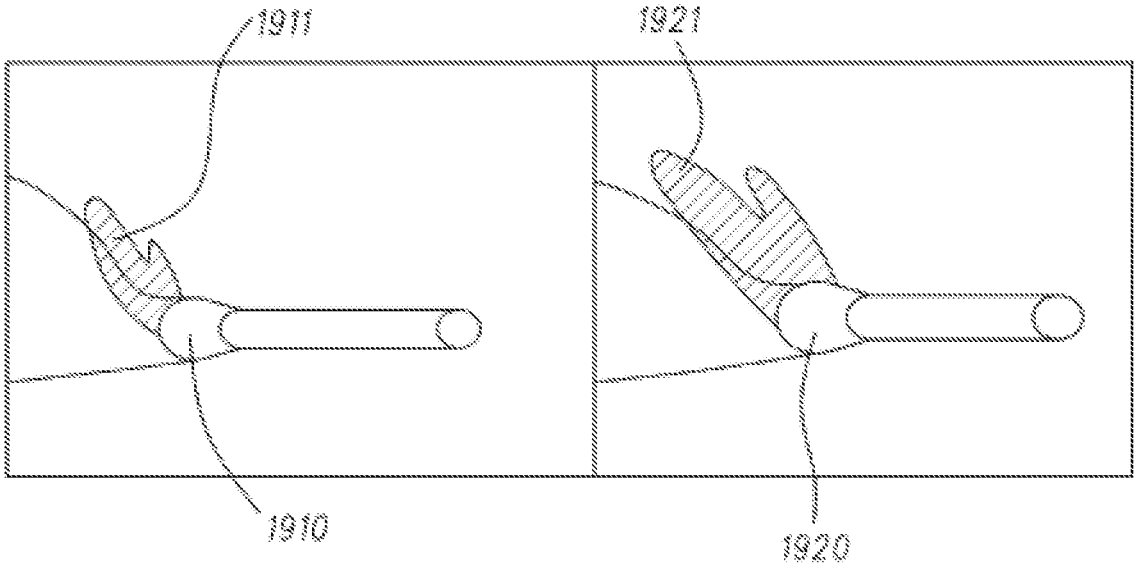
FIG. 19 illustrates a comparison of stagnant drag wake areas for respective hosels of different golf club heads 1910 and 1920.
Figure 20:
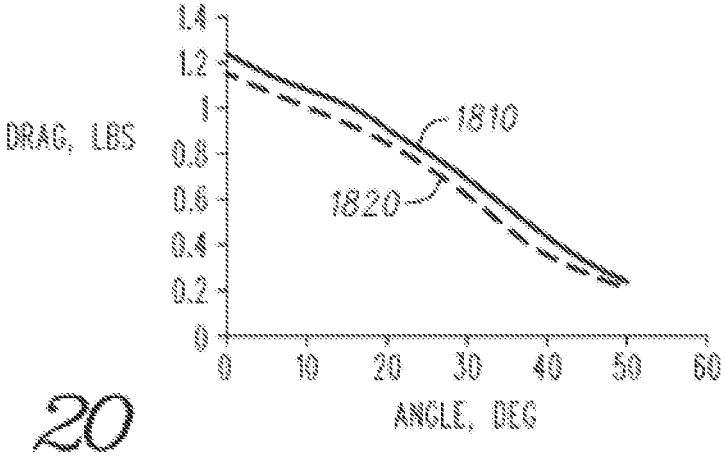
FIG. 20 illustrates a chart of drag as a function of open face angle with respect to the hosel diameters the golf club heads of FIG. 19.

Because hosel diameter 1031 can be minimized as described above, the aerodynamic characteristics of golf club head 101 can be improved as a result of the reduced aerodynamic drag from hosel 1015. FIG. 19 illustrates a comparison of stagnant drag wake areas 1911 and 1921 for respective hosels of golf club heads 1910 and 1920, where golf club head 1910 comprises a hosel diameter of approximately 0.5 inches, and where golf club head 1920 comprises a larger hosel diameter of approximately 0.62 inches. In some examples, golf club head 1910 can be similar to golf club head 101 (FIGS. 1-4, 8-9). As seen in FIG. 19, the larger hosel diameter of club head 1920 creates larger stagnant drag wake area 1921 downstream of its hosel, leading to higher values of aerodynamic drag when compared to the smaller stagnant drag wake area 1911 of club head 1910. FIG. 20 illustrates a chart of drag as a function of open face angle with respect to the hosel diameters golf club heads 1910 and 1920. In some examples, club head 1910 can also comprise a golf club shaft of reduced shaft thickness, such as a shaft thickness of approximately 0.335 inches (approximately 8.5 mm). In the same or other examples, for open-faced orientations of up to 50 degrees, such difference in hosel diameter can amount for up to approximately 0.1 pounds less drag resistance for golf club head 1910 when compared to the larger drag of golf club head 1920. In the same or other examples, the drag of golf club head 1910 can range from approximately 1.2 pounds at an approximately square orientation, to approximately 0.2 pounds at an open-faced orientation of approximately 50 degrees.

In the same or other embodiments, the mass and/or mass ratio of the golf coupler mechanisms of FIGS. 1-17 can be minimized with respect to their respective golf club heads when compared to other golf club heads with adjustable shaft coupling mechanisms. For instance, in examples where golf club head 101 (FIGS. 1-4, 8-9) comprises a driver-type golf club head, the different elements of club head 101 can comprise mass characteristics similar to those summarized below in Table 1.

TABLE 1

Sample Mass Characteristics for Driver-Type Golf Club Head

| | Exemplary Driver Head | Ranges for Driver Heads |
|---|---|---|
| Mass of Club Head 101 (Disassembled) | ≤192 grams (approx.) | 185-205 grams (approx.) |
| Mass of Sleeve 1100 | ≤5.2 grams (approx.) | ≤6 grams (approx.) |
| Mass of Sleeve 1100 + Securing Fastener 3400 | ≤6.8 grams (approx.) | ≤7.5 grams (approx.) |
| Total Assembled Club Head Mass | ≤198.8 grams (approx.) | 188-213 grams (approx.) |

In such examples, the mass ratios for the golf coupler mechanism 1000 relative to assembled club head 101 can be very low, as summarized below in Table 2.

TABLE 2

Sample Mass Ratios for Driver-Type Golf Club Head

| | Exemplary Driver Head | Ranges for Driver Heads |
|---|---|---|
| Mass of Sleeve | ≤2.7% | ≤3% |
| Mass of Disassembled Club Head | (approx.) | (approx.) |
| Mass of Sleeve | ≤2.6% | ≤3% |
| Mass of Assembled Club Head | (approx.) | (approx.) |
| Mass of (Sleeve + Securing Fastener) | ≤3.5% | ≤4% |
| Mass of Disassembled Club Head | (approx.) | (approx.) |
| Mass of (Sleeve + Securing Fastener) | ≤3.4% | ≤4% |
| Mass of Assembled Club Head | (approx.) | (approx.) |

In other examples, such as where golf club head 101 (FIGS. 1-4, 8-9) comprises a fairway-wood-type golf club head, the different elements of club head 101 can comprise mass characteristics similar to those summarized below in Table 3.

TABLE 3

Sample Mass Characteristics for Fairway-Wood-Type Golf Club Head

| | Exemplary 3-FW Head | Exemplary 5-FW Head | Exemplary 7-FW Head | Ranges for FW Heads |
|---|---|---|---|---|
| Mass of Club Head 101 (Disassembled) | ≤205 grams (approx.) | ≤209 grams (approx) | ≤213 grams (approx.) | 200-225 grams (approx.) |
| Mass of Sleeve 1100 | ≤5.2 grams (approx.) | ≤5.2 grams (approx.) | ≤5.2 grams (approx.) | ≤6 grams (approx.) |
| Mass of Sleeve 1100 + Securing Fastener 3400 | ≤6.8 grams (approx.) | ≤6.8 grams (approx.) | ≤6.8 grams (approx.) | ≤7.5 grams (approx.) |
| Total Assembled Club Head Mass | ≤211.8 (approx.) | ≤215.8 (approx.) | ≤219.8 (approx.) | 203-233 grams (approx.) |

In such examples, the mass ratios for the golf coupler mechanism 1000 relative to assembled club head 101 can be very low, as summarized below in Table 4.

TABLE 4

Sample Mass Ratios for Fairway-Wood-Type Golf Club Head

| | Exemplary 3-FW Head | Exemplary 5-FW Head | Exemplary 7-FW Head | Ranges for FW Heads |
|---|---|---|---|---|
| Mass of Sleeve | ≤2.54% | ≤2.48% | ≤2.44% | ≤2.8% |
| Mass of Disassembled Club Head | (approx.) | (approx.) | (approx.) | (approx.) |
| Mass of Sleeve | ≤2.46% | ≤2.41% | ≤2.36% | ≤2.8% |
| Mass of Assembled Club Head | (approx.) | (approx.) | (approx.) | (approx.) |
| Mass of (Sleeve + Securing Fastener) | ≤3.32% | ≤3.25% | ≤3.19% | ≤3.5% |
| Mass of Disassembled Club Head | (approx.) | (approx.) | (approx.) | (approx.) |
| Mass of (Sleeve + Securing Fastener) | ≤3.21% | ≤3.16% | ≤3.10% | ≤3.5% |
| Mass of Assembled Club Head | (approx.) | (approx.) | (approx.) | (approx.) |

There can be examples where the mass, dimension, and/or location characteristics described above can provide benefits and/or flexibility with respect to the mass distribution and/or location of the center of gravity (CG) for the golf club head. For example, shaft sleeve center of gravity 1150 (FIG. 1) of shaft sleeve 1100 can be configured to be located at shaft sleeve CG vertical distance 1159 (FIG. 1).

In some examples, such as in embodiments where club head 101 (FIGS. 1-4, 8-9) comprises a driver-type golf club head, shaft sleeve center of gravity 1150 (FIG. 1) of shaft sleeve 1100 can be configured to be located at shaft sleeve CG vertical distance 1159 can be of less than approximately 50 mm above the exterior sole bottom end 10141 of sole 1014 of driver-type club head 101. In the same or other examples, shaft sleeve CG vertical distance 1159 can be less than approximately 46.2 mm above exterior sole bottom end 10141. In the same or other examples, shaft sleeve CG vertical distance 1159 can be less than approximately 43.7 mm above the exterior sole bottom end 10141. Shaft sleeve center of gravity 1150 of shaft sleeve 1100 also can be configured to be located at shaft sleeve CG vertical distance 1059 (FIG. 1) of less than approximately 0.59 inches (approximately 15 mm) above assembled club head center of gravity 1050 (FIG. 1) of driver-type assembled golf club head 101 in some embodiments. In the same or other embodiments, shaft sleeve CG vertical distance 1159 can be at least approximately 7.6 mm greater than assembled club head CG vertical distance 1058 of driver-type club head 101.

In other examples, such as in embodiments where club head 101 (FIGS. 1-4, 8-9) comprises a fairway-wood-type golf club head, shaft sleeve center of gravity 1150 (FIG. 1) of shaft sleeve 1100 can be configured to be located at shaft sleeve CG vertical distance 1159 of less than approximately 35.6 mm above exterior sole bottom end of sole 1014 of fairway-wood-type club head 101. In the same or other examples, shaft sleeve CG vertical distance 1159 can be less than approximately 1.35 inches (approximately 34.3 mm) above exterior sole bottom end 10141 of sole 1014 of fairway-wood-type club head 101. Shaft sleeve center of gravity 1150 of shaft sleeve 1100 also can be configured to be located at shaft sleeve CG vertical distance 1059 (FIG. 1) of less than approximately 19 mm above assembled club head center of gravity 1050 (FIG. 1) of fairway-wood-type assembled golf club head 101 in some embodiments. In the same or other embodiments, shaft sleeve CG vertical distance 1159 can be at least approximately 16.5 mm greater than assembled club head CG vertical distance 1058 of fairway-wood-type club head 101.

In the present example, as seen in FIG. 1, hosel 1015 comprises hosel axis 1016 extending along a longitudinal centerline of hosel 1015. Hosel axis 1016 defines hosel lie angle 1018 relative to bottom horizontal axis 1019, where bottom horizontal axis 1019 is horizontally tangent to sole bottom end 10141. In some embodiments, hosel lie angle 1018 can be of, for example, approximately 58 degrees. In the present embodiment, shaft sleeve CG vertical distance 1159 and assembled club head CG vertical distance 1058 extend vertically from bottom horizontal axis 1019.

Club head 101 also comprises crown height vertical distance 1018 extending vertically to the top end of crown 1017 relative to sole bottom end 10141. In some embodiments, such as where club head 101 comprises a driver-type golf club head, crown height vertical distance 1018 can be of at least approximately 59.7 mm relative to sole bottom end 10141. In the same or other embodiments, assembled club head CG vertical distance can be less than approximately 33 mm relative to sole bottom end 10141.

There can also be examples, such as seen in FIG. 1, where receiver top end 1032 is at the top of hosel 1015 and is configured to remain below the top end of crown 1017 of golf club head 101. Hosel 1015 can be devoid of a cylindrical external top section in the same or other embodiments, where crown 1017 can transition to the substantially circular external perimeter at receiver top end 1032 of hosel 1015 without defining an cylindrical external shape for hosel 1015. Such features can permit location of the center of gravity of shaft sleeve 1100 closer to the center of gravity of assembled golf club head 101.

Backtracking though the figures, FIG. 18 illustrates a flowchart for a method 18000, which can be used to provide, form, and/or manufacture a golf coupler mechanism in accordance with the present disclosure. In some examples, the golf coupler mechanism can be similar to golf coupler mechanism 1000 of FIGS. 1-11 and 14-16, or the golf coupler mechanism of FIGS. 12-13.

Method 18000 comprises block 18100 for providing a shaft sleeve to couple with an end of a golf club shaft and comprising a sleeve arcuate coupler set. In some examples, the shaft sleeve can be similar to shaft sleeve 1100 (FIGS. 1-7, 10, 14-16) and/or to shaft sleeve 12100 (FIG. 12), and the golf club shaft can be similar to golf club shaft 102 (FIGS. 1, 5). In the same or other examples, the sleeve arcuate coupler set can be similar to sleeve coupler set 3110 (FIGS. 3-7, 10, 14-17) and/or to sleeve coupler set 12110 (FIG. 12).

Block 18200 of method 18000 comprises providing a shaft receiver of a golf club head, comprising a receiver arcuate coupler set configured to couple with the sleeve arcuate coupler set of the shaft sleeve. In some examples, the shaft receiver can be similar to shaft receiver 3200 (FIGS. 3-4, 8-9, 11, 14-17) and/or to shaft receiver 13200 (FIG. 13). The receiver arcuate coupler set can be similar to receiver coupler set 3210 (FIGS. 3-4, 8-9, 11, 14-17) and/or to receiver coupler set 13210 (FIG. 13).

Block 18300 of method 18000 comprises providing a securing fastener configured to secure the shaft sleeve to the shaft receiver. In some examples, the securing fastener can be similar to securing fastener 3400 (FIGS. 3-4). The securing fastener can be configured to pull the shaft sleeve towards the shaft receiver to seat the sleeve arcuate coupler set against the receiver arcuate coupler set.

In some examples, one or more of the different blocks of method 18000 can be combined into a single block or performed simultaneously, and/or the sequence of such blocks can be changed. For example, in some embodiments, blocks 18200 and 18300 may be combined if desired. In the same or other examples, some of the blocks of method 18000 can be subdivided into several sub-blocks. As an example, block 18100 may comprise a sub-block for forming horizontal radii of curvature for the arcuate surfaces of the sleeve couplers of the sleeve arcuate coupler set, and a sub-block for forming vertical taperings for the arcuate surfaces of the sleeve couplers of the sleeve arcuate coupler set. There can also be examples where method 18000 can comprise further or different blocks. As an example, method 18000 may comprise another block for providing the golf club head for the shaft receiver of block 18200, and/or another block for providing the shaft for the shaft sleeve of block 18100. In addition, there may be examples where method 18000 can comprise only part of the steps described above. For instance, block 18300 may be optional in some implementations. Other variations can be implemented for method 18000 without departing from the scope of the present disclosure.

Slot Cap Golf Coupling Mechanism

Figure 21:
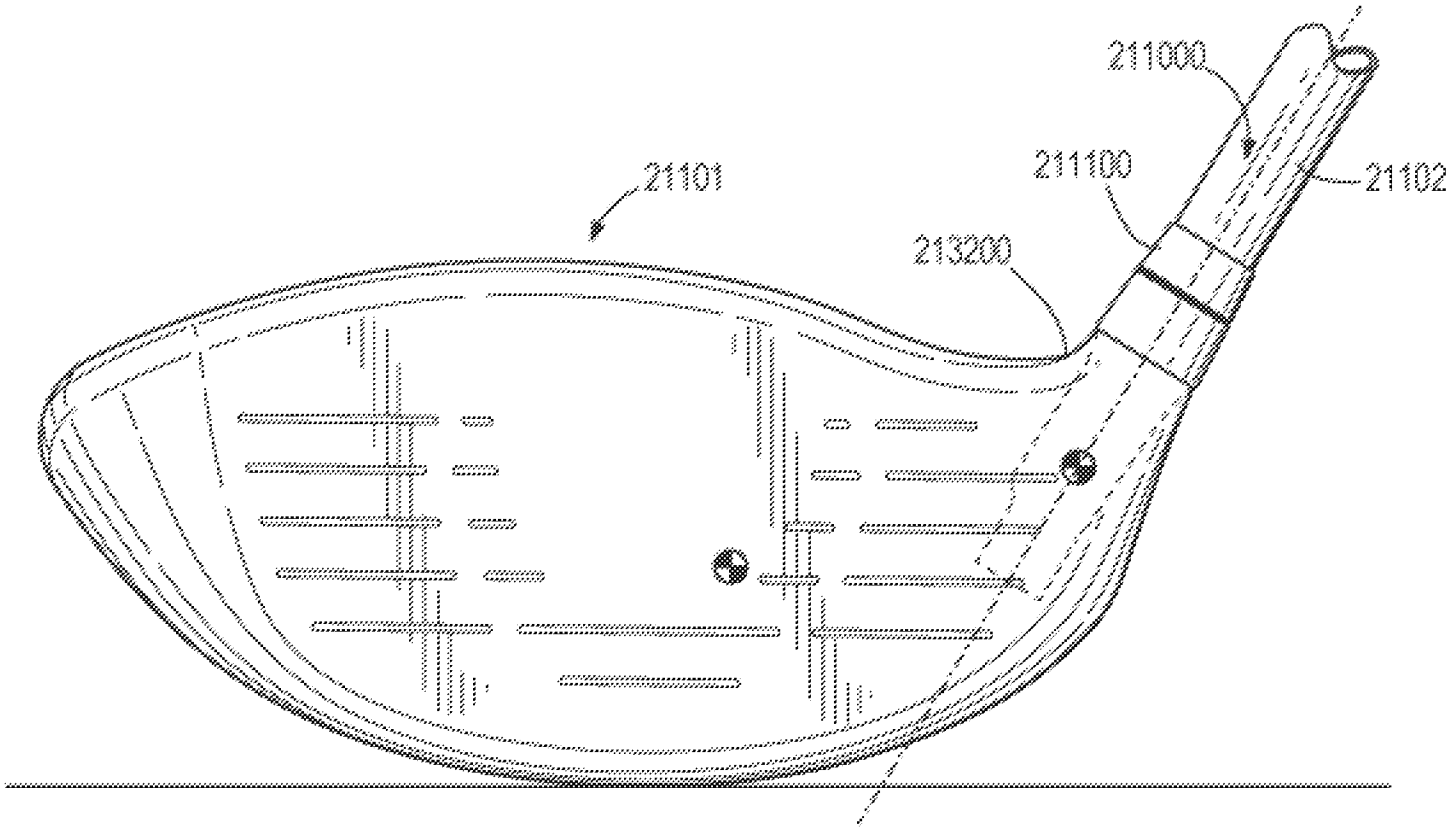
FIG. 21 illustrates a front perspective view of a golf club head with a golf coupling mechanism, according to an embodiment.

Turning ahead in the drawings, FIG. 21 illustrates a front perspective view of golf club head 21101 with golf coupling mechanism 211000, according to an embodiment. In many embodiments, golf coupling mechanism 211000 can comprise shaft sleeve 211100 configured to be coupled to an end of a golf club shaft, such as golf club shaft 21102. In various embodiments, golf club head 21101 can be similar to golf club head 101 (FIG. 1); golf coupling mechanism 211000 can be similar to golf coupling mechanism 1000 (FIG. 1); and/or golf club shaft 21102 can be similar or identical to golf club shaft 102 (FIG. 1). Accordingly, golf coupling mechanism 211000 can comprise shaft sleeve 211100 and shaft receiver 213200. Meanwhile, shaft sleeve 211100 can be similar to shaft sleeve 1100 (FIG. 1), and/or shaft receiver 213200 can be similar to shaft receiver 3200 (FIG. 3).

Figure 22:
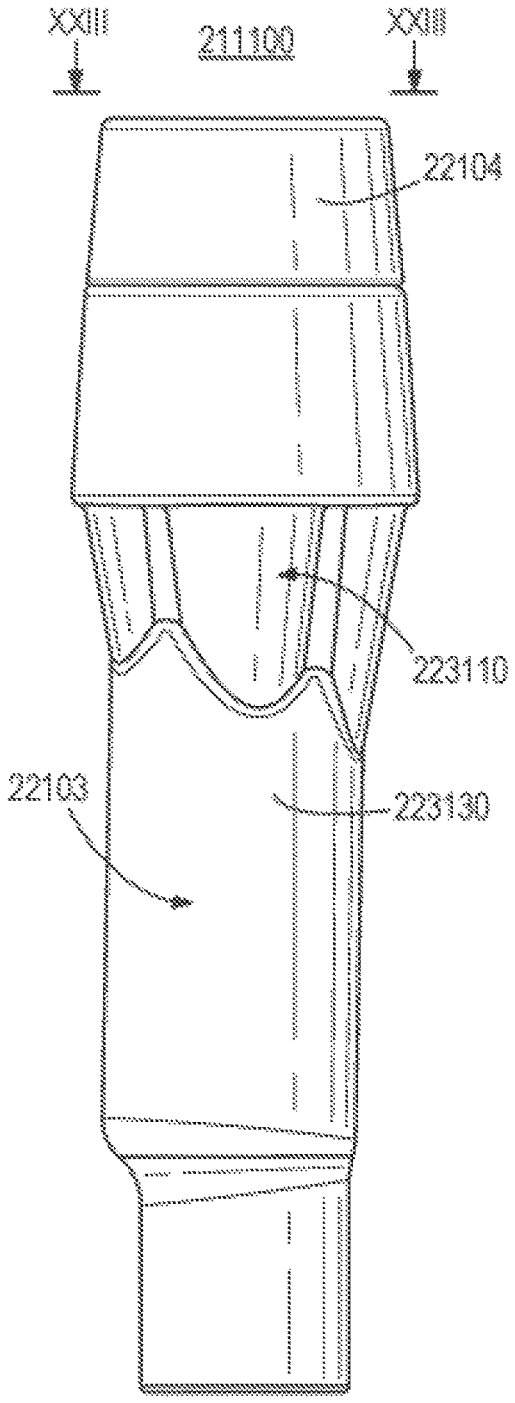
FIG. 22 illustrates a side view of a shaft sleeve of the golf coupling mechanism of the golf club head decoupled from the golf club head, according to the embodiment of FIG. 21.
Figure 22A:
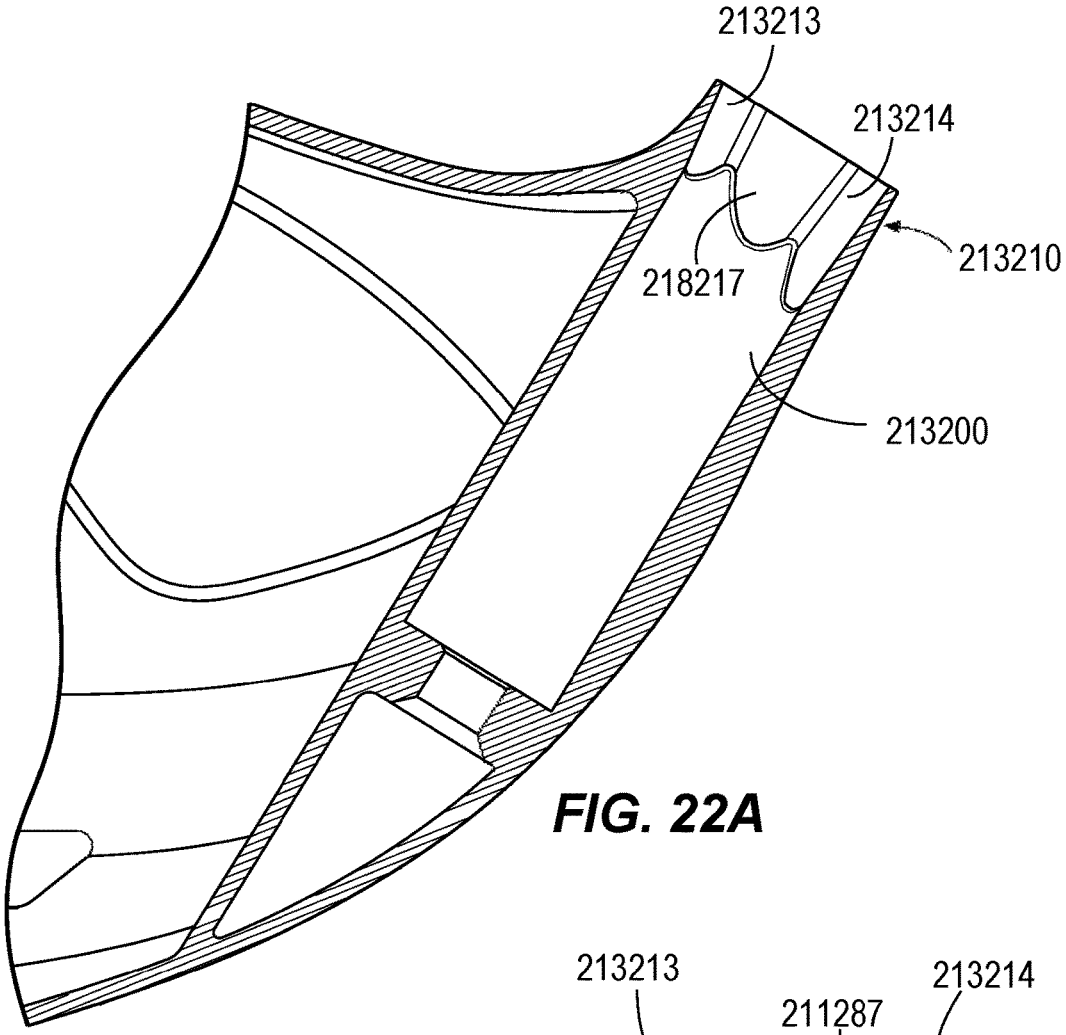
FIG. 22A illustrates a side cross-sectional view of the golf club head of FIG. 21 along cross-sectional line of FIG. 2, with the shaft sleeve removed therefrom.
Figure 22B:
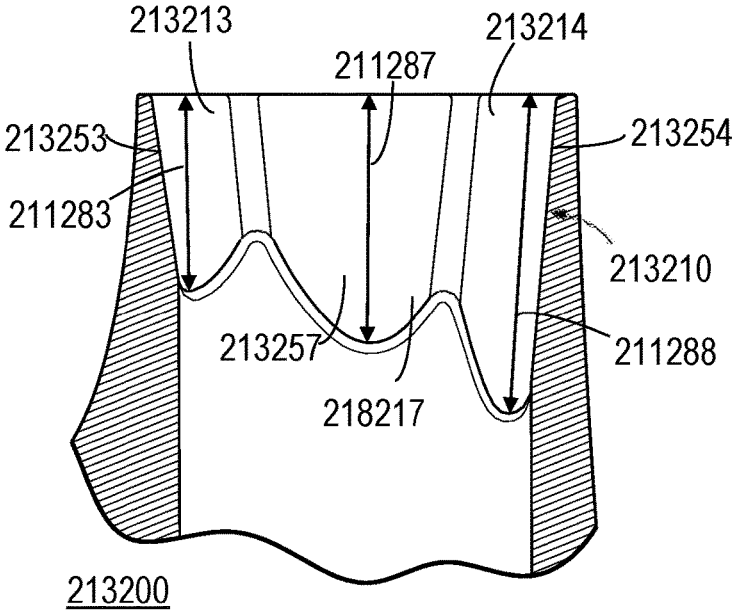
FIG. 22B illustrates a side x-ray view of a portion of a receiver coupler set of the shaft receiver.

Turning ahead again in the drawings, FIG. 22 illustrates a side view of shaft sleeve 211100 decoupled from golf club head 21101 (FIG. 21), according to the embodiment of FIG. 21. FIG. 22A illustrates a cross-sectional side view of golf club head 21101 with shaft sleeve 211100 removed, showing a side cross section of shaft receiver 213200 with asymmetric lobes. FIG. 22B illustrates a side cross-sectional view of a portion of a receiver coupler set of the shaft receiver, wherein the asymmetric lobes comprise different vertical taperings resulting in different lobe lengths. Meanwhile, FIG. 23 illustrates a cross sectional view of shaft sleeve 211100 along line XXIII-XXIII of FIG. 22, according to the embodiment of FIG. 21.

Referring to FIG. 22, shaft sleeve 211100 comprises shaft sleeve body 22103 and shaft sleeve cap 22104. Further, in many embodiments, shaft sleeve body 22103 can comprise sleeve coupler set 223110 with one or more couplers protruding from sleeve body outer wall 223130, and shaft receiver 213200 (FIG. 21) can comprise a receiver coupler 213210 (FIG. 22B) set configured to engage sleeve coupler set 223110 of shaft sleeve 211100 to restrict a rotation of shaft sleeve 211100 relative to shaft receiver 213200. In these or other embodiments, sleeve coupler set 213110 can be similar to sleeve coupler set 3110 (FIG. 3); sleeve body outer wall 223130 can be similar to sleeve outer wall 3130 (FIG. 3); and/or the receiver coupler set can be similar to receiver coupler set 3210 (FIG. 3). Shaft sleeve 211100 is configured to be inserted into shaft receiver 223200, such that receiver couplers 213213, 218217, and 213214, shown in FIG. 22A, comprise arcuate surfaces 213253, 213257, and 213254, shown in FIG. 22B, that correspond to the arcuate surfaces sleeve coupler set 223110. For example, as shown in FIG. 22B, arcuate surfaces 213253, 213257, and 213254 of receiver couplers 213213, 218217, and 213214 comprise vertical taperings 211283, 211287, and 211284, which are complementary with vertical taperings of the sleeve couplers of sleeve coupler set 223110. As explained in greater detail below, in many embodiments, shaft sleeve cap 22104 can comprise a ferrule and can be operable to couple shaft sleeve body 22103 with golf club shaft 21102 (FIG. 21).

Figure 23:
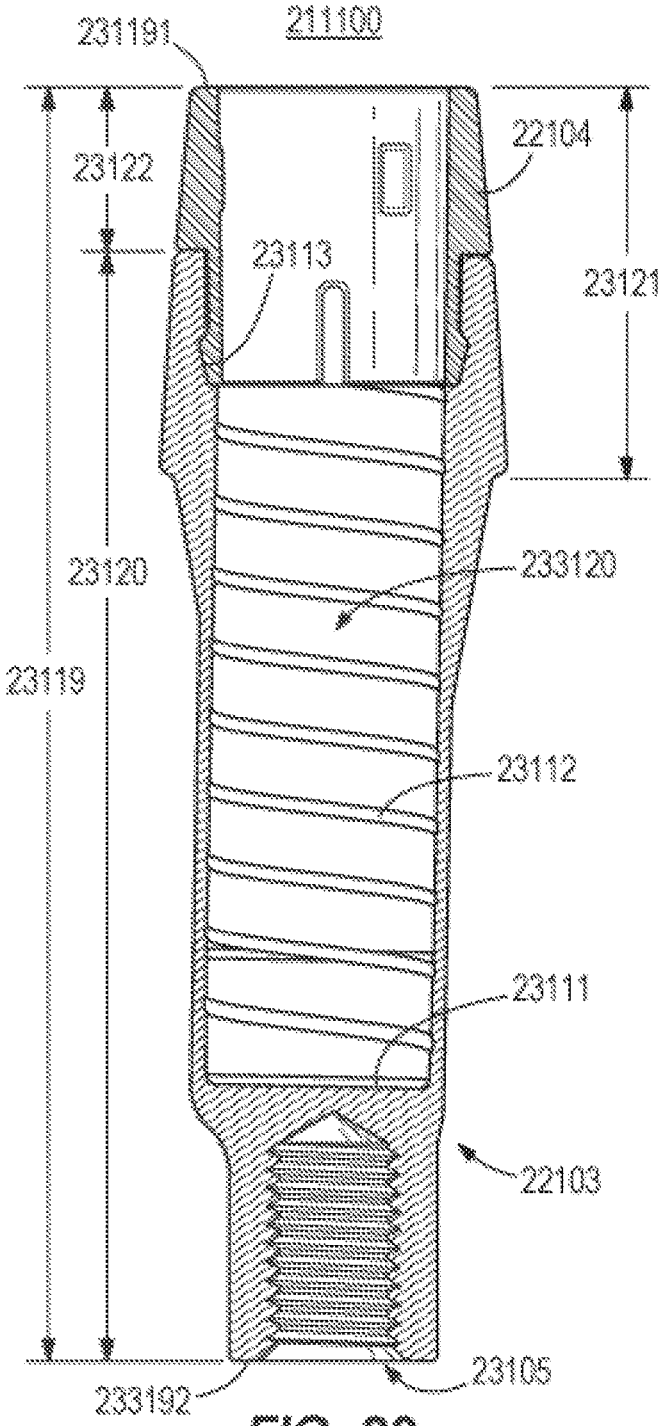
FIG. 23 illustrates a cross sectional view of the shaft sleeve along line XXIII-XXIII of FIG. 22, according to the embodiment of FIG. 21.

Meanwhile, turning now to FIG. 23, shaft sleeve 211100 can comprise: (i) shaft bore 233120 configured to receive an end of golf club shaft 21102 (FIG. 21), (ii) securing fastener bore 23105 at sleeve body bottom end 233192, (iii) bore bottom surface 23111; and/or (iv) shaft sleeve top end 231191. Securing fastener bore 23105 can be configured to receive a securing fastener (not shown) in order to secure shaft sleeve 211100 to shaft receiver 213200 (FIG. 21).

Further, bore bottom surface 23111 can comprise a bottom surface (e.g., deepest surface) of shaft bore 232120. In many embodiments, shaft bore 233120 can be similar to shaft bore 3120 (FIG. 3); securing fastener bore 23105 can be similar or identical to the bore configured to receive securing fastener 3400 (FIG. 3); sleeve body bottom end 233192 can be similar or identical to sleeve bottom end 3192 (FIG. 3); the securing fastener can be similar or identical to securing fastener 3400 (FIG. 3); and/or shaft sleeve top end 231191 can be similar or identical to sleeve top end 1191 (FIG. 3).

Further, when shaft sleeve body 22103 is coupled to shaft sleeve cap 22104, shaft sleeve 211100 can comprise shaft sleeve height 23119, shaft sleeve body height 23120, shaft sleeve cap height 23121, and shaft sleeve cap top height 23122. Shaft sleeve height 23119 can refer to a distance from sleeve body bottom end 233192 to shaft sleeve top end 231191 measured approximately perpendicular to sleeve body bottom end 233192. Meanwhile, shaft sleeve body height 23120 can refer to a distance from sleeve body bottom end 233192 to a top end of shaft sleeve body 22103 measured parallel to shaft sleeve height 23119, and shaft sleeve cap height 23121 can refer to a distance from a bottom of shaft sleeve cap 22104 to shaft sleeve top end 231191 measured parallel to shaft sleeve height 23119. Further, shaft sleeve cap top height 23122 can refer to a difference between shaft sleeve height 23119 and shaft sleeve body height 23120.

For example, shaft sleeve height 23119 can be greater than or equal to approximately 1.78 inches and less than or equal to approximately 1.82 inches. In specific examples, shaft sleeve height 23119 can be approximately 1.8 inches.

Further, shaft sleeve body height 23120 can be greater than or equal to approximately 1.527 inches and less than or equal to approximately 1.567 inches. In specific examples, shaft sleeve body height 23120 can be approximately 1.547 inches.

Further still, shaft sleeve cap height 23121 can be greater than or equal to approximately 0.43 inches and less than or equal to approximately 0.47 inches. In specific examples, shaft sleeve cap height 23121 can be approximately 0.45 inches.

Meanwhile, for example, shaft sleeve cap top height 23122 can be greater than or equal to approximately 0.23 inches and less than or equal to approximately 0.27 inches. In specific examples, shaft sleeve body height 23122 can be approximately 0.25 inches.

In some embodiments, the securing fastener (not shown) for insertion into securing fastener bore 23105 can comprise titanium over steel. Further, the securing fastener can comprise a securing fastener mass. The securing fastener mass can be greater than or equal to approximately 2.7 grams.

Figure 24:
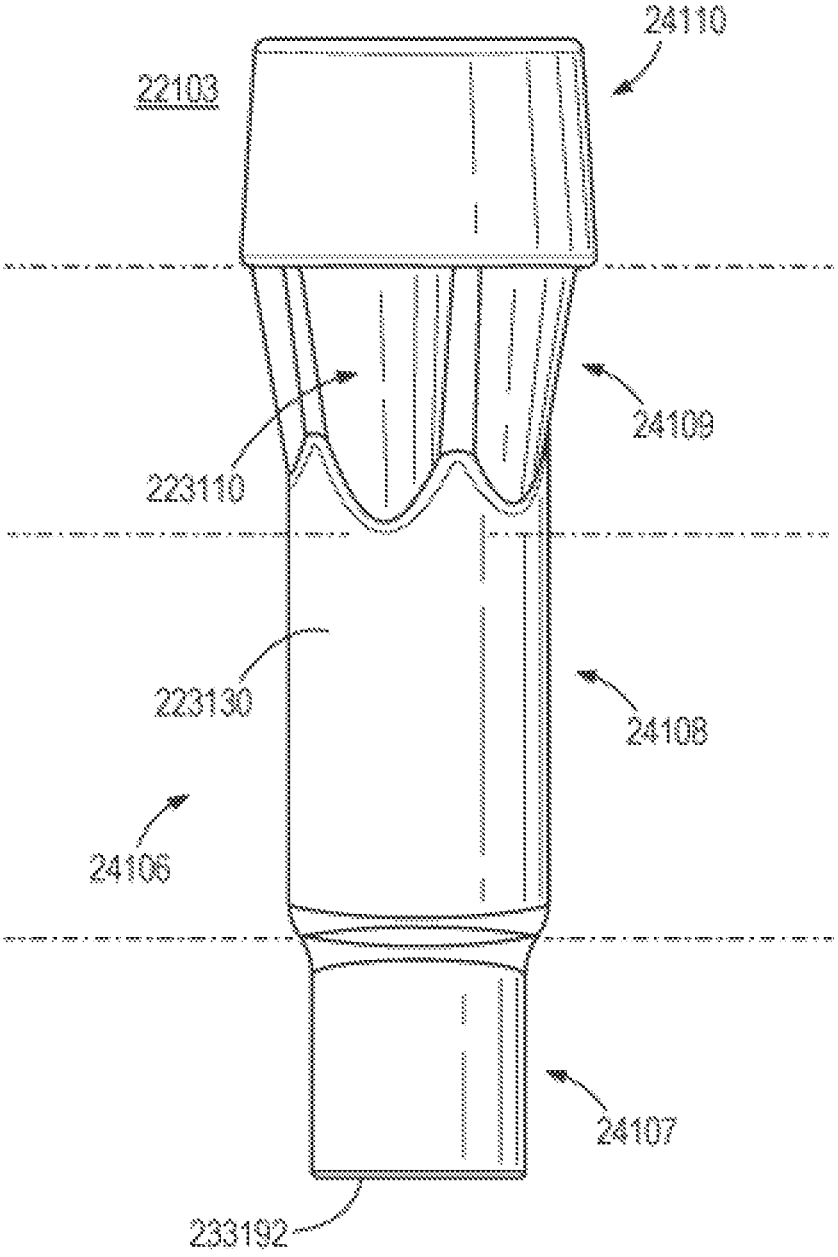
FIG. 24 illustrates a side view of a shaft sleeve body of the shaft sleeve decoupled from a shaft sleeve cap of the shaft sleeve, according to the embodiment of FIG. 21.

Turning to the next drawing, FIG. 24 illustrates a side view of shaft sleeve body 22103 decoupled from shaft sleeve cap 22104 (FIG. 22), according to the embodiment of FIG. 21. Shaft sleeve body 22103 can be associated with one or more regions 24106. For example, regions 24106 can comprise fastener region 24107, intermediate region 24108, coupler region 24109, and cap interface region 24110.

Fastener region 24107 can refer to a portion of shaft sleeve body 22103 located between sleeve body bottom end 233192 and bore bottom surface 23111 (FIG. 23). Meanwhile, coupler region 24109 can refer to a portion of shaft sleeve body located from a lowest point of sleeve coupler set 223110 (e.g., a point of sleeve coupler set 223110 closest to sleeve body bottom end 233192 (FIG. 23)) to a highest point of sleeve coupler set 223110 (e.g., a point of sleeve coupler set 223110 farthest from sleeve body bottom end 233192). Meanwhile, intermediate region 24108 can refer to a portion of shaft sleeve body 22103 between fastener region 24107 and coupler region 24109, and cap interface region 24110 can refer to a portion of shaft sleeve body 22103 opposite coupler region 24109 with respect to intermediate region 24108.

When golf club head 21101 (FIG. 21) is being swung and/or operated to hit a golf ball, fastener region 24107 and coupler region 24109 can experience high stresses. Meanwhile, intermediate region 24108 and/or cap interface region 24110 can experience stresses lower than the high stresses experienced by fastener region 24107 and coupler region 24109.

Securing shaft sleeve 211100 (FIG. 21) to shaft receiver 213200 (FIG. 21) with the securing fastener can help to offset the high stresses at fastener region 24107. Further, because of the high stresses that can be experienced at coupler region 24109, the coupler(s) of sleeve coupler set 223110 can comprise solid lobes configured to provide additional thickness to a sleeve body wall of shaft sleeve body 22103. Accordingly, the coupler(s) can reinforce the sleeve body wall at coupler region 24109 to offset these the high stresses at coupler region 24109. The coupler(s) of sleeve coupler set 223110 can slope (e.g., linearly or curvedly) with a greatest thickness at an end of coupler region 24109 farthest from sleeve body bottom end 233192 (e.g., where coupler region 24109 interfaces with cap interface region 24110) and with a least thickness at an end of coupler region 24109 nearest sleeve body bottom end 233192 (FIG. 23) (e.g., where coupler region 24109 interfaces with intermediate region 24108). For example, the greatest thickness can be approximately 0.75 inch thick, and the least thickness can be approximately 0.020 inch thick. In many embodiments, sloping the coupler(s) of sleeve coupler set 223110 (FIG. 22) can provide continuity (e.g., smooth transitioning in thickness) between intermediate region 24108 and cap interface region 24110).

In some embodiment, the coupler(s) of sleeve couple set 223110 can be symmetric in profile. A length of the coupler (s) of sleeve coupler set 223110 can be less than or equal to approximately 0.38 inch (e.g., at part of the sleeve body outer wall 223130 of shaft sleeve body 42103) and can be greater than or equal to approximately 0.26 inch (e.g., at another part of the sleeve body outer wall 423130 of shaft sleeve body 22103).

In some embodiments, the coupler(s) of sleeve coupler set 223110 can be asymmetric in profile such that the coupler(s) are longer at a first part of sleeve body outer wall 223130 of shaft sleeve body 22103 than at another part (e.g., a part directly or 180 degrees opposite the first part). A length of the coupler(s) of sleeve coupler set 223110 can be less than or equal to approximately 0.38 inch (e.g., at part of the sleeve body outer wall 223130 of shaft sleeve body 22103) and can be greater than or equal to approximately 0.260 inch (e.g., at another part of the sleeve body outer wall 223130 of shaft sleeve body 22103). In many embodiments, the coupler(s) of sleeve coupler set 223110 (FIG. 22) can be longest at a part of the sleeve body outer wall 223130 of shaft sleeve body 22103 closest to a sleeve axis of shaft sleeve body 22103 at an end of coupler region 24109 farthest from sleeve body bottom end 233192 (e.g., where coupler region 24109 interfaces with cap interface region 24110). The sleeve axis can be similar or identical to sleeve axis 5150 (FIG. 5). Said another way, the coupler(s) of sleeve coupler set 223110 (FIG. 22) can be longest at a part of the sleeve body outer wall 223130 of shaft sleeve body 22103 that intersects a plane including the sleeve axis and extending approximately perpendicular to sleeve body bottom end 233192.

Meanwhile, because intermediate region 24108 experiences lower stresses when golf club head 21101 is being swung and/or operated to hit a golf ball, a sleeve body wall of shaft sleeve body can be thinner at intermediate region 24108 than at part or all of coupler region 24109, and/or intermediate region 24108 can have holes or recesses to reduce the weight of intermediate region 24108. For example, the sleeve body wall of shaft sleeve body 22103 at intermediate region 24108 can comprise a thickness (e.g., an average thickness) of approximately 0.020 inch.

Turning now back to FIG. 23, in some embodiments, shaft bore 233120 can comprise a width (e.g., diameter) of approximately 0.346 inches. In these embodiments, the width can comprise an average width and/or can be approximately constant throughout shaft bore 233120.

In various embodiments, shaft sleeve body 22103 can comprise etching channels 23112 at shaft bore 233120 to provide a better surface area for epoxy bonding golf club shaft 21102 (FIG. 21) to shaft sleeve body 22103. Etching channels 23112 can be located at coupler region 24109 (FIG. 24) and/or at part or all of intermediate region 24108 (FIG. 24), such as, for example, at a half of intermediate region 24108 (FIG. 24) closer to coupler region 24109 (FIG. 24).

Figure 25:
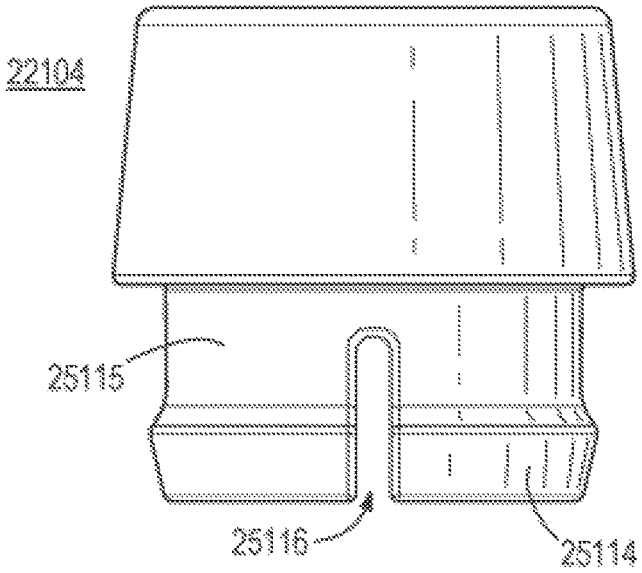
FIG. 25 illustrates a side view of the shaft sleeve cap decoupled from shaft sleeve body, according to the embodiment of FIG. 21.

In these or other embodiments, shaft sleeve body 22103 can comprise receiving groove 23113 (e.g., an undercut notch). As explained in greater detail below, receiving groove 23113 can communicate and interlock with extrusion portion 25114 (FIG. 25) of shaft sleeve cap 22104 to secure shaft sleeve cap 22104 to shaft sleeve body 22103. Thus, in many embodiments, receiving groove 23113 can complement extrusion portion 25114 (FIG. 25). In some embodiments, receiving groove 23113 can be located at cap interface region 24110 (FIG. 24). In many embodiments, receiving groove 23113 can be located at an interface of cap interface region 24110 (FIG. 24) and coupler region 24109 (FIG. 24).

Turning ahead now in the drawings, FIG. 25 illustrates a side view of shaft sleeve cap 22104 decoupled from shaft sleeve body 22103 (FIG. 22), according to the embodiment of FIG. 21.

In some embodiments, shaft sleeve cap 22104 can comprise cap wall 25115. Further, cap wall 22115 can comprise extrusion portion 25114 and one or more slits 25116.

Extrusion portion 25114 can comprise a lip extending out from cap wall 25115, such as, for example, at an end of cap wall 25115. Accordingly, extrusion portion 25114 can comprise a width (e.g., diameter) greater than a width (e.g., diameter) of a remainder of cap wall 25115 and/or of shaft bore 233120.

Meanwhile, slit(s) 25116 can permit cap wall 25115 (e.g., extrusion portion 25114) to elastically (e.g., temporarily) compress (e.g., axially) and draw toward itself when shaft sleeve cap 22104 is being coupled to and being decoupled from shaft sleeve body 22103 (FIG. 22). Accordingly, extrusion portion 25114 can be situated in and out of receiving groove 23113 (FIG. 23) to couple and decouple shaft sleeve cap 22104 to and from shaft sleeve body 22103 (FIG. 22). In these embodiments, extrusion portion 25114 can be operable as a locking feature to lock or snap into position the shaft sleeve cap 22104.

Shaft sleeve cap 22104 can be further operable to provide damping (e.g., vibration and/or stress reduction) between golf club shaft 21102 (FIG. 21) and shaft sleeve body 22103 (FIG. 22). For example, shaft sleeve cap 22104 can act as a "shaft pillow" by increasing a concentricity of golf club shaft 21102 (FIG. 21) within shaft sleeve body 22103 (FIG. 22). In many embodiments, the concentricity of golf club shaft 21102 (FIG. 21) within shaft sleeve body 22103 (FIG. 22) can be strongly correlated with a durability of golf club shaft 21102 (FIG. 21). Accordingly, shaft sleeve cap 22104 can prevent breakage of golf club shaft 21102 (FIG. 21) and increase an overall life of golf club head 21101 (FIG. 21).

Figure 26:
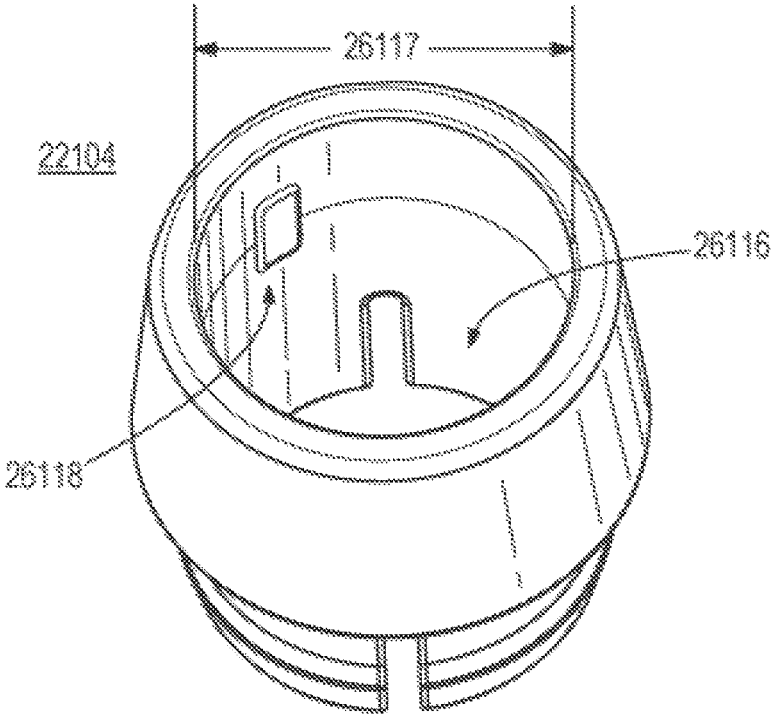
FIG. 26 illustrates an elevational view of the shaft sleeve cap decoupled from the shaft sleeve body, according to the embodiment of FIG. 21.

Turning ahead in the drawings, FIG. 26 illustrates an elevational view of shaft sleeve cap 22104 decoupled from shaft sleeve body 22103 (FIG. 22), according to the embodiment of FIG. 21. In many embodiments, shaft sleeve cap 22104 can comprise cap bore 26116, cap bore width 26117, and one or more centering features 26118. In some embodiments, shaft bore 233120 (FIG. 23) also can comprise cap bore width 26117. Cap bore width 26117 can refer to a width (e.g., diameter) of cap bore 26116. In these embodiments, the width can comprise an average width (e.g., average diameter).

Cap bore width 26117 can be greater than a width (e.g., diameter) of golf club shaft 21102 (FIG. 21). Dissimilarity in cap bore width 26117 and the width of golf club shaft 21102 (FIG. 21) can result in shaft orientation inconsistencies. Accordingly, to prevent misalignment of golf club shaft 21102 (FIG. 21), centering feature(s) 26118 can be extruded from an interior surface of cap bore 26116. A distance that centering feature(s) 26118 extends from the interior surface of cap bore 26116 can be at least enough so that a collective magnitude will provide an effective width (e.g., diameter) within cap bore 26116 that is approximately less than or equal to the width of golf club shaft 21102 (FIG. 21). Cap bore width 26117 is greater than the effective width of cap bore 26116 resulting from centering feature(s) 26118. Further, cap bore width 26117 can be similar or identical to the width of shaft bore 233120 (FIG. 23). Therefore, when golf club shaft 21102 (FIG. 21) is introduced to shaft sleeve cap 22104 and shaft sleeve body 22103 (FIG. 23), centering feature(s) 26118 are operable to approximately center golf club shaft 21102 (FIG. 21) in cap bore 26116 and about the sleeve axis described above.

Turning back to FIG. 22, shaft sleeve body 22103 can comprise any suitable material. For example, in some embodiments, shaft sleeve body 22103 can comprise a metal or metal alloy (e.g., an aluminum alloy). In these examples, the aluminum alloy can comprise greater than or equal to approximately 70% aluminum and less than or equal to approximately 75% aluminum. In more specific examples, the aluminum alloy can comprise approximately 70%, 71%, 72%, 73%, 74%, or 75% aluminum. Likewise, shaft sleeve cap 22104 can comprise any suitable material configured to permit cap wall 25115 (FIG. 25) to elastically compress as described above. For example, shaft sleeve cap 22104 can comprise a polymer material.

In many embodiments, shaft sleeve body 22103 can comprise a shaft sleeve body mass, and shaft sleeve cap 22104 can comprise a shaft sleeve cap mass. Further, shaft sleeve 211100 can comprise a shaft sleeve mass comprising the shaft sleeve body mass and the shaft sleeve cap mass. The shaft sleeve mass can be similar to the mass of the sleeve described above with respect to sleeve 1100 (FIG. 1).

In these or other embodiments, the shaft sleeve mass can be greater than or equal to approximately 4.3 grams. Further, the shaft sleeve body mass can be greater than or equal to approximately 3.3 grams and less than or equal to approximately 3.8 grams. Further still, the shaft sleeve cap mass can be greater than or equal to approximately 0.5 grams and less than or equal to approximately 1.0 grams. In various embodiments, the shaft sleeve mass can be approximately 0.5 grams less than the mass of sleeve 1100 (FIG. 1). Further, the shaft sleeve mass combined with the securing fastener mass can be greater than or equal to approximately 7 grams. According, in various embodiments, shaft sleeve 211100 can offer weight advantages over shaft sleeve 1100 (FIG. 1).

Turning to FIG. 21, golf club head 21101 can comprise a disassembled club head mass and an assembled club head mass. The disassembled club head mass can be similar to the disassembled club head mass described above with respect to golf club head 101 (FIG. 1), and the assembled club head mass can be similar to the assembled club head mass described above with respect to golf club head 101 (FIG. 1).

In some embodiments, the disassembled club head mass can be greater than or equal to approximately 185 grams and less than or equal to approximately 205 grams. In these or other embodiments, the disassembled club head mass can be greater than or equal to approximately 192 grams.

In some embodiments, the assembled club head mass can be greater than or equal to approximately 188 grams and less than or equal to approximately 213 grams. In these or other embodiments, the assembled club head mass can be greater than or equal to approximately 199 grams.

Further, a ratio of the shaft sleeve mass to the disassembled club head mass can be less than or equal to approximately 2.0%, 2.2%, or 2.4%; a ratio of the shaft sleeve mass to the assembled club head mass can be less than or equal to approximately 1.95%, 2.16%, or 2.35%; a ratio of the shaft sleeve mass and the securing fastener mass to the disassembled club head mass can be less than or equal to approximately 3.4%, 3.6%, or 3.8%; and/or a ratio of the shaft sleeve mass and the securing fastener mass to the assembled club head mass can be less than or equal to approximately 3.3%, 3.5%, or 3.7%.

Meanwhile, golf club head 21101 can comprise an assembled club head CG associated with assembled club head CG vertical distance, and shaft sleeve 211100 can comprise a shaft sleeve CG associated with a shaft sleeve CG vertical distance. In these embodiments, assembled club head CG can be similar or identical to assembled club head CG 1050 (FIG. 1); the assembled club head CG vertical distance can be similar or identical to assembled club head CG vertical distance 1058 (FIG. 1); the shaft sleeve CG can be similar or identical to shaft sleeve CG 1032 (FIG. 1); and/or the shaft sleeve CG vertical distance can be similar or identical to shaft sleeve CG vertical distance 1159 (FIG. 1). In many embodiments, the shaft sleeve CG vertical distance can be greater than or equal to approximately 0.010 inch (approximately 0.254 millimeter) and less than or equal to approximately 0.050 inch (approximately 1.27 millimeter) less than shaft sleeve CG vertical distance 1159 (FIG. 1). For example, the shaft sleeve CG vertical distance can be greater than or equal to approximately 44.9 millimeters from a sole bottom end of golf club head 21101 and less than or equal to approximately 46 millimeters from the sole bottom end of golf club head 21101. In specific examples, the shaft sleeve CG vertical distance can be greater than or equal to approximately 44.9 millimeters, 45.0 millimeters, 45.1 millimeters, 45.2 millimeters, 45.3 millimeters, 45.4 millimeters, 45.5 millimeters, 45.6 millimeters, 45.7 millimeters, 45.8 millimeters, 45.9 millimeters, 46.0 millimeters from the sole bottom end of golf club head 21101. In some embodiments, the shaft sleeve CG vertical distance of the golf coupling mechanism 211000 can be less than or equal to approximately 44.9 millimeters, 45.0 millimeters, 45.1 millimeters, 45.2 millimeters, 45.3 millimeters, 45.4 millimeters, 45.5 millimeters, 45.6 millimeters, 45.7 millimeters, 45.8 millimeters, 45.9 millimeters, or 46.0 millimeters from the sole bottom end of golf club head 41101. The shaft sleeve CG vertical distance of the golf coupling mechanism 411000 can be 44.9 millimeters from the sole bottom end of golf club head 41101. The sole bottom end can be similar or identical to sole bottom end 10141 (FIG. 1).

Figure 27:
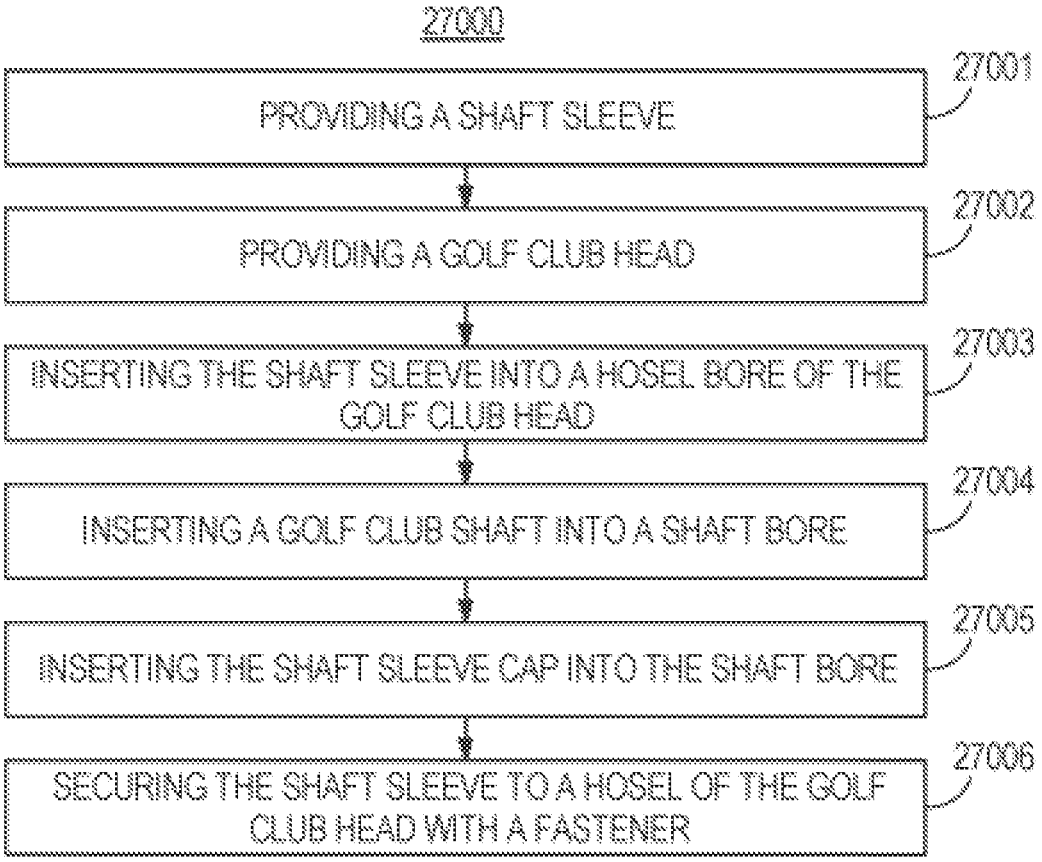
FIG. 27 illustrates a flowchart for a method, according to an embodiment.

Turning ahead in the drawings, FIG. 27 illustrates a flowchart for a method 27000, according to an embodiment. In many embodiments, method 27000 can comprise a method of manufacturing a golf club head of one or more parts of the golf club head. The golf club head can be similar or identical to golf club head 21101 (FIG. 21).

Figure 28:
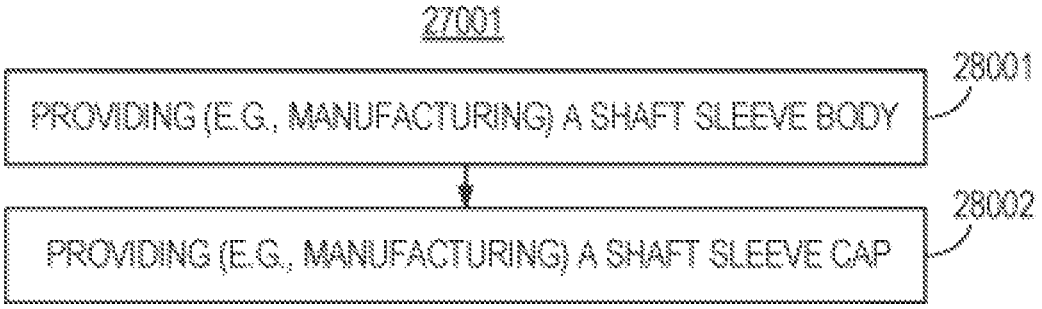
FIG. 28 illustrates an exemplary activity of providing a shaft sleeve, according to the embodiment of FIG. 27.

Method 27000 can comprise activity 27001 of providing a shaft sleeve. The shaft sleeve can be similar or identical to shaft sleeve 211100 (FIG. 21). FIG. 28 illustrates an exemplary activity 27001, according to the embodiment of FIG. 27.

For example, in FIG. 28, activity 27001 can comprise activity 28001 of providing (e.g., manufacturing) a shaft sleeve body. The shaft sleeve body can be similar or identical to shaft sleeve body 22103 (FIG. 22).

Further, activity 27002 can comprise activity 28002 of providing (e.g., manufacturing) a shaft sleeve cap. The shaft sleeve cap can be similar or identical to shaft sleeve cap 22104 (FIG. 22).

Referring now back to FIG. 27, method 27000 can comprise activity 27002 of providing (e.g., manufacturing) a golf club head. The golf club head can be similar or identical to golf club head 21101 (FIG. 21). In some embodiments, activity 27001 can be performed before activity 27002, and vice versa. In other embodiments, activity 27001 and 27002 can be performed approximately simultaneously.

Further, method 27000 can comprise activity 27003 of inserting the shaft sleeve into a hosel bore of the golf club head. The hosel bore can be similar or identical to the hosel bore described above with respect to golf club head 21101 (FIG. 21).

Also, method 2700 can comprise activity 27004 of inserting a golf club shaft into a shaft bore. The golf club shaft can be similar or identical to golf club shaft 21102 (FIG. 21), and the shaft bore can be similar or identical to shaft bore 233120 (FIG. 23).

Meanwhile, method 2700 can comprise activity 27005 of inserting the shaft sleeve cap into the shaft bore. In some embodiments, activity 27004 can be performed before activity 27005, or vice versa. In other embodiments, activity 27004 and 27005 can be performed approximately simultaneously. In further embodiments, activity 27003 can be performed before activity 27004 and/or activity 27005, and vice versa. In many embodiments, one or more of activities 27001-27003 can be performed before one or more of activities 27004-27005, or vice versa.

Further still, method 27000 can comprise activity 27006 of securing the shaft sleeve to a hosel of the golf club head with a fastener. The hosel can be similar or identical to the hosel described above with respect to golf club head 21101 (FIG. 21), and the fastener can be similar or identical to the fastener described above with respect to golf club head 21101 (FIG. 21).

Solid Ribbed Cap Coupling Mechanism

Figure 29:
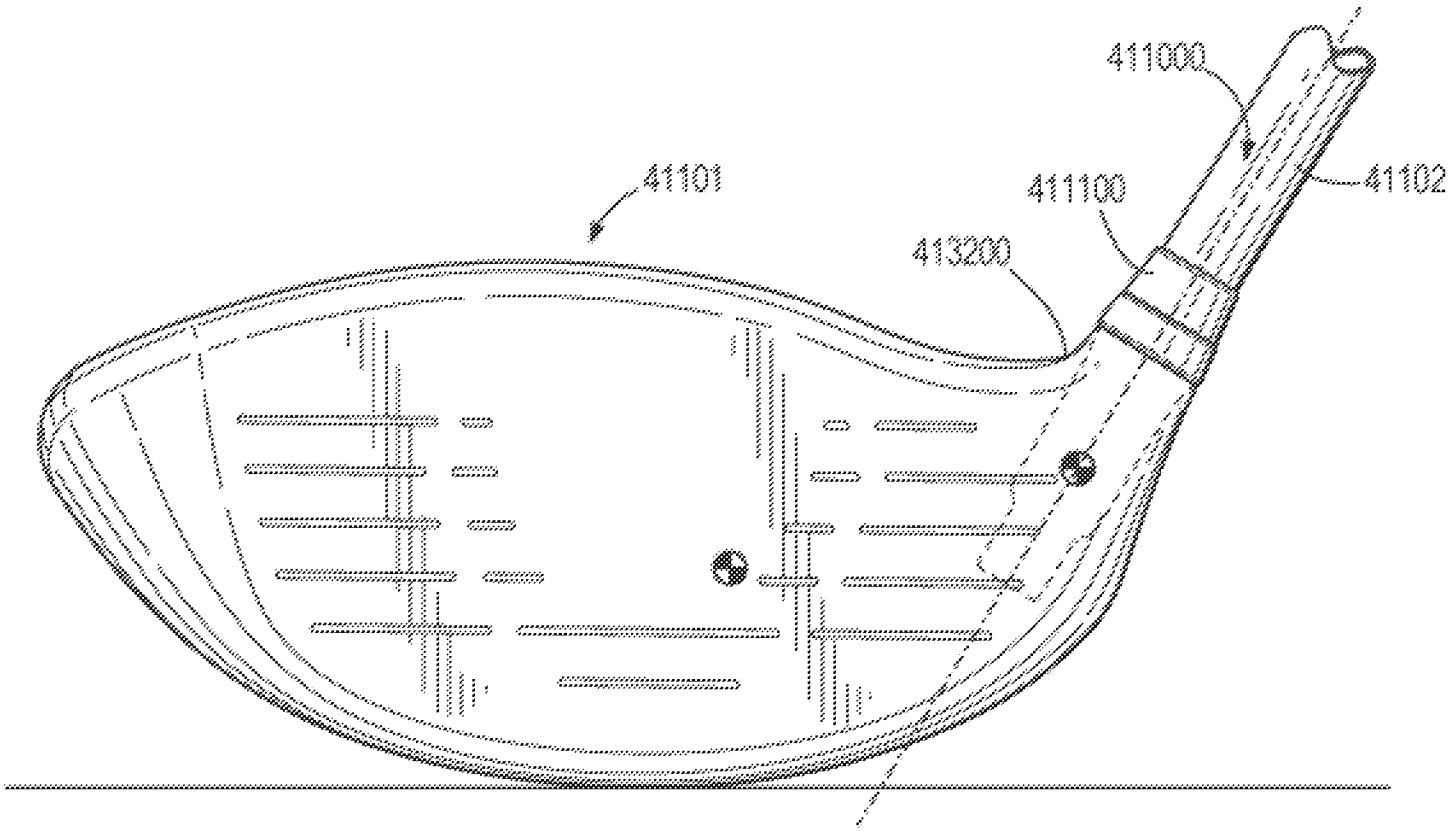
FIG. 29 illustrates a front perspective view of a golf club head with a golf coupling mechanism, according to an embodiment.

Turning ahead in the drawings, FIG. 29 illustrates a front perspective view of golf club head 41101 with golf coupling mechanism 411000, according to an embodiment. In many embodiments, golf coupling mechanism 411000 can comprise shaft sleeve 411100 configured to be coupled to an end of a golf club shaft, such as golf club shaft 41102. In various embodiments, golf club head 41101 can be similar to golf club head 101 (FIG. 1); golf coupling mechanism 411000 can be similar to golf coupling mechanism 1000 (FIG. 1); and/or golf club shaft 41102 can be similar or identical to golf club shaft 102 (FIG. 1). Accordingly, golf coupling mechanism 411000 can comprise shaft sleeve 411100 and shaft receiver 413200. Meanwhile, shaft sleeve 411100 can be similar to shaft sleeve 1100 (FIG. 1), and/or shaft receiver 413200 can be similar to shaft receiver 3200 (FIG. 3).

Figure 30:
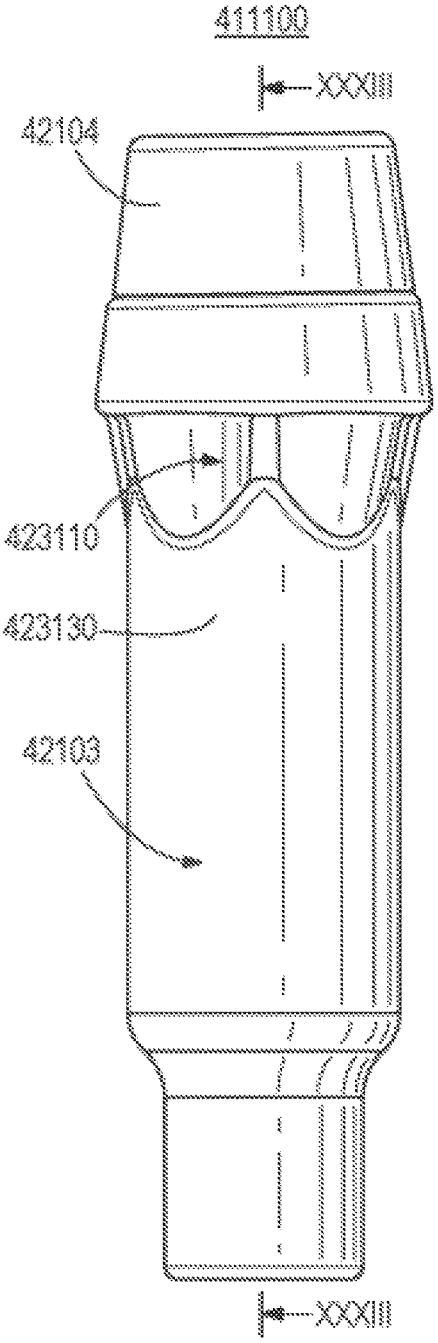
FIG. 30 illustrates a side view of a shaft sleeve of the golf coupling mechanism of the golf club head decoupled from the golf club head, according to the embodiment of FIG. 29.

Turning ahead again in the drawings, FIG. 30 illustrates a side view of shaft sleeve 411100 decoupled from golf club head 21101 (FIG. 29), according to the embodiment of FIG. 29. Meanwhile, FIG. 31 illustrates a cross sectional view of shaft sleeve 411100 along line XXXIII-XXXIII of FIG. 30, according to the embodiment of FIG. 29.

Referring to FIG. 30, shaft sleeve 411100 comprises shaft sleeve body 42103 and shaft sleeve cap 42104. Further, in many embodiments, shaft sleeve body 22103 can comprise sleeve coupler set 423110 with one or more couplers protruding from sleeve body outer wall 423130, and shaft receiver 413200 (FIG. 29) can comprise a receiver coupler set configured to engage sleeve coupler set 423110 of shaft sleeve 411100 to restrict a rotation of shaft sleeve 411100 relative to shaft receiver 413200. In these or other embodiments, sleeve coupler set 413110 can be similar to sleeve coupler set 3110 (FIG. 3); sleeve body outer wall 423130 can be similar to sleeve outer wall 3130 (FIG. 3); and/or the receiver coupler set can be similar to receiver coupler set 3210 (FIG. 3). As explained in greater detail below, in many embodiments, shaft sleeve cap 42104 can comprise a ferrule and can be operable to couple shaft sleeve body 42103 with golf club shaft 41102 (FIG. 29).

Figure 31:
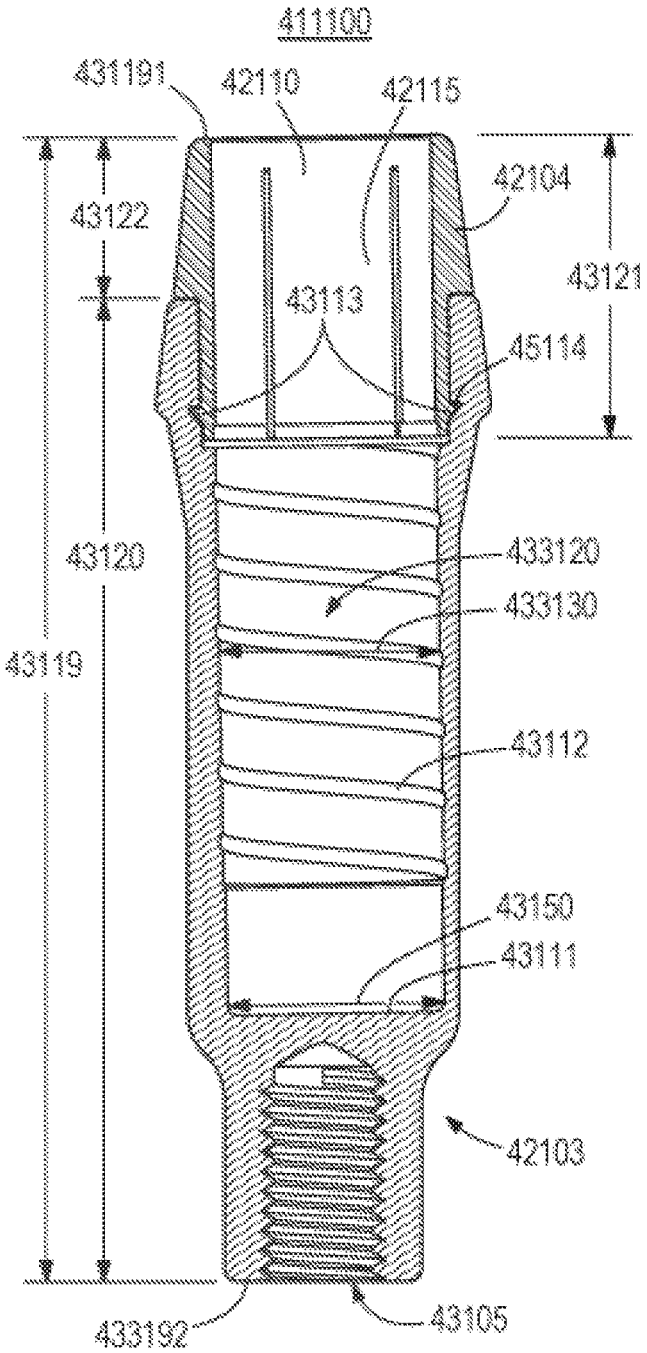
FIG. 31 illustrates a cross sectional view of the shaft sleeve along line XXXIII-XXXIII of FIG. 30, according to the embodiment of FIG. 29.

Meanwhile, turning now to FIG. 31, shaft sleeve 411100 can comprise: (i) shaft bore 433120 configured to receive an end of golf club shaft 41102 (FIG. 29), (ii) securing fastener bore 43105 at sleeve body bottom end 433192, (iii) bore bottom surface 43111; (iv) a cap bore 42110 configured to receive an end of the golf club shaft 41102 and couple to the shaft bore 433120 and/or (v) shaft sleeve top end 431191. Securing fastener bore 43105 can be configured to receive a securing fastener (not shown) in order to secure shaft sleeve 411100 to shaft receiver 413200 (FIG. 29). Further, bore bottom surface 43111 can comprise a bottom surface (e.g., deepest surface) of shaft bore 432120. In many embodiments, shaft bore 433120 can be similar to shaft bore 3120 (FIG. 3); securing fastener bore 43105 can be similar or identical to the bore configured to receive securing fastener 3400 (FIG. 3); sleeve body bottom end 433192 can be similar or identical to sleeve bottom end 3192 (FIG. 3); the securing fastener can be similar or identical to securing fastener 3400 (FIG. 3); and/or shaft sleeve top end 431191 can be similar or identical to sleeve top end 1191 (FIG. 3).

Further, when shaft sleeve body 42103 is coupled to shaft sleeve cap 42104, shaft sleeve 411100 can comprise shaft sleeve height 43119, shaft sleeve body height 43120, shaft sleeve cap height 43121, and shaft sleeve cap top height 23122. Shaft sleeve height 43119 can refer to a distance from sleeve body bottom end 433192 to shaft sleeve top end 431191 measured approximately perpendicular to sleeve body bottom end 433192. Meanwhile, shaft sleeve body height 43120 can refer to a distance from sleeve body bottom end 433192 to a top end of shaft sleeve body 42103 measured parallel to shaft sleeve height 43119, and shaft sleeve cap height 43121 can refer to a distance from a bottom of shaft sleeve cap 42104 to shaft sleeve top end 431191 measured parallel to shaft sleeve height 43119. Further, shaft sleeve cap top height 43122 can refer to a difference between shaft sleeve height 43119 and shaft sleeve body height 43120.

For example, shaft sleeve height 43119 can be greater than or equal to approximately 1.78 inches and less than or equal to approximately 1.82 inches. In specific examples, shaft sleeve height 43119 can be approximately 1.8 inches.

Further, shaft sleeve body height 43120 can be greater than or equal to approximately 1.529 inches and less than or equal to approximately 1.569 inches. In specific examples, shaft sleeve body height 43120 can be approximately 1.549 inches.

Further still, shaft sleeve cap height 43121 can be greater than or equal to approximately 0.46 inches and less than or equal to approximately 0.50 inches. In specific examples, shaft sleeve cap height 43121 can be approximately 0.48 inches.

Meanwhile, for example, shaft sleeve cap top height 43122 can be greater than or equal to approximately 0.23 inches and less than or equal to approximately 0.27 inches. In specific examples, shaft sleeve body height 23122 can be approximately 0.25 inches.

In some embodiments, the securing fastener (not shown) for insertion into securing fastener bore 23105 can comprise titanium over steel. Further, the securing fastener can comprise a securing fastener mass. The securing fastener mass can be greater than or equal to approximately 2.7 grams.

Figure 32:
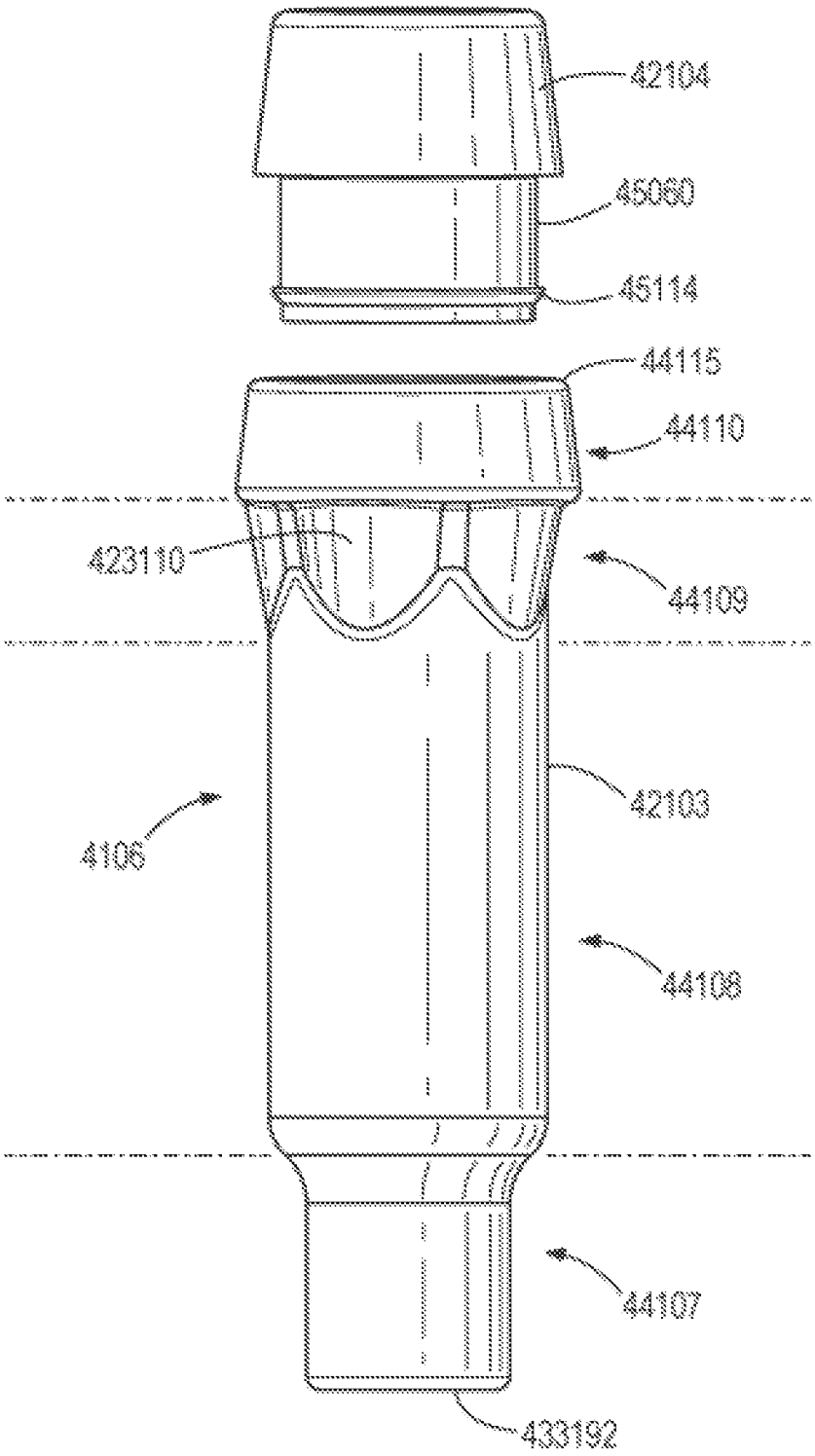
FIG. 32 illustrates a side view of a shaft sleeve body of the shaft sleeve decoupled from a shaft sleeve cap of the shaft sleeve, according to the embodiment of FIG. 29.

Turning to the next drawing, FIG. 32 illustrates a side view of shaft sleeve body 42103 decoupled from shaft sleeve cap 42104 (FIG. 30), according to the embodiment of FIG. 29. Shaft sleeve body 42103 can be associated with one or more regions 44106. For example, regions 44106 can comprise fastener region 44107, intermediate region 44108, coupler region 44109, and cap interface region 44110.

Fastener region 44107 can refer to a portion of shaft sleeve body 42103 located between sleeve body bottom end 433192 and bore bottom surface 43111 (FIG. 31). Meanwhile, coupler region 424109 can refer to a portion of shaft sleeve body located from a lowest point of sleeve coupler set 423110 (e.g., a point of sleeve coupler set 423110 closest to sleeve body bottom end 433192 (FIG. 31)) to a highest point of sleeve coupler set 423110 (e.g., a point of sleeve coupler set 423110 farthest from sleeve body bottom end 433192). Meanwhile, intermediate region 44108 can refer to a portion of shaft sleeve body 42103 between fastener region 44107 and coupler region 44109, and cap interface region 44110 can refer to a portion of shaft sleeve body 42103 opposite coupler region 44109 with respect to intermediate region 44108. Further referring to FIG. 32, the cap interface region 44110 (FIG. 32) can further comprise a top ring 44115 (FIG. 32).

When golf club head 41101 (FIG. 29) is being swung and/or operated to hit a golf ball, fastener region 44107 and coupler region 44109 can experience high stresses. Meanwhile, intermediate region 44108 and/or cap interface region 44110 can experience stresses lower than the high stresses experienced by fastener region 44107 and coupler region 44109.

Securing shaft sleeve 411100 (FIG. 29) to shaft receiver 413200 (FIG. 29) with the securing fastener can help to offset the high stresses at fastener region 44107. Further, because of the high stresses that can be experienced at coupler region 44109, the coupler(s) of sleeve coupler set 423110 can comprise solid lobes configured to provide additional thickness to a sleeve body wall of shaft sleeve body 42103. Accordingly, the coupler(s) can reinforce the sleeve body wall at coupler region 44109 to offset these high stresses at coupler region 44109. The coupler(s) of sleeve coupler set 423110 can slope (e.g., linearly or curvedly) with a greatest thickness at an end of coupler region 44109 farthest from sleeve body bottom end 433192 (e.g., where coupler region 44109 interfaces with cap interface region 44110) and with a least thickness at an end of coupler region 44109 nearest sleeve body bottom end 433192 (FIG. 31) (e.g., where coupler region 44109 interfaces with intermediate region 44108). For example, the greatest thickness can be approximately 0.75 inch thick, and the least thickness can be approximately 0.020 inch thick. In many embodiments, sloping the coupler(s) of sleeve coupler set 423110 (FIG. 30) can provide continuity (e.g., smooth transitioning in thickness) between intermediate region 44108 and cap interface region 44110).

In some embodiment, the coupler(s) of sleeve couple set 423110 can be symmetric in profile. A length of the coupler (s) of sleeve coupler set 423110 can be less than or equal to approximately 0.38 inch (e.g., at part of the sleeve body outer wall 423130 of shaft sleeve body 42103) and can be greater than or equal to approximately 0.26 inch (e.g., at another part of the sleeve body outer wall 423130 of shaft sleeve body 42103).

In some embodiments, the coupler(s) of sleeve coupler set 423110 can be asymmetric in profile such that the coupler(s) are longer at a first part of sleeve body outer wall 423130 of shaft sleeve body 42103 than at another part (e.g., a part directly or 180 degrees opposite the first part). A length of the coupler(s) of sleeve coupler set 423110 can be less than or equal to approximately 0.38 inch (e.g., at part of the sleeve body outer wall 423130 of shaft sleeve body 42103) and can be greater than or equal to approximately 0.260 inch (e.g., at another part of the sleeve body outer wall 423130 of shaft sleeve body 42103). In many embodiments, the coupler(s) of sleeve coupler set 423110 (FIG. 30) can be longest at a part of the sleeve body outer wall 423130 of shaft sleeve body 42103 closest to a sleeve axis of shaft sleeve body 42103 at an end of coupler region 44109 (FIG. 32) farthest from sleeve body bottom end 433192 (e.g., where coupler region 44109 interfaces with cap interface region 44110). The sleeve axis can be similar or identical to sleeve axis 5150 (FIG. 5). Said another way, the coupler(s) of sleeve coupler set 423110 (FIG. 30) can be longest at a part of the sleeve body outer wall 423130 of shaft sleeve body 42103 that intersects a plane including the sleeve axis and extending approximately perpendicular to sleeve body bottom end 433192.

Meanwhile, because intermediate region 44108 experiences lower stresses when golf club head 41101 is being swung and/or operated to hit a golf ball, a sleeve body wall of shaft sleeve body can be thinner at intermediate region 44108 than at part or all of coupler region 44109, and/or intermediate region 44108 can have holes or recesses to reduce the weight of intermediate region 44108. For example, the sleeve body wall of shaft sleeve body 42103 at intermediate region 44108 can comprise a thickness (e.g., an average thickness) of approximately 0.020 inch.

Turning now back to FIG. 31, in some embodiments, shaft sleeve body 42103 can comprise a width (e.g., outer diameter). The outer diameter of the shaft sleeve body 42103 can be greater than or equal to approximately 0.405 inches, and less than or equal to approximately 0.445 inches. In specific examples, the outer diameter of the shaft sleeve body can be 0.425 inches.

In some embodiments, the shaft bore can comprise a width (e.g., diameter) (FIG. 31). The diameter of the shaft sleeve body. The diameter of the shaft bore 433120 can decrease from the middle of the shaft bore to the bore bottom surface 43111. The diameter of bore cap can be similar or the same as the diameter of the middle shaft bore 433130. The diameter of the bore bottom 43150 can be greater than or equal to approximately 0.320 inches, and less than or equal to approximately 0.360 inches. In specific examples, the diameter of the bore bottom can be 0.340 inches. The diameter of the middle shaft bore 433130 can be greater than or equal to approximately 0.326 inches, and less than or equal to 0.366 inches. In specific examples, the diameter of the middle shaft bore 433130 can be 0.346 inches. The diameter of the cap bore 42115 can be greater than or equal to approximately 0.326 inches, and less than or equal to 0.366 inches. In specific examples, the diameter of the cap bore 42115 can be 0.346 inches.

In various embodiments, shaft sleeve body 42103 can comprise etching channels 43112 at shaft bore 433120 to provide a better surface area for epoxy bonding golf club shaft 41102 (FIG. 29) to shaft sleeve body 42103. Etching channels 43112 can be located at coupler region 44109 (FIG. 32) and/or at part or all of intermediate region 44108 (FIG. 32), such as, for example, at a half of intermediate region 44108 (FIG. 32) closer to coupler region 44109 (FIG. 32).

In these or other embodiments, shaft sleeve body 42103 can comprise receiving groove 43113 (e.g., an undercut notch). As explained in greater detail below, receiving groove 43113 (FIG. 31) can communicate and interlock with extrusion portion 45114 (FIG. 33) of a shaft sleeve cap 42104 to secure shaft sleeve cap 42104 to shaft sleeve body 42103. Thus, in many embodiments, receiving groove 43113 (FIG. 34) of the shaft sleeve body 42103 can complement extrusion portion 45114 (FIG. 33). In some embodiments, receiving groove 43113 can be located at cap interface region 44110 (FIG. 32). In many embodiments, receiving groove 43113 (FIG. 35B) can be located at an interface of cap interface region 44110 (FIG. 32) and coupler region 44109 (FIG. 32) (see also FIG. 31).

Figure 33A:
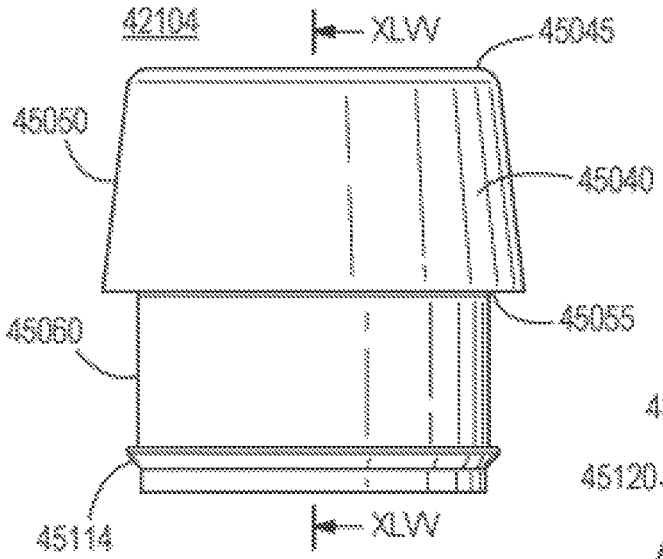
FIG. 33A illustrates a side view of the shaft sleeve cap decoupled from shaft sleeve body, according to the embodiment of FIG. 29.
Figure 33B:
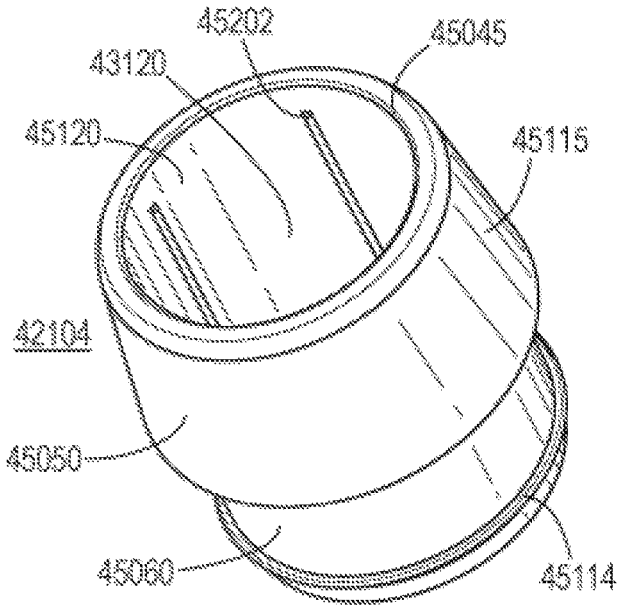
FIG. 33B illustrates a top angled view of the shaft sleeve cap decoupled from shaft sleeve body, according to the embodiment of FIG. 29.
Figure 34:
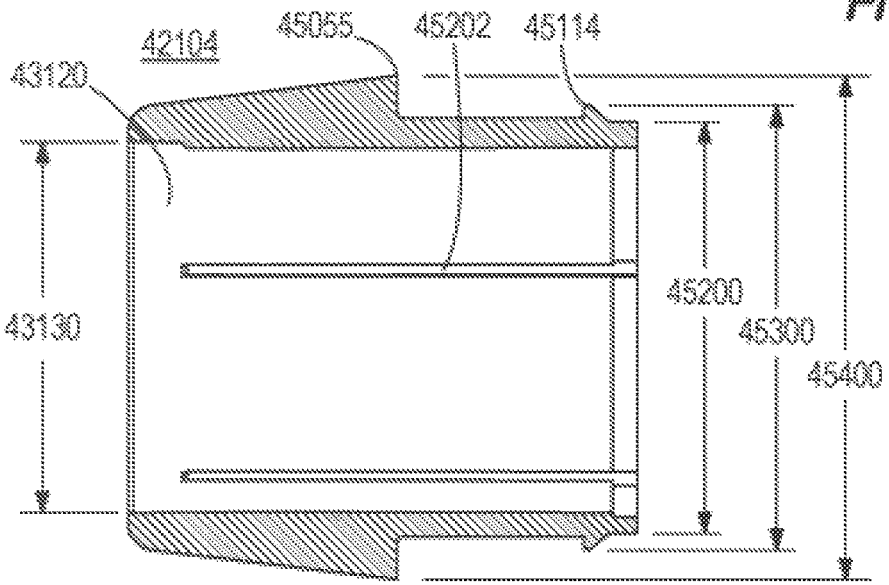
FIG. 34 illustrates a cross sectional view of the shaft sleeve cap along line XLVV-XLVV of FIG. 33B, according to the embodiment of FIG. 29.
Figure 35A:
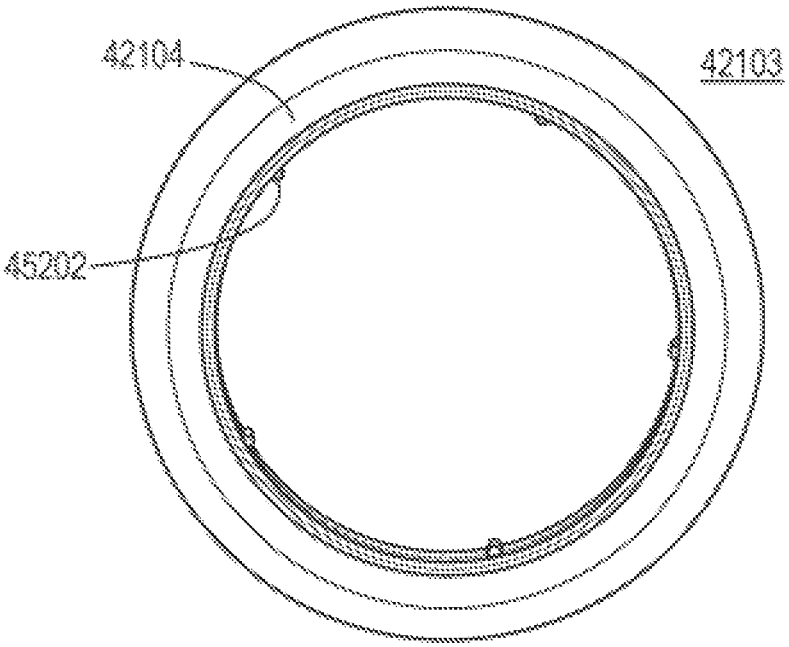
FIG. 35A illustrates a top view of the shaft sleeve cap decoupled from the shaft sleeve body, according to the embodiment of FIG. 29.
Figure 35B:
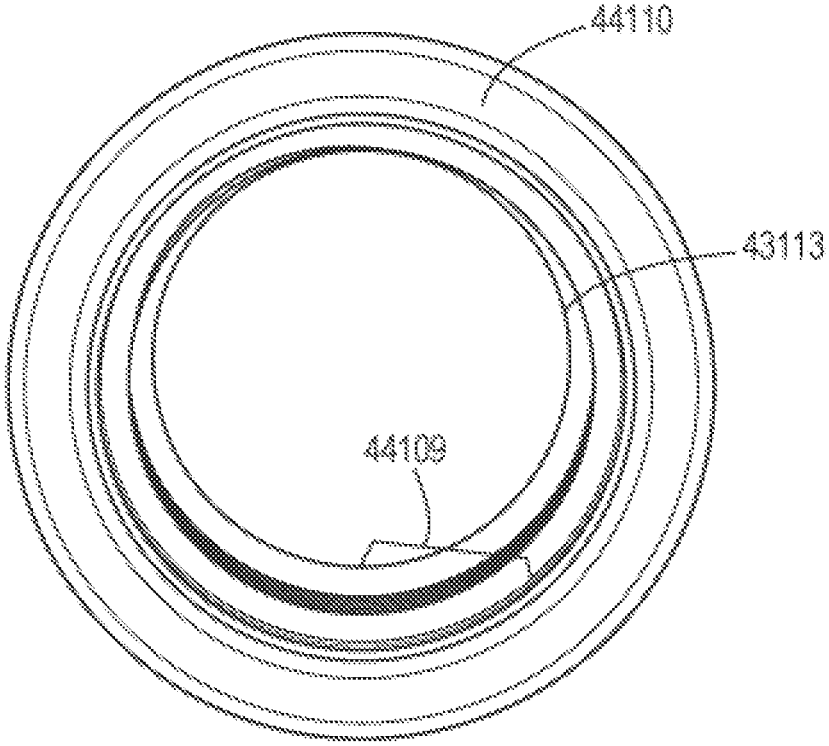
FIG. 35B illustrates a top view of the shaft sleeve body decoupled from the golf head, according to the embodiment of FIG. 29.

Turning ahead now in the drawings, FIG. 33A illustrates an upright side view of shaft sleeve cap 42104 decoupled from shaft sleeve body 42103 (FIG. 30), according to the embodiment of FIG. 29. FIG. 33B illustrates angled top view of shaft sleeve cap 42104 decoupled from shaft sleeve body 42103 (FIG. 30), according to the embodiment of FIG. 29. FIG. 34 illustrates a cross sectional view of shaft sleeve cap 42104 along line XLV-XLV of FIG. 33A, according to the embodiment of FIG. 29. The shaft sleeve cap 42104 can further comprise a cap wall 45040 (FIG. 33A). The cap wall can comprise an outer cap wall 45115 on one end of the cap wall and an inner cap wall 45120 opposite the outer cap wall.

Referring to FIG. 33A, shaft sleeve cap 42104 can comprise an upper cap region 45050 and a lower cap region 45060. The upper cap region 45050 can comprise a top ring 45045 at the top of the upper cap region 45050, and a lower edge shelf 45055 at the lower end of the upper cap region 45050. The upper cap region 45050 increases in diameter from top to bottom to the lower edge shelf 45055. The lower cap region 45060 has a smaller outer diameter than the upper cap region 45050.

The lower cap region 45060 can comprise an extrusion portion 45114 protruding from the outer cap wall 45115. Extrusion portion 45114 can comprise a lip extending out from the outer cap wall 45115 (FIG. 34). Accordingly, extrusion portion 45114 can comprise a width (e.g. diameter) 45300 greater than a width 45200 of the remainder of cap wall of the lower cap region 45060 and/or the diameter of the shaft bore 43120 (FIG. 33A and FIG. 34). The width 45400 of the lower end shelf 45055 of the upper cap region

45050 is greater than the width 45300 of the extrusion portion 45114 of the lower cap region 45060 (FIG. 34).

The lower cap region 45060 of the shaft sleeve cap 41204 fits within the cap interface region 44110 and coupler region 44109 of the shaft sleeve body 42103 (FIG. 32). In one embodiment, the extrusion portion 45114 of the lower cap region 45060 of the shaft sleeve cap 41204 can be situated in and out of the receiving groove 43113 (FIG. 34) to couple and decouple shaft sleeve cap 41204 to and from shaft sleeve body 42103. The receiving groove 43113 (FIG. 34) can complement the extrusion portion 45114 (FIG. 33) of the lower cap region 45060. In these embodiments, the extrusion portion 45115 can be operable as a locking feature or snaps into position between the receiving groove 43113 (FIG. 34) of the shaft sleeve body 42103 (FIG. 32). In some embodiments, the extrusion portion 45115 can extend out at an upward angle to allow bending as the shaft sleeve cap 41204 is fitted into the shaft sleeve body 42103 (FIG. 32). Further referring to FIG. 32, when fitting the shaft sleeve cap 41204 into the shaft sleeve body 42103, the lower end shelf 45055 of the shaft sleeve cap 42104 fits on top of the top ring of the cap interface region 44115 of the shaft sleeve body 42103 (FIG. 32).

The shaft sleeve cap 42104 can comprise a shaft bore 43120 (FIG. 33B). The shaft bore diameter 43130 is consistent throughout both the upper cap region 45050 and lower cap region 45060 (FIG. 34). The combination of the shaft sleeve cap 42104 (upper and lower region), and the cap interface region 44110 and coupler region 44109 of the shaft sleeve body 42103 prevents epoxy seepage during the assembly process.

The shaft sleeve cap 42104 can comprise one or more ribs 45202 protruding or extending into the shaft bore 43120 of the shaft sleeve cap 42104 parallel to each other along the inner cap wall 45120 from the upper cap region 45050 to the lower cap region 45060 (FIG. 33B). The ribs 45202 can provide additional sealing and securely couple the shaft sleeve cap 41204 into the shaft sleeve body 42103. The ribs 45202 can further provide securely centering the shaft of the golf club 41102 within the shaft sleeve 411100.

The shaft sleeve cap 42104 provides stability compared to a shaft sleeve body 42103 without a shaft sleeve cap 42104. The combination of the (1) overall design of the shaft sleeve cap 42104, (2) ribs 45202 on the inner cap wall 45120 of the shaft sleeve cap 42104, (3) the extrusion portion 45115 on the outer cap wall 45115 of the same, (4) the receiving groove 43113 of the shaft sleeve body 42103, and (5) decreasing bore diameter from the middle of the shaft bore to the bore bottom surface 43111 of the shaft sleeve body 42103 can individually or in any combination thereof center the shaft of the golf club 41102 within both the top and bottom of the shaft sleeve 411100, and provide greater stability to the shaft 41102 of FIG. 29. Centering increases the concentricity of the golf club shaft and reduces stresses upon the shaft during swinging of the golf club head and upon impact with a golf ball.

These factors, alone or in combination thereof, also provide damping (e.g., vibration) and stress reduction between golf club shaft 41102 (FIG. 29) and shaft sleeve body 42103 (FIG. 29). For example, shaft sleeve cap 42104 can act as a "shaft pillow" by increasing a concentricity of golf club shaft 41102 (FIG. 30) within shaft sleeve body 42103 (FIG. 31). In many embodiments, the concentricity of golf club shaft 41102 (FIG. 29) within shaft sleeve body 42103 (FIG. 30) can be strongly correlated with a durability of golf club shaft 41102 (FIG. 31). Accordingly, the ribs 45202 on the inner cap wall 45120 of the shaft sleeve cap 42104, (2) the extrusion portion 45115 on the outer cap wall 45115 of the same, (3) the receiving groove 43113 of the shaft sleeve body 42103, and (4) decreasing bore diameter from the middle of the shaft bore to the bore bottom surface 43111 of the shaft sleeve body 42103 can individually or in any combination thereof shaft sleeve cap 42104 can prevent breakage of golf club shaft 41102 (FIG. 29) and increase an overall life of golf club head 41101 (FIG. 29).

Turning back to FIG. 30, shaft sleeve body 42103 can comprise any suitable material. For example, in some embodiments, shaft sleeve body 22103 can comprise a metal or metal alloy (e.g., an aluminum alloy). In these examples, the aluminum alloy can comprise greater than or equal to approximately 70% aluminum and less than or equal to approximately 75% aluminum. In more specific examples, the aluminum alloy can comprise approximately 70%, 71%, 72%, 73%, 74%, or 75% aluminum.

The shaft sleeve cap 42104 can comprise any suitable material configured to permit cap wall 25115 (FIG. 25) to elastically compress as described above. For example, a shaft sleeve cap 22104 can comprise a polymer plastic material wherein the polymer plastic material can be a thermoplastic material, or a soft polymer plastic according to the Shore D durometer scale. The The soft polymer plastic can be no greater than a 40, 45, 50, 55 or 60 on the Shore D durometer scale. The soft polymer plastic can be no greater than 55 on the Shore D durometer scale. The polymer plastic material can be comprised of polystyrene, polyvinyl chloride, nylon, polymethacrylate, rubber, polycarbonate, synthetic rubber or co-polymers thereof.

In many embodiments, shaft sleeve body 42103 can comprise a shaft sleeve body mass, and shaft sleeve cap 42104 can comprise a shaft sleeve cap mass. Further, shaft sleeve 411100 can comprise a shaft sleeve mass comprising the shaft sleeve body mass and the shaft sleeve cap mass. The shaft sleeve mass can be similar to the mass of the sleeve described above with respect to sleeve 1100 (FIG. 1).

In these or other embodiments, the shaft sleeve mass can be greater than or equal to approximately 4.0 grams, 4.1 grams, 4.2 grams, 4.3 grams, 4.4 grams, 4.5 grams, 4.6 grams, 4.7 grams, 4.8 grams, 4.9 grams or 5.0 grams. Further, the shaft sleeve body mass can be greater than or equal to approximately 4.2 grams and less than or equal to approximately 4.8 grams. The shaft sleeve body mass can be 4.5 grams. Further still, the shaft sleeve cap mass can be greater than or equal to approximately 3.8 grams, 3.9 grams, 4.0 grams, 4.1 grams, 4.2 grams, 4.3 grams or 4.4 grams. The shaft sleeve cap mass can be greater than or equal to approximately 0.1 grams and less than or equal to approximately 0.7 grams. In various embodiments, the shaft sleeve mass can be approximately 0.4 grams less than the mass of sleeve 1100 (FIG. 1). Further, the shaft sleeve mass combined with the securing fastener mass can be greater than or equal to approximately 7.2 grams. According, in various embodiments, shaft sleeve 411100 can offer weight advantages over shaft sleeve 1100 (FIG. 1).

Turning to FIG. 29, golf club head 41101 can comprise a disassembled club head mass and an assembled club head mass. The disassembled club head mass can be similar to the disassembled club head mass described above with respect to golf club head 101 (FIG. 1), and the assembled club head mass can be similar to the assembled club head mass described above with respect to golf club head 101 (FIG. 1).

In some embodiments, the disassembled club head mass can be greater than or equal to approximately 185 grams and less than or equal to approximately 205 grams. In these or other embodiments, the disassembled club head mass can be greater than or equal to approximately 192 grams.

In some embodiments, the assembled club head mass can be greater than or equal to approximately 188 grams and less than or equal to approximately 213 grams. In these or other embodiments, the assembled club head mass can be greater than or equal to approximately 199 grams.

Further, a ratio of the shaft sleeve mass to the disassembled club head mass can be less than or equal to approximately 2.0%, 2.2%, or 2.4%; a ratio of the shaft sleeve mass to the assembled club head mass can be less than or equal to approximately 1.95%, 2.16%, or 2.35%; a ratio of the shaft sleeve mass and the securing fastener mass to the disassembled club head mass can be less than or equal to approximately 3.4%, 3.6%, or 3.8%; and/or a ratio of the shaft sleeve mass and the securing fastener mass to the assembled club head mass can be less than or equal to approximately 3.3%, 3.5%, or 3.7%.

Meanwhile, golf club head 41101 can comprise an assembled club head CG associated with assembled club head CG vertical distance, and shaft sleeve 411100 can comprise a shaft sleeve CG associated with a shaft sleeve CG vertical distance. In these embodiments, assembled club head CG can be similar or identical to assembled club head CG 1050 (FIG. 1); the assembled club head CG vertical distance can be similar or identical to assembled club head CG vertical distance 1058 (FIG. 1); the shaft sleeve CG can be similar or identical to shaft sleeve CG 1032 (FIG. 1); and/or the shaft sleeve CG vertical distance can be similar or identical to shaft sleeve CG vertical distance 1159 measured either from the bottom of the club head (FIG. 1).

In many embodiments, the shaft sleeve CG vertical distance of the shaft sleeve 411100 (FIG. 31) can be greater than or equal to approximately 0.052 inches (approximately 1.32 millimeters), and less than or equal to 0.092 inches (approximately 2.34 millimeters) than shaft sleeve CG vertical distance of the shaft sleeve 211100 (FIG. 23). The shaft sleeve CG vertical distance of the shaft sleeve 411100 (FIG. 31) can be greater than or equal to approximately 0.042 inches (approximately 1.07 millimeters), and less than or equal to 0.062 inches (approximately 1.58 millimeters) than shaft sleeve CG vertical distance 1159 (FIG. 1). The shaft sleeve CG vertical distance of the golf coupling mechanism 411000 can be greater than or equal to approximately 43.5 millimeters from a sole bottom end of golf club head 41101 and less than or equal to approximately 47.0 millimeters from the sole bottom end of golf club head 41101. In some embodiments, the shaft sleeve CG vertical distance of the golf coupling mechanism 411000 can be greater than or equal to approximately 43.5 millimeters, 43.6 millimeters, 43.7 millimeters, 43.8 millimeters, 43.9 millimeters, 44.0 millimeters, 44.1 millimeters, 44.2 millimeters, 44.3 millimeters, 44.4 millimeters, 44.5 millimeters, 44.6 millimeters, 44.7 millimeters, 44.8 millimeters, 44.9 millimeters, 45.0 millimeters, 45.1 millimeters, 45.2 millimeters, 45.3 millimeters, 45.4 millimeters, 45.5 millimeters, 45.6 millimeters, 45.7 millimeters, 45.8 millimeters, 45.9 millimeters, 46.0 millimeters, 46.1 millimeters, 46.2 millimeters, 46.3 millimeters, 46.4 millimeters, 46.5 millimeters, 46.6 millimeters, 46.7 millimeters, 46.8 millimeters, 46.9 millimeters, or 47.0 millimeters from the sole bottom end of golf club head 41101. In some embodiments, the shaft sleeve CG vertical distance of the golf coupling mechanism 411000 can be less than or equal to approximately 43.5 millimeters, 43.6 millimeters, 43.7 millimeters, 43.8 millimeters, 43.9 millimeters, 44.0 millimeters, 44.1 millimeters, 44.2 millimeters, 44.3 millimeters, 44.4 millimeters, 44.5 millimeters, 44.6 millimeters, 44.7 millimeters, 44.8 millimeters, 44.9 millimeters, 45.0 millimeters, 45.1 millimeters, 45.2 millimeters, 45.3 millimeters, 45.4 millimeters, 45.5 millimeters, 45.6 millimeters, 45.7 millimeters, 45.8 millimeters, 45.9 millimeters, 46.0 millimeters, 46.1 millimeters, 46.2 millimeters, 46.3 millimeters, 46.4 millimeters, 46.5 millimeters, 46.6 millimeters, 46.7 millimeters, 46.8 millimeters, 46.9 millimeters, or 47.0 millimeters from the sole bottom end of golf club head 41101. The shaft sleeve CG vertical distance of the golf coupling mechanism 411000 can be 45.3 millimeters from the sole bottom end of golf club head 41101. The sole bottom end can be similar or identical to sole bottom end 10141 (FIG. 1).

In some embodiments, the shaft sleeve CG vertical distance of the golf coupling mechanism 411000 can be greater than or equal to approximately 32.0 millimeters, 32.1 millimeters, 32.3 millimeters, 32.4 millimeters, 32.5 millimeters, 32.6 millimeters, 32.7 millimeters, 32.8 millimeters, 32.9 millimeters, 33.0 millimeters, 33.1 millimeters, 33.2 millimeters, 33.3 millimeters, 33.4 millimeters, 33.5 millimeters, 33.6 millimeters, 33.7 millimeters, 33.8 millimeters, 33.9 millimeters, 34.0 millimeters, 34.1 millimeters, 34.2 millimeters, 34.3 millimeters, 34.4 millimeters, or 34.5 millimeters from the sole bottom end of golf club head 41101. The shaft sleeve CG vertical distance of the golf coupling mechanism 411000 can be less than or equal to approximately 32.0 millimeters, 32.1 millimeters, 32.3 millimeters, 32.4 millimeters, 32.5 millimeters, 32.6 millimeters, 32.7 millimeters, 32.8 millimeters, 32.9 millimeters, 33.0 millimeters, 33.1 millimeters, 33.2 millimeters, 33.3 millimeters, 33.4 millimeters, 33.5 millimeters, 33.6 millimeters, 33.7 millimeters, 33.8 millimeters, 33.9 millimeters, 34.0 millimeters, 34.1 millimeters, 34.2 millimeters, 34.3 millimeters, 34.4 millimeters, or 34.5 millimeters from the sole bottom end of golf club head 41101. The shaft sleeve CG vertical distance of the golf coupling mechanism can be 33.6 millimeters from the sole bottom end of golf club head 41101.

Figure 36:
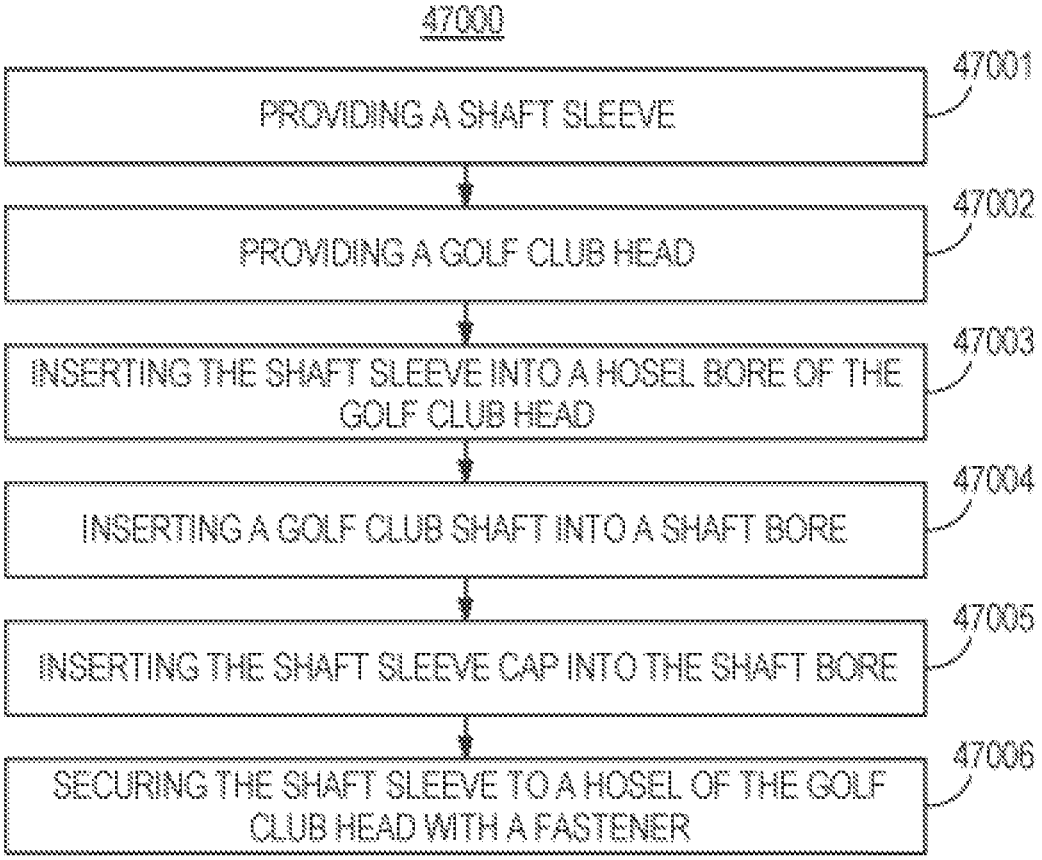
FIG. 36 illustrates a flowchart for a method, according to an embodiment.

Turning ahead in the drawings, FIG. 36 illustrates a flowchart for a method 47000, according to an embodiment. In many embodiments, method 47000 can comprise a method of manufacturing a golf club head of one or more parts of the golf club head. The golf club head can be similar or identical to golf club head 41101 (FIG. 29).

Method 47000 can comprise activity 47001 of providing a shaft sleeve. The shaft sleeve can be similar or identical to shaft sleeve 411100 (FIG. 30). FIG. 36 illustrates an exemplary activity 47001, according to the embodiment of FIG. 36.

Figure 37:
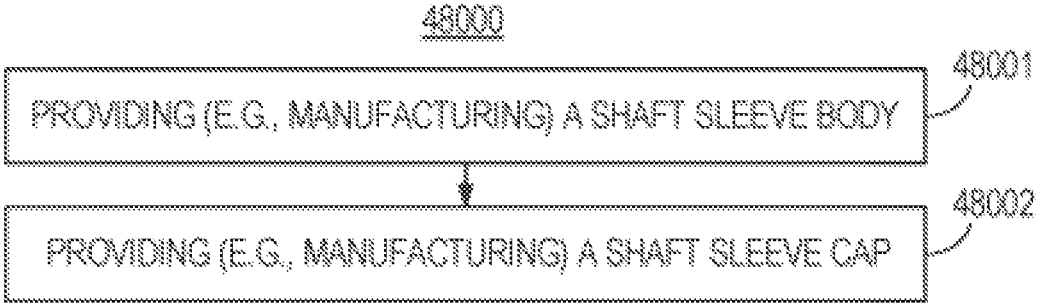
FIG. 37 illustrates an exemplary activity of providing a shaft sleeve, according to the embodiment of FIG. 35.

For example, in FIG. 36, activity 47001 can comprise activity 48001 of providing (e.g., manufacturing) a shaft sleeve body. The shaft sleeve body can be similar or identical to shaft sleeve body 42103 (FIG. 37).

Further, activity 47002 can comprise activity 48002 of providing (e.g., manufacturing) a shaft sleeve cap. The shaft sleeve cap can be similar or identical to shaft sleeve cap 42104 (FIG. 28).

Referring now back to FIG. 36, method 47000 can comprise activity 47002 of providing (e.g., manufacturing) a golf club head. The golf club head can be similar or identical to golf club head 41101 (FIG. 29). In some embodiments, activity 47001 can be performed before activity 47002, and vice versa. In other embodiments, activity 47001 and 47002 can be performed approximately simultaneously.

Further, method 47000 can comprise activity 47003 of inserting the shaft sleeve into a hosel bore of the golf club head. The hosel bore can be similar or identical to the hosel bore described above with respect to golf club head 41101 (FIG. 29).

Also, method 4700 can comprise activity 47004 of inserting a golf club shaft into a shaft bore. The golf club shaft can be similar or identical to golf club shaft 41102 (FIG. 29), and the shaft bore can be similar or identical to shaft bore 433120 (FIG. 31).

Meanwhile, method 47000 can comprise activity 47005 of inserting the shaft sleeve cap into the shaft bore. In some embodiments, activity 47004 can be performed before activity 47005, or vice versa. In other embodiments, activity 47004 and 47005 can be performed approximately simultaneously. In further embodiments, activity 47003 can be performed before activity 47004 and/or activity 47005, and vice versa. In many embodiments, one or more of activities 47001-47003 can be performed before one or more of activities 47004-47005, or vice versa (FIG. 37).

Further still, method 47000 can comprise activity 47006 of securing the shaft sleeve to a hosel of the golf club head with a fastener. The hosel can be similar or identical to the hosel described above with respect to golf club head 41101 (FIG. 31), and the fastener can be similar or identical to the fastener described above with respect to golf club head 21101 (FIG. 31).

Although the golf coupling mechanisms and related methods herein have been described with reference to specific embodiments, various changes may be made without departing from the spirit or scope of the present disclosure. As an example, there may be embodiments where sleeve coupler set 3110 (FIGS. 3-7, 10, 14-17), sleeve coupler set 12110 (FIG. 12), sleeve coupler set 223110 (FIG. 22), and/or sleeve coupler set 411100 can comprise only two sleeve couplers, and where receiver coupler set 3210 (FIGS. 3-4, 8-9, 11, 14-17), receiver coupler set 13210 (FIG. 13), the receiver coupler set of shaft receiver 213200 (FIG. 21) and/or the receiver coupler set of shaft receiver 413200 (FIG. 29) can comprise only two receiver couplers. In such embodiments, only two configurations may be possible between the shaft sleeve and the shaft receiver, and the golf coupler set may permit adjustment between two lie angles or two loft angles. Of course, there can also be embodiments with sleeve coupler sets having three, five, six, seven, eight, or more sleeve couplers, and receiver coupler sets having three, five, six, seven eight, or more receiver couplers, with corresponding increases in the number of possible lie and loft angle combinations.

Figure 38:
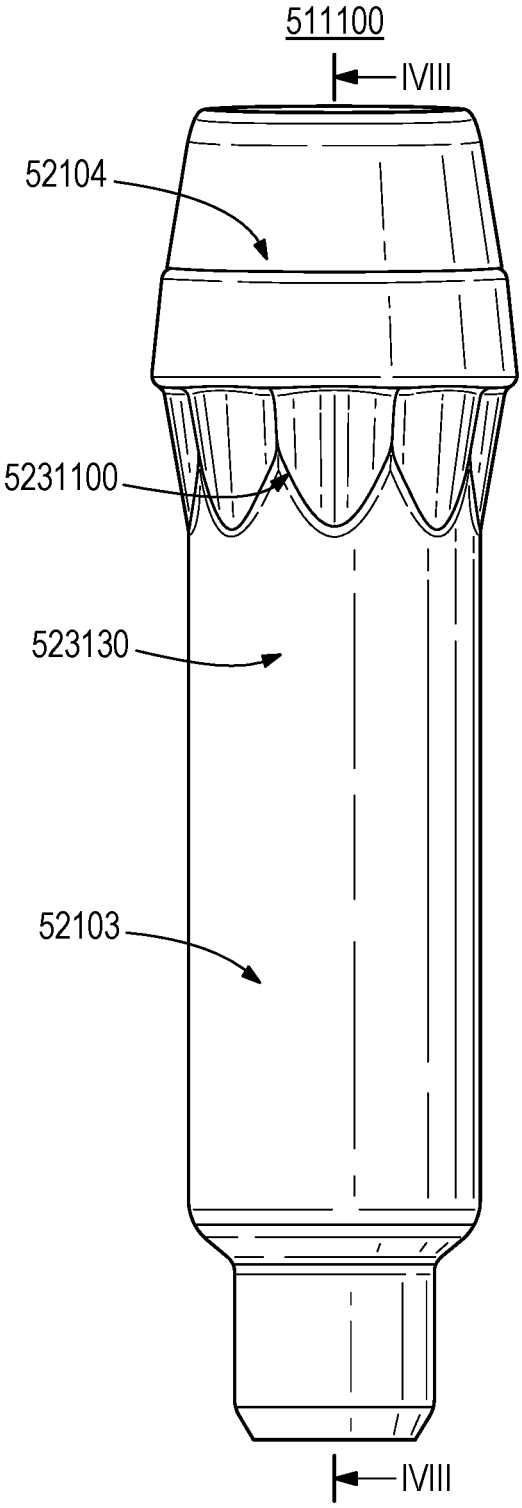
FIG. 38 illustrates a side view of a shaft sleeve of a golf coupling mechanism decoupled from a golf club head, according to an embodiment.
Figure 39:
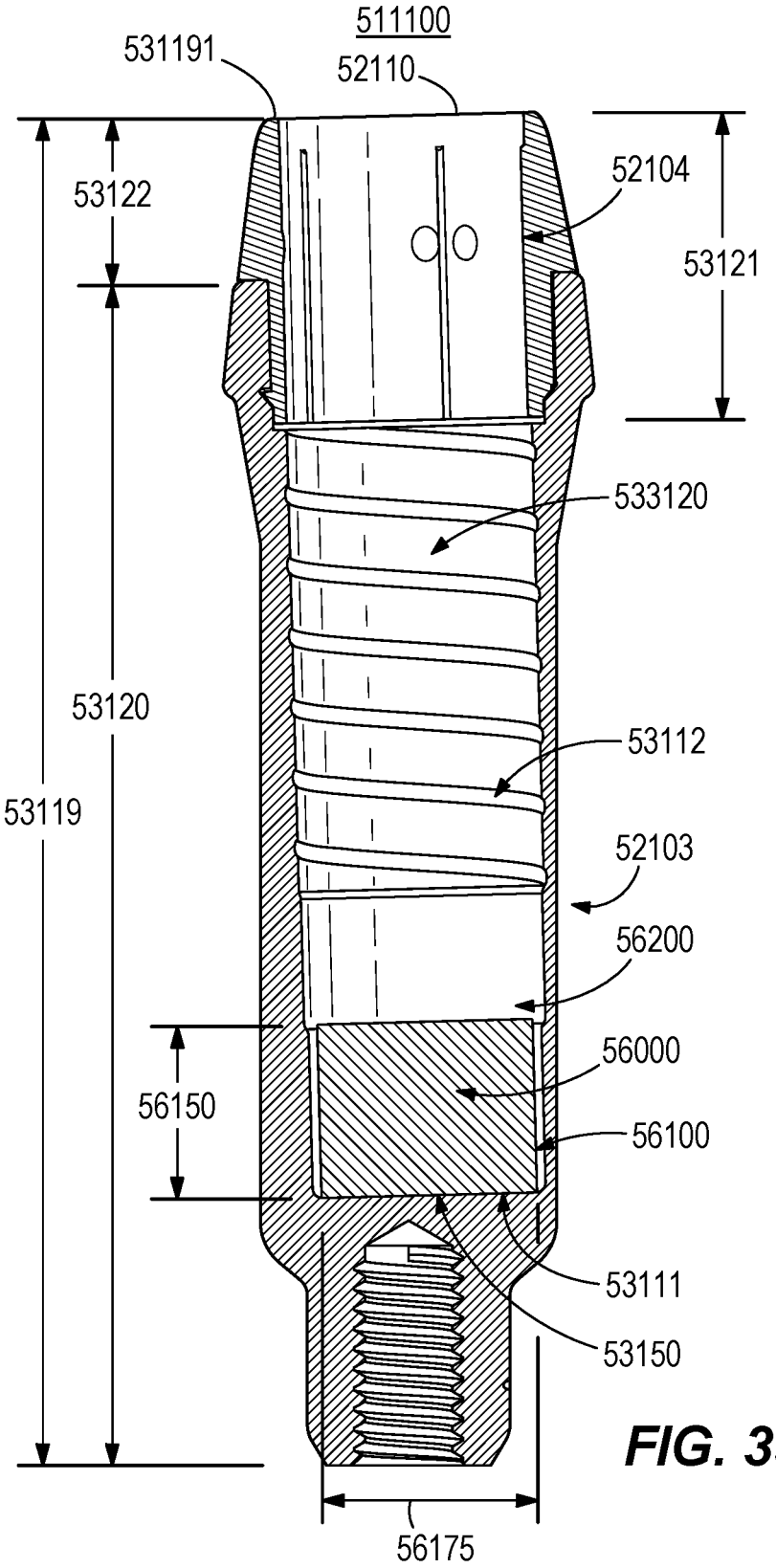
FIG. 39 illustrates a cross sectional view of the shaft sleeve alone IVIII-IVIII of FIG. 38, according to the embodiment of FIG. 38.

Turning ahead in the drawings, FIG. 38 illustrates a side view of another embodiment of a shaft sleeve 511100 decoupled from golf club head 51101 (not shown). Golf club head 51101 (not shown) is substantially similar to golf club head 41101, shown in FIG. 29. FIG. 39 illustrates a cross sectional view of shaft sleeve 511100 along line IVIII-IVIII of FIG. 38, according to the embodiment of FIG. 38 comprising tip weight 56000. In many embodiments, golf coupling mechanism 511000 can comprise shaft sleeve 511100 configured to be coupled to an end of a golf club shaft (not shown), such as golf club shaft 41102. In various embodiments, golf club head 51101 can be similar to golf club head 101 (FIG. 1); golf coupling mechanism 511000 can be similar to golf coupling mechanism 1000 (FIG. 1); and/or golf club shaft can be similar or identical to golf club shaft 102 (FIG. 1). Accordingly, golf coupling mechanism 511000 can comprise shaft sleeve 511100 and shaft receiver 513200. Meanwhile, shaft sleeve 511100 can be similar to shaft sleeve 1100 (FIG. 1) and configured to receive a tip weight 56000, and shaft receiver 513200 can be similar to shaft receiver 3200 (FIG. 3) or shaft receiver 213200 (FIG. 22A).

Referring to FIG. 38, shaft sleeve 511100 comprises shaft sleeve body 52103 and shaft sleeve cap 52104. In many embodiments, shaft sleeve body 52103 can comprise a sleeve coupler set 5231100 with one or more couplers protruding from a sleeve body outer wall 523130. Likewise, shaft receiver 513200 can comprise a receiver coupler set configured to engage sleeve coupler set 523110 of shaft sleeve 511100, such that rotation of shaft sleeve 511100 relative to shaft receiver 513200. In these or other embodiments, sleeve coupler set 513110 can be similar to sleeve coupler set 3110 (FIG. 3); sleeve body outer wall 523130 can be similar to sleeve outer wall 3130 (FIG. 3); and/or the receiver coupler set can be similar to receiver coupler set 3210 (FIG. 3). In these examples, the one or more couplers of sleeve coupler set 523110 can have substantially similar lengths. The length can be measured from a top end of the one or more couplers to a bottom end of the one or more couplers. In other examples, the one or more couplers of sleeve coupler set 523110 can have coupler lengths that vary. The shaft sleeve cap 52104 can comprise a ferrule and can be operable to couple shaft sleeve body 52103 with golf club shaft (not shown).

Moving to the cross-sectional view of FIG. 39, shaft sleeve 511100 can comprise: (i) shaft bore 533120 configured to receive an end of golf club shaft (not shown), (ii) securing fastener bore 53105 at sleeve body bottom end 533192, (iii) bore bottom surface 53111; (iv) a tip weight 56000; (v) a cap bore 52110 configured to receive an end of the golf club shaft and couple to the shaft bore 533120 and/or (vi) shaft sleeve top end 531191. Securing fastener bore 53105 can be configured to receive a securing fastener (not shown) in order to secure shaft sleeve 511100 to shaft receiver 513200 (FIG. 29). Further, bore bottom surface 53111 can comprise a bottom surface (e.g., deepest surface) of shaft bore 532120 configured to abut a bottom surface 56100 of the tip weight 56000. In many embodiments, shaft bore 533120 can be similar to shaft bore 3120 (FIG. 3); securing fastener bore 53105 can be similar or identical to the bore configured to receive securing fastener 3400 (FIG. 3); sleeve body bottom end 533192 can be similar or identical to sleeve bottom end 3192 (FIG. 3); the securing fastener can be similar or identical to securing fastener 3400 (FIG. 3); and/or shaft sleeve top end 531191 can be similar or identical to sleeve top end 1191 (FIG. 3).

Figure 40:
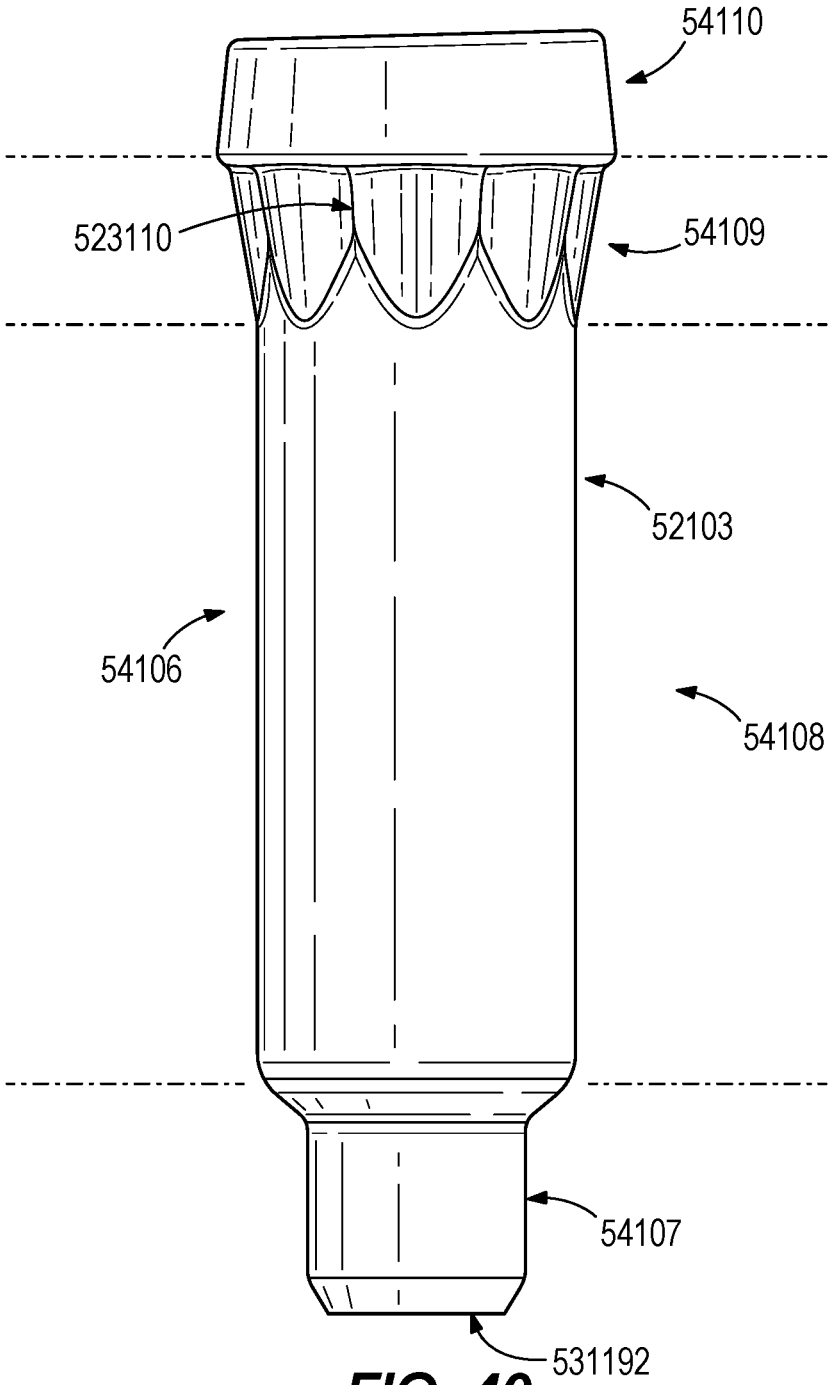
FIG. 40 illustrates a side view of a shaft sleeve body of the shaft sleeve decoupled from the shaft sleeve cap of the shaft sleeve, according to the embodiment of FIG. 38.

FIG. 40 illustrates a side view of shaft sleeve 511100 with sleeve cap 52104 decoupled from shaft sleeve body 52103, according to the embodiment of FIG. 38. Shaft sleeve body 52103 can be associated with one or more regions 54106. For example, regions 54106 can comprise fastener region 54107, intermediate region 54108, coupler region 54109, and cap interface region 54110.

Further, when shaft sleeve cap 52104 is coupled to shaft sleeve body 52103, shaft sleeve 511100 can comprise shaft sleeve height 53119, shaft sleeve body height 53120, shaft sleeve cap height 53121, and shaft sleeve cap top height 53122. Shaft sleeve height 53119 can refer to a distance from sleeve body bottom end 533192 to shaft sleeve top end 531191 measured approximately perpendicular to sleeve body bottom end 533192. Meanwhile, shaft sleeve body height 53120 can refer to a distance from sleeve body bottom end 533192 to a top end of shaft sleeve body 52103 measured parallel to shaft sleeve height 53119, and shaft sleeve cap height 53121 can refer to a distance from a bottom of shaft sleeve cap 52104 to shaft sleeve top end 531191 measured parallel to shaft sleeve height 53119.

Further, shaft sleeve cap top height 53122 can refer to a difference between shaft sleeve height 53119 and shaft sleeve body height 53120.

Shaft sleeve height 53119 can be greater than previous embodiments in order to accommodate tip weight 56000. For example, shaft sleeve height can be greater than or equal to 2.00 inches and less than or equal to 2.20 inches. In some examples, shaft sleeve height 59119 is 2.00 inches, 2.01 inches, 2.02 inch, 2.03 inches, 2.04 inches, 2.05 inches, 2.06 inches, 2.07 inches, 2.08 inches, 2.09 inches, 2.10 inches, 2.11 inches, 2.12 inches, 2.13 inches, 2.14 inches, 2.15 inches, 2.16 inches, 2.17 inches, 2.18 inches, 2.19 inches, or 2.20 inches. In a specific example, the shaft sleeve height 53119 is 2.10 inch.

Likewise, shaft sleeve body height 53120 can be extended, as compared to previous embodiments, to accommodate tip weight 56000. Specifically, the shaft sleeve 52103 can be extended from the top end 531191, rather than the bottom end 531192, such that the shaft bore 533120 is extended in a vertical direction. In some examples, shaft sleeve body height 53120 can be greater than or equal to approximately 1.78 inches and less than or equal to approximately 1.90 inches. For example, the shaft sleeve height 53119 can be 1.78 inches, 1.79 inches, 1.80 inches, 1.81 inches, 1.82 inches, 1.83 inches, 1.84 inches, 1.85 inches, 1.86 inches, 1.87 inches, 1.88 inches, 1.89 inches, or 1.90 inches. In specific examples, the shaft sleeve body height can be between 1.85 inches and 1.86 inches. Extending the shaft bore 533120 by way of the shaft sleeve body height 53120 ensures sufficient contact area between shaft bore 533120 and the golf club shaft for a secure fit between components. The increase in shaft sleeve body height 53120, therefore, can be directly associated with the dimensions of the tip weight 56000, such that the height increase is greater than or equal to a height of the tip weight 56600.

Further, shaft sleeve cap height 53121 can be greater than or equal to approximately 0.46 inches and less than or equal to approximately 0.50 inches. In specific examples, shaft sleeve cap height 53121 can be approximately 0.48 inches.

Further still, shaft sleeve cap top height 53122 can be greater than or equal to approximately 0.23 inches and less than or equal to approximately 0.27 inches. In specific examples, shaft sleeve cap top height 53122 can be approximately 0.25 inches.

As mentioned above, weight receiving region 53124 is configured to retain a tip weight 56000. The addition of tip weight 56000 within shaft bore 533120 allows a golf club head swing weight to be modified according to golfer specifications, independent of CG position. In other words, tip weight 56000 allows swing weight to be increased without moving the CG from the desired position. Tip weight 56000 can be secured within shaft bore 533120 via an epoxy or adhesive. Positioning the tip weight 56000 within the shaft sleeve 511100 can increase mass very far into the heel and toward the sole 10141. This allows for improved CG modulation and the potential to maintain CG position or move the CG downward and toward the heel as desired.

Tip weight 56000 comprises a mass added to shaft sleeve 511100. In some embodiments, tip weight 56000 comprises a mass ranging from 3 grams to 7 grams. For example, the tip weight 56000 can comprise a mass of 3 grams, 4 grams, 5 grams, 6 grams, or 7 grams. In a specific example, the tip weight 56000 comprises a mass of 5 grams.

Turning back to FIG. 38, shaft sleeve body 52103 comprises a width, or outer diameter. The outer diameter of shaft sleeve body can be greater than or equal to approximately 0.405 inch and less than or equal to 0.475 inch. For example, the outer diameter can be 0.405 inch, 0.410 inch, 0.415 inch, 0.420 inch, 0.425 inch, 0.430 inch, 0.435 inch, 0.440 inch, 0.445 inch, 0.450 inch, 0.455 inch, 0.460 inch, 0.465, 0.470 inch, or 0.475 inch. In specific examples, the shaft sleeve outer diameter can be 0.460 inch.

According to FIG. 39, shaft bore 533120 also comprises a width, or diameter. The diameter of shaft bore 533120 can decrease from the middle of the shaft bore to the bore bottom surface 53111. The diameter of cap bore 52110 to the middle of shaft bore 533120 can be greater than approximately 0.400 inch and less than approximately 0.450 inch. In specific examples, the diameter of the middle of shaft bore 533120 can be approximately 0.430 inch. The diameter of the bore bottom surface 53111 can be greater than or equal to approximately 0.320 inch and less than or equal to approximately 0.365 inch. In specific examples, the diameter of the bore bottom surface can be approximately 0.360 inch. The tip weight 56000 can comprise a cylindrical body having a body geometry corresponding shaft bore 533120. Tip weight 56000 comprises a height 56150 defined as the perpendicular distance between weight bottom surface 56100 and weight top surface 56200. The weight height ranges from 0.200 inch to 0.500 inch. For example, the weight height can be 0.200 inch, 0.220 inch, 0.240 inch, 0.260 inch, 0.280 inch, 0.300 inch, 0.320 inch, 0.340 inch, 0.360 inch, 0.380 inch, 0.400 inch, 0.420 inch, 0.440 inch, 0.460 inch, 0.480 inch, or 0.500 inch. In a specific example, the tip weight height 56150 of 0.260 inch. As mentioned above, the shaft sleeve body height 53120 can be extended by 0.200 inch to 0.500 inch to accommodate the tip weight height.

The tip weight 56000 can have a cylindrical shape so as to complement the interior shape of the shaft sleeve 511100. In many embodiments, the tip weight 56000 can have a diameter that is equal to the diameter of the interior portion of the shaft sleeve 511100 that houses the tip weight 56000. In other embodiments, the tip weight 56000 diameter can be slightly smaller than that of the interior shaft sleeve 511100 diameter. The tip weight 56000 fits into the shaft sleeve 511100 in a snug and secure manner, without substantial gaps, to prevent substantial lateral movement, twisting, or sliding of the weight 56000 during a swing.

In embodiments in which the tip weight 56000 is not fastened or secured with adhesive into the club head or shaft sleeve 511100, it can be quickly and easily installed and removed. In these embodiments, the tip weight 56000 can be dropped into the shaft sleeve 511100 prior to the shaft sleeve 511100 receiving the shaft. To remove, the user can remove the shaft 51102 from the shaft sleeve 511100 and tip the shaft sleeve 511100 upside down, allowing the tip weight 56000 to fall out. This makes it simple for a golfer to change the weight 56000 as desired. In a fitting session, a fitter can easily interchange tip weights 56000 of various masses to optimize the feel and performance of the golf club for any given golfer.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf coupling mechanisms and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf coupling mechanism between a golf club head and a golf club shaft, the golf coupling mechanism comprising:
- a shaft sleeve configured to be coupled to an end of the golf club shaft and a hosel;
- wherein:
  - the shaft sleeve comprises:
    - a shaft bore configured to receive the end of the golf club shaft;
    - a shaft sleeve body comprising a sleeve outer wall;
    - a shaft sleeve cap configured to be coupled with the shaft sleeve;
    - a coupler set comprising:
    - a first coupler protruding from the sleeve outer wall;
    - a second coupler protruding from the sleeve outer wall;
    - a third coupler protruding from the sleeve outer wall; and
    - a fourth coupler protruding from the sleeve outer wall;
  - the first coupler comprises a first arcuate surface curved throughout the first coupler;
  - the second coupler comprises a second arcuate surface curved throughout the second coupler;
  - the third coupler comprises a third arcuate surface curved throughout the third coupler;
  - the fourth coupler comprises a fourth arcuate surface curved throughout the fourth coupler;
- wherein the first arcuate surface, second arcuate surface, third arcuate surface, and fourth arcuate surface are symmetric in profile;
- wherein the shaft bore is further configured to receive and retain a tip weight; and
- wherein the tip weight is disposed between a bottom surface of the shaft bore and the end of the golf club shaft.

2. The golf coupling mechanism of claim 1, wherein:
- the shaft sleeve further comprises a shaft sleeve height, the shaft sleeve height ranging between 2.00 inches and 2.20 inches.

3. The golf coupling mechanism of claim 1, wherein:
- the first through fourth arcuate surfaces are configured to restrict the rotation of the shaft sleeve relative to the golf club head.

4. The golf coupling mechanism of claim 1, wherein:
- the shaft sleeve cap is removably coupled with the shaft sleeve body; and the shaft sleeve cap comprises soft polymeric plastic, wherein the soft polymer plastic can be no greater than 55 on the Shore D durometer scale.

5. The golf coupling mechanism of claim 1, wherein:
- the tip weight comprises a mass ranging from 3 grams to 7 grams.

6. The golf coupling mechanism of claim 1, wherein:
- the first through fourth couplers comprise a coupler length; and
- the coupler length is greater than or equal to approximately 0.260 inch and less than or equal to approximately 0.38 inch.

7. The golf coupling mechanism of claim 1, wherein:
- the tip weight comprises a height between 0.200 inch and 0.500 inch.

8. A golf coupling mechanism for a golf club head and a golf club shaft, the golf coupling mechanism comprising:
- a shaft sleeve configured to be coupled to an end of the golf club shaft and a hosel;
- a shaft receiver of the golf club head configured to receive the shaft sleeve;
- wherein:
  - the shaft sleeve comprises:
    - a shaft bore configured to receive the end of the golf club shaft;
    - a shaft sleeve body comprising a sleeve outer wall;
    - a shaft sleeve cap configured to be coupled with the shaft sleeve;
    - a coupler set comprising:
    - a first coupler protruding from the sleeve outer wall;
    - a second coupler protruding from the sleeve outer wall;
    - a third coupler protruding from the sleeve outer wall; and
    - a fourth coupler protruding from the sleeve outer wall;
  - the first coupler comprises a first arcuate surface curved throughout the first coupler;
  - the second coupler comprises a second arcuate surface curved throughout the second coupler;

the third coupler comprises a third arcuate surface curved throughout the third coupler;

the fourth coupler comprises a fourth arcuate surface curved throughout the fourth coupler; and the shaft receiver comprises:

a fifth coupler indented into a receiver inner wall;

a sixth coupler indented into the receiver inner wall;

a seventh coupler indented into the receiver inner wall; and an eighth coupler indented into the receiver inner wall;

the fifth coupler comprises a fifth arcuate surface curved throughout the fifth coupler;

the sixth coupler comprises a sixth arcuate surface curved throughout the sixth coupler;

the seventh coupler comprises a seventh arcuate surface curved throughout the seventh coupler;

the eighth coupler comprises an eighth arcuate surface curved throughout the eighth coupler;

wherein the coupler set is asymmetric in profile such that the first coupler is longer at a first part of the sleeve body outer wall of the shaft sleeve than the second, third, and fourth couplers;

wherein the shaft bore is further configured to receive and retain a tip weight; and wherein the tip weight is disposed between a bottom surface of the shaft bore and the end of the golf club shaft.

9. The golf coupling mechanism of claim 8, wherein:

the second coupler, third coupler, and fourth coupler are symmetrical in profile.

10. The golf coupling mechanism of 9, wherein:

the fifth coupler is longer at a first part of the receiver inner wall than the sixth, seventh, and eight couplers.

11. The golf coupling mechanism of claim 8, wherein:

the sixth coupler, seventh coupler, and eighth coupler are symmetrical in profile.

12. The golf coupling mechanism of claim 8, wherein:

the receiver coupler set of the shaft receiver is configured to engage the coupler set of the shaft sleeve and restrict the rotation of the shaft sleeve relative to the golf club head.

13. The golf coupling mechanism of claim 8, wherein:

the coupler set protrudes from a top section of the sleeve outer wall towards the sleeve top end.

14. The golf coupling mechanism of claim 8, wherein:

the receiver coupler set is indented into a top section of the receiver inner wall.

15. The golf coupling mechanism of claim 8, wherein:

a portion of one or more of the first coupler, second coupler, third coupler, and fourth coupler, of the sleeve coupler set, protrudes past a top end of the shaft receiver.

16. The golf coupling mechanism of claim 8, wherein:

a portion of one or more of the fifth coupler, sixth coupler, seventh coupler, and eighth coupler, of the sleeve coupler set, may protrude past a bottom end of one or more couplers of the coupler set.

17. The golf coupling mechanism of claim 8, wherein:

a contact area defined by the interface between the first coupler and one of the sixth coupler, seventh coupler, and eight coupler is approximately 51% to approximately 79%.

18. The golf coupling mechanism of claim 8, wherein:

a contact area defined by the interface between the first coupler and the fifth coupler is approximately 90% to approximately 95%.

19. The golf coupling mechanism of claim 8, wherein:

a contact area defined by the interface between one of the second coupler, third coupler, and fourth coupler, and one of the sixth coupler, seventh coupler, and eighth coupler is approximately 90% to approximately 95%.

* * * * *